US012215550B2

(12) United States Patent
Isted

(10) Patent No.: US 12,215,550 B2
(45) Date of Patent: Feb. 4, 2025

(54) WELL TOOL PRESSURE COMPENSATING SYSTEM AND METHOD

(71) Applicant: Madis XL Ltd., Calgary (CA)

(72) Inventor: Robert Edward Isted, Calgary (CA)

(73) Assignee: Madis XL Ltd., Calgary (CA)

( * ) Notice: Subject to any disclaimer, the term of this patent is extended or adjusted under 35 U.S.C. 154(b) by 41 days.

(21) Appl. No.: 18/315,198

(22) Filed: May 10, 2023

(65) Prior Publication Data

US 2024/0376787 A1 Nov. 14, 2024

(51) Int. Cl.

| | |
|---|---|
| ***E21B 17/02*** | (2006.01) |
| ***E21B 33/127*** | (2006.01) |
| ***E21B 41/00*** | (2006.01) |

(52) U.S. Cl.

CPC ..... *E21B 17/028* (2013.01); *E21B 17/025* (2013.01); *E21B 41/00* (2013.01); *E21B 33/1275* (2013.01)

(58) Field of Classification Search

CPC ..... E21B 17/023; E21B 17/02; E21B 17/025; E21B 17/028; E21B 17/0285

See application file for complete search history.

(56) References Cited

U.S. PATENT DOCUMENTS

| | | | |
|---|---|---|---|
| 3,547,193 | A | 12/1970 | Gill |
| 3,601,195 | A | 8/1971 | Hearn |
| 3,824,364 | A | 7/1974 | Cachat |
| 4,008,761 | A | 2/1977 | Fisher et al. |
| 4,043,393 | A | 8/1977 | Fisher et al. |
| 4,344,483 | A | 8/1982 | Fisher et al. |
| 4,484,627 | A | 11/1984 | Perkins |
| 4,489,782 | A | 12/1984 | Perkins |
| 4,538,682 | A | 9/1985 | Mcmanus et al. |
| 4,951,748 | A | 8/1990 | Gill et al. |
| 5,099,918 | A | 3/1992 | Bridges et al. |
| 5,233,304 | A | 8/1993 | Hubans |
| 5,282,508 | A | 2/1994 | Ellingsen et al. |
| 5,293,936 | A | 3/1994 | Bridges |
| 5,323,855 | A | 6/1994 | Evans |

(Continued)

FOREIGN PATENT DOCUMENTS

| | | | |
|---|---|---|---|
| CA | 866574 | A | 3/1971 |
| CA | 2090629 | C | 12/1998 |

(Continued)

*Primary Examiner* — Robert E Fuller
(74) *Attorney, Agent, or Firm* — David Guerra

(57) ABSTRACT

A well tool pressure compensating system for connecting well tubing sections or well tools and providing pressure and/or thermal compensation along the entire length of the tool in a wellbore. The system can include first and second connectors each including fluid components and power and/or signal components. A tubing allows fluid to travel between the first and second connectors and along the tool. A hose traveling along and within the tool is in fluid communication with a wellbore fluid, thereby providing pressure and thermal compensation along the tool. A flexible tubing extends between the first and second connectors within the tool. The flexible tubing is in fluid communication with an area around the power and/or signal components of the first and second connectors, thereby providing pressure and/or thermal compensation around the power and/or signal components.

19 Claims, 28 Drawing Sheets

(56) References Cited

U.S. PATENT DOCUMENTS

| | | | | |
|---|---|---|---|---|
| 5,361,845 | A | 11/1994 | Jamaluddin et al. | |
| 5,366,623 | A | 11/1994 | Clair | |
| 5,454,943 | A | 10/1995 | Ashton et al. | |
| 5,465,789 | A | 11/1995 | Evans | |
| 5,539,853 | A | 7/1996 | Jamaluddin et al. | |
| 6,017,198 | A * | 1/2000 | Traylor | E21B 43/129 417/539 |
| 6,112,808 | A | 9/2000 | Isted | |
| 6,800,642 | B2 | 10/2004 | Tran et al. | |
| 6,802,375 | B2 | 10/2004 | Bosma et al. | |
| 7,409,990 | B1 | 8/2008 | Burts, Jr. et al. | |
| 7,510,004 | B1 | 3/2009 | Hessert et al. | |
| 7,640,965 | B2 | 1/2010 | Bosma et al. | |
| 7,669,653 | B2 | 3/2010 | Craster et al. | |
| 7,730,956 | B2 * | 6/2010 | Smithson | E21B 47/017 166/385 |
| 8,307,899 | B2 | 11/2012 | Brenneis et al. | |
| 2002/0129945 | A1 * | 9/2002 | Brewer | E21B 47/017 166/242.6 |
| 2010/0006289 | A1 | 1/2010 | Spencer | |
| 2011/0061934 | A1 * | 3/2011 | Jekielek | E21B 17/028 248/560 |
| 2017/0089168 | A1 | 3/2017 | Carragher | |
| 2017/0187177 | A1 * | 6/2017 | Mangum | H02G 15/02 |
| 2017/0204680 | A1 * | 7/2017 | Leismer | H01R 13/5219 |
| 2019/0360293 | A1 * | 11/2019 | Mack | E21B 17/206 |

FOREIGN PATENT DOCUMENTS

| | | | |
|---|---|---|---|
| CA | 2937762 | C | 8/2018 |
| CN | 102132002 | B | 6/2014 |
| RU | 2010954 | C1 | 4/1994 |
| SU | 1298354 | A1 | 3/1987 |
| WO | 2018063822 | A1 | 4/2018 |

* cited by examiner

WELL TOOL PRESSURE COMPENSATING SYSTEM AND METHOD

BACKGROUND

Technical Field

One or more embodiments of the present technology relates to a well tool pressure compensating system and method for use in connection with utilizing a plug connection assembly to connect adjacent well tubing. Further, one or more embodiments of the present technology can be utilized in connection with providing an aligned connection between well tubing or tool sections without rotation of the tool section enabling shop prepared mating connector assemblies that are quickly and correctly coupled together onsite. Still further, one or more embodiments of the present technology can be utilized in connection with a well tubing plug connection including pressure compensation. In some embodiments of the present technology, the pressure compensation is capable of utilizing a hose that extends a length of a tool ensuring that pressure inside the tool is equal to that on an exterior surface thereof or in an annulus of a well casing or well bore.

Background Description

Present and known well tubing connectors typically require rotation of the connection parts, which is time consuming and not ideal for aligning power and/or communication plugs. Any damage to the present connectors requires shop remediation that results in significant down time and costs.

Known configurations employ a pup joint to join sections together. Each pup joint has a male and female set of Power Feed Through (PFT) connectors, signal wires and a pressure compensating bellows. Because of the heavy wires it is necessary to back spin, to alleviate some twisting in the wires, fill and degas the fluid, balance the pressure and makeup two joints. All of these actions halt the run-in operation. If the female connector is damaged it could be replaced in the field but the male portion is in the tool and requires factory remediation.

In the exemplary, connectors can be utilized with induction heating systems that employ a number of inductors encased in a carbon steel tube, metallic tube stainless or steel tube, and when they are electrically powered, heat the well casing and nearby strata. The increased temperature reduces the fluid viscosity and may change a non-Newtonian deposit (wax or bitumen) to a fluid enabling an increase in produced fluid.

These known induction systems have disadvantages with pressure compensation along the length of the tool, with some systems utilizing bellows and/or flexible plates as a solution. However, these solutions are complex and costly, and are not easily associated with the connectors.

SUMMARY

In view of the foregoing disadvantages inherent in the known types of connectors, the present technology provides a novel well tool pressure compensating system, and overcomes one or more of the mentioned disadvantages and drawbacks of known systems. As such, the general purpose of the present technology, which will be described subsequently in greater detail, is to provide a new and novel well tool pressure compensating system and method which has all the advantages of known systems mentioned heretofore and many novel features that result in a well tool pressure compensating system which is not anticipated, rendered obvious, suggested, or even implied by known systems, either alone or in any combination thereof.

According to one aspect, the present technology can include a well tool pressure compensating system that can include a first connector body, a second connector body and a compensation hose. The first connector body can include one or more first fluid components configured to allow fluid to pass therethrough, and one or more first electrical components configured for connection with one or more wires associated with a well tool. The second connector body can include one or more second fluid components configured to allow the fluid to pass therethrough, and one or more second electrical components configured for connection with the wires. The compensation hose can travel within the well tool and can be in fluid communication with a wellbore fluid in a wellbore. The compensation hose can be configured to provide pressure and thermal compensation along the well tool.

According to another aspect, the present technology can include a well tool pressure compensating system that can include a first connector body comprising, a second connector body, a first tubing, a hose assembly and a flexible tubing. The first connector body can be of a well tool, and can include one or more first fluid components configured to allow fluid to pass therethrough and one or more first electrical components configured for connection with one or more wires associated with the well tool. The second connector body can be of the well tool opposite the first connector body, and can include one or more second fluid components configured to allow the fluid to pass therethrough and one or more second electrical components configured for connection with the wires associated with the well tool. The first tubing can be in fluid communication with at least one of the first fluid components and at least one of the second fluid components. The hose assembly can travel along and within the well tool and can be in fluid communication with a wellbore fluid in a wellbore. The hose assembly can include an outer hose enclosed by a gel within the well tool, and an inner hose in fluid communication with the wellbore fluid. The hose assembly can be configured to provide pressure and thermal compensation along the well tool. The flexible tubing can extend between the first connector body and the second connector body, and can be in fluid communication with an area around the electrical components and an area around the second electrical components.

According to yet another aspect, the present technology can include a well string system including one or more packers each including a pressure compensating connector system. The pressure compensating connector system can include a first connector body comprising, a second connector body, a first tubing and a compensation hose. The first connector body can include one or more first fluid components configured to allow fluid to pass therethrough, and one or more first electrical components configured for connection with one or more wires associated with the packers. The second connector body can include one or more second fluid components configured to allow the fluid to pass therethrough, and one or more second electrical components configured for connection with the wires. The first tubing can be in fluid communication with at least one of the first fluid components and at least one of the second fluid components. The compensation hose can travel within the packers and can be in fluid communication with a wellbore fluid in a wellbore. The compensation hose can be configured to provide pressure and thermal compensation along the packers.

According to yet even another aspect, the present technology can include a well string system including one or more induction heaters each including a pressure compensating connector system. The pressure compensating connector system can include a first connector body comprising, a second connector body, a first tubing and a compensation hose. The first connector body can include one or more first fluid components configured to allow fluid to pass therethrough, and one or more first electrical components configured for connection with one or more wires associated with the induction heaters. The second connector body can include one or more second fluid components configured to allow the fluid to pass therethrough, and one or more second electrical components configured for connection with the wires. The first tubing can be in fluid communication with at least one of the first fluid components and at least one of the second fluid components. The compensation hose can travel within the induction heaters and can be in fluid communication with a wellbore fluid in a wellbore. The compensation hose can be configured to provide pressure and thermal compensation along the induction heaters.

According to still yet another aspect, the present technology can include a method of using a well tool pressure compensating system. The method can include the steps of providing a first connector body on a well tool and a second connector body on the well tool opposite the first connector body. The first connector body can include one or more first fluid components and one or more first electrical components. The second connector body can include one or more second fluid components and one or more second electrical components. Allowing a fluid to flow between the first fluid components and the second fluid components by way of a first tubing extending within the well tool between the first connector body and the second connector body.

Exposing a wellbore fluid from a wellbore to both ends of a hose extending along and within the well tool between the first connector body and the second connector body.

In some or all embodiments, the first connector body can include an interior chamber, and a cover configured to mate with the first connector body and cover the interior chamber.

In some or all embodiments, the first connector body and the cover can each include grooves that align and correspond with each other when the cover is mated with the first connector body. The grooves can be configured to receive and guide one or more wires or conduits into the interior chamber.

In some or all embodiments, the second connector body can include a spring biased member configured to provide pressure on a seal associated with at least one of the second electrical components during temperature and pressure variations encountered in the interior chamber.

Some or all embodiments of the present technology can include a guide pin associated with any one of or any combination of the first fluid components and the second fluid components. The guide pin can have defined a passageway therethrough allowing the fluid to therethrough.

Some or all embodiments of the present technology can include multiple guide pins which can connect to any one of or any combination of a pressure sensor to indicate pressure at a certain location, a discharge port to enable fluid injection along the tool, a sample port, and to provide a means of controlling another packer or set of packers.

Some or all embodiments of the present technology can include a connector chamber defined between the first connector body and the second connector body. The connector chamber can be pressure compensated with respect to the well tool and the wellbore.

Some or all embodiments of the present technology can include a first tubing that can be in fluid communication with at least one of the first fluid components and at least one of the second fluid components.

In some or all embodiments, the first electrical components can each include a first power insert, and the second electrical components can each include a second power insert. The first power insert and the second power insert can be operatively engageable with each other.

In some or all embodiments, the first power insert can be a sleeve, and the second power insert can be a connector receivable in the sleeve.

In some or all embodiments, the connector can have a barrel or curved shape configured to accommodate misalignment when the connector is engaged in the sleeve. In some or all embodiments, the first electrical components can each include a first signal insert, and the second electrical components can each include a second signal insert. The first signal insert and the second signal insert can be operatively engageable with each other.

In some or all embodiments, the first signal insert and the second signal insert can each include one or more spring pins.

In some or all embodiments, the compensation hose can include an outer hose enclosed by a gel within the well tool, and an inner hose in fluid communication with the wellbore fluid.

In some or all embodiments, the compensation hose can be along an entire length of the well tool and can be configured to enable elastic distortion of the gel due to expansion and contraction to partially collapse the compensation hose. Ends of the compensation hose can be open to an annulus of the wellbore where a wellbore pressure can be present on an inside of the compensation hose therefore allowing pressure on the gel and on an inside of the well tool to be equal thus providing compensation for volume and pressure changes so as to avoid collapse of the well tool.

Some or all embodiments of the present technology can include one or more register pins associated with any one of or any combination of the first connector body and the second connector body. The register pins can be configured to ensure rotational alignment and torsion restraint when the first connector body or the second connector body is joined with a mating body, respectively.

In some or all embodiments, the first connector body can include an upper connector body, a first intermediate body and a first compensator body. The upper connector body can include the first electrical components and the first fluid components. The first intermediate body can be engageable to the upper connector body, and can include one or more first passageways defined therethrough each in fluid communication with the first fluid components and the first tubing, respectively, and one or more first electrical inserts in communication with the first electrical components and the wires. The first compensator connector body can be engageable to the first intermediate body and the well tool. A first end of the compensation hose can be associated with the first compensator connector body. An interior of the first compensator connector body can be in communication with an interior of the well tool to contain a gel for providing any one of or combination of pressure and thermal compensation to the compensation hose.

In some or all embodiments, the second connector body can include a second compensator connector body, a second intermediate body and a lower connector body. The second compensator connector body can be engageable to the well tool opposite to the first compensator connector body. A second end of the compensation hose can be associated with the second compensator connector body. An interior of the second compensator connector body can be in communication with the interior of the well tool to contain the gel. The second intermediate body can be engageable to the second compensator connector body, and can include one or more second passageways defined therethrough each in fluid communication with the first tubing and the second fluid components, respectively, and one or more second electrical inserts in communication with the second electrical components and the wires. The lower connector body can be engageable with the second intermediate body, and can include the second electrical components.

In some or all embodiments, a hollow guide pin can connect each of the first fluid components with the second fluid components, respectively.

Some or all embodiments of the present technology can include a flexible tubing that can extend between the first intermediate body and the second intermediate body. The flexible tubing can be in fluid communication with an area around the first electrical inserts and an area around the second electrical inserts.

Some or all embodiments of the present technology can include a flexible tubing that can extend between the first connector body and the second connector body. The flexible tubing can be in fluid communication with an area around the first electrical inserts and an area around the second electrical inserts.

Some or all embodiments of the present technology can include one or more capillary tubes in fluid communication with any one of or any combination of the first fluid components and the second fluid components.

In some or all embodiments, the well tool can be selected from the group consisting of an induction heater, a packer, and a spacer tubing.

In some or all embodiments, the well tool is a packer including a bladder and a support pipe inside the bladder. An internal area between the support pipe and the bladder can be in fluid communication with the first fluid components and the second fluid components, respectively.

In some or all embodiments, the first electrical components and the second electrical components can each be surrounded by any one of or any combination of a rubber sleeve, a castable epoxy, and polyetheretherketone (PEEK).

In some or all embodiments, any one of or any combination of the first electrical components and the second electrical components can each include a conductive connector sleeve having fingers capable of receiving a conductive inner connector from a mating connector, a rubber connector insulator that can surround the connector sleeve, a power insert including a first conductive inner connector at a first end and a second conductive inner connector at an opposite second end. The first conductive inner connector can be received in the connector sleeve. The second conductive inner connector can be in communication with at least one of the wires.

In some or all embodiments, any one of or any combination of the first electrical components and the second electrical components can each include a spring pin guide that can include an alignment tab and that can receive multiple conductive spring pins. A rubber insulator sleeve can receive the spring pin guide and can include a slot that can receive the alignment tab. The first connector body or the second connector body can define a keyway that can be configured to receive the alignment tab.

In some or all embodiments, a signal insert can be included with any one of or any combination of the first electrical components and the second electrical components. The signal insert can be in communication with the spring pins by way of conductors in the signal insert. The signal insert can include an alignment tab receivable in a keyway defined in the first connector body or the second connector body.

In some or all embodiments, any one of or any combination of the first electrical components and the second electrical components include a first spring pin guide including conductive spring pins, a first signal insert including conductors each in communication with at least one of the spring pins, a second spring pin guide including conductive second spring pins each in communication with at least one of the conductors, and a second signal insert including signal wire receptacles in communication with at least one of the second spring pins.

In some or all embodiments, the first spring pin guide, the first signal insert, the second spring pin guide and the second signal insert can each include an alignment tab that can be received in a keyway defined in the first connector body or the second connector body.

Some or all embodiments of the present technology can include a combiner hub that can include a first end including multiple first ports each configured to receive one or more of the wires, and a second end including one second port configured to group all the wires.

In some or all embodiments, the wires can be received in a flexible second hose configured to provide pressure compensation. An adapter can be utilized at each end of the flexible second hose for connection to the first connector body and the second connector body, respectively.

In some or all embodiments, any one of or combination of the first fluid components and the second fluid components can include a valve for controlling the fluid flowing therethrough.

Some or all embodiments of the present technology can include one or more adapter connectors attachable onto a wellbore tubing to enable well tool wiring and fluid channels to continue past unproductive zones of the wellbore or to reduce a size of the well tool.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology.

It is therefore an object of the present technology to provide a new and novel well tool pressure compensating system that has all of the advantages of known systems and none of the disadvantages.

It is another object of the present technology to provide a new and novel well tool pressure compensating system that may be easily and efficiently manufactured and marketed.

An even further object of the present technology is to provide a new and novel well tool pressure compensating system that has a low cost of manufacture with regard to both materials and labor, and which accordingly is then susceptible of low prices of sale to the consuming public, thereby making such well tool pressure compensating system economically available to the buying public.

Still another object of the present technology is to provide a new well tool pressure compensating system that provides in the apparatuses and methods of known systems some of the advantages thereof, while simultaneously overcoming some of the disadvantages normally associated therewith.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology. Whilst multiple objects of the present technology have been identified herein, it will be understood that the claimed present technology is not limited to meeting most or all of the objects identified and that some embodiments of the present technology may meet only one such object or none at all.

BRIEF DESCRIPTION OF THE DRAWINGS

The present technology will be better understood and objects other than those set forth above will become apparent when consideration is given to the following detailed description thereof, with phantom lines (long-short-short-long lines) depicting environmental structure and may form no part of the claimed present technology. Such description makes reference to the annexed drawings wherein:

DETAILED DESCRIPTION OF THE EMBODIMENTS

Figure 1:
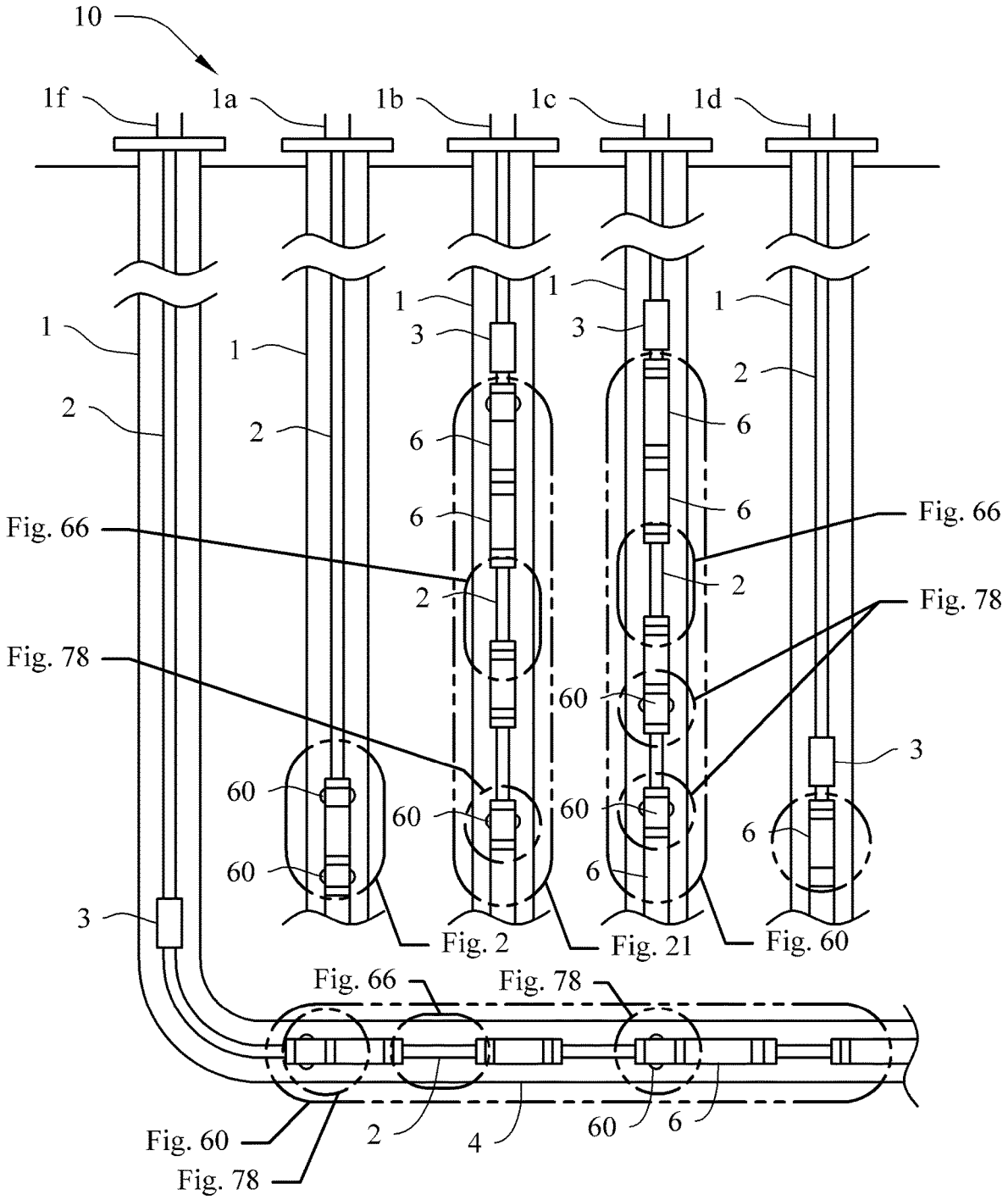
FIG. 1 is a well site system utilizing embodiments of the well tool pressure compensating system in vertical or horizontal wellbores constructed in accordance with the principles of the present technology.

While the above-described devices fulfill their respective, particular objectives and requirements, the aforementioned devices or systems do not describe a well tool pressure compensating system that allows utilizing a plug assembly to connect adjacent well tubing. The present technology additionally overcomes one or more of the disadvantages associated with known connection systems.

A need exists for a new and novel well tool pressure compensating system that can be used for utilizing a plug assembly to connect adjacent well tubing. In this regard, the present technology substantially fulfills this need. In this respect, the well tool pressure compensating system according to the present technology substantially departs from the conventional concepts and designs of known systems, and in doing so provides an apparatus primarily developed for the purpose of utilizing a plug assembly to connect adjacent well tubing.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

One or more embodiments of the present technology can provide a means for a device submerged in a fluid to withstand external pressure by balancing pressure within a device to pressure on an external surface of the device. The embodiments can provide a means for adjusting an internal volume of the device to compensate for volume changes to components of the device. Such changes may be due to, but not limited to, mechanical or thermal changes to the device, gas trapped in the device or changes to the device's environment. The embodiment enables a volume change to affect pressure compensation and is referred to as a compensator.

One or more embodiments of the present technology can be an operation to adjust the internal volume of the device (volume compensation) to ensure a balance between pressure on the external surface of the enclosure and internal pressure is maintained throughout the device in order to avoid damage to the device enclosure. Without compensation, any event that creates pressure within the device that is greater than the external pressure may stress the enclosure causing it to yield resulting in an increased internal volume. A common cause of an increase in volume is due to thermal expansion of the components within the device. Similarly a decrease in volume either as a result of a return to previous conditions or other factors such as, but not limited to, a compressible component within the device may cause collapse, crushing or damage to the enclosure.

In addition to thermal related volume changes air or gas may be entrained in gel or liquid employed as fill around components within a device rendering the device susceptible to collapse when external pressure is sufficient to distort or crush the device enclosure. Conditions under which the device operates and construction of the device affects the embodiments with respect to material selection, volume of compensation required, fluid selection and assembly procedures.

While a long tubular device is shown in order to illustrate operation of the embodiment the embodiment may form other shapes. Pressure equalization is accomplished by allowing fluid from the exterior surface to exert pressure across a membrane within the device resulting in a change in volume enclosed by the membrane. The volume within the membrane increases or decreases in response to volume changes of components within the device to balance pressure across the device enclosure thus preventing crushing or stretching of the enclosure. Without compensation expansion that is sufficient to cause yielding of the tube wall will increase the internal volume of the device. When the component volume lowers or returns to original value external pressure will be greater than internal pressure rendering the device subject to crushing. Devices that must have a tube with a thin wall, in order to function for their intended purpose, are susceptible to crushing of the tube as a result of the difference in pressure between the external and internal surfaces. A means of pressure compensation which extends throughout the device may be employed to prevent damage to the device independent of wall thickness. Some devices may benefit as a result of a compensator that minimizes the wall strength required to prevent stretching, crushing and/or distortion.

One or more embodiments of the present technology can include a well tool pressure compensating system 10 that can include a first connector body, a second connector body, a first tubing and a compensation hose. The first connector body can include one or more first fluid components configured to allow fluid to pass therethrough, and one or more first electrical components configured for connection with one or more wires associated with a well tool. The second connector body can include one or more second fluid components configured to allow the fluid to pass therethrough, and one or more second electrical components configured for connection with the wires. The first tubing can be in fluid communication with at least one of the first fluid components and at least one of the second fluid components. The compensation hose can travel within the well tool and can be in fluid communication with a wellbore fluid in a wellbore. The compensation hose can be configured to provide pressure and thermal compensation along the well tool.

Figure 94:
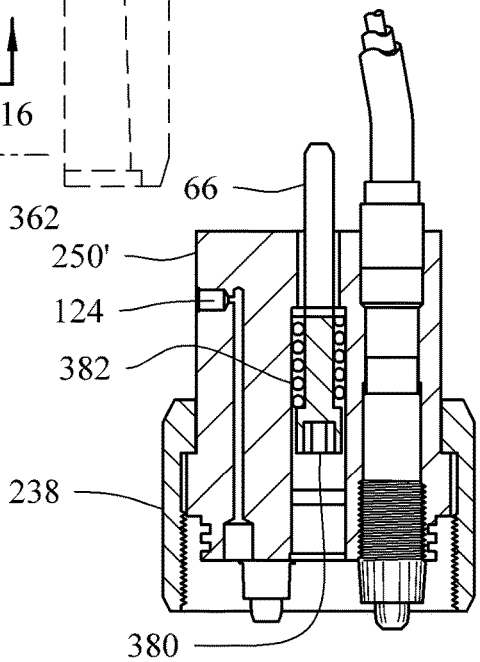
FIG. 94 is a cross-sectional view of the alternate connector assembly of FIG. 89. The same reference numerals refer to the same parts throughout the various figures.

Referring now to the drawings, and particularly to FIGS. 1-94, one or more embodiments of the well tool pressure compensating system of the present technology is shown and generally designated by the reference numeral 10. In an embodiment, a hose extending along the tool can provide pressure compensation with a minimum of longitudinal movement in a gel.

In FIG. 1, a new and novel well tool pressure compensating system 10 of the present technology for utilizing a plug assembly to connect adjacent well tubing is illustrated and will be described. In an embodiment, the present technology can be utilized with different assemblies and/or tools in a downhole well casing 1. Some of the various combinations that may be assembled with components having compatible connectors are shown. Multiple exemplary configurations are shown in FIG. 1. The present technology can be utilized with a spacer or well tubing 2, which can be associated with a pump 3 in either vertical well casings 1 or horizontal well casings 4. For example, a configuration 1*a* can be for well abandonment of a thin zone (less than 12 meters) requiring moderate heat input but could also be utilized for water flood or similar injection activities. One or more induction heaters 6 can be utilized and can be individually controlled. In an embodiment, the present technology may be constructed for use in an open hole in which there is no casing.

Another exemplary configuration 1*b* can be with packers 60 for thicker zones that may or may not, include the use of spacer tubing. Packer 60 and induction heaters 6 can be utilized and can be individually controlled.

Still another exemplary configuration 1*c* can include multiple tool sections depicting two packers 60 and straddling spacer tubing 2, as might be used to block flow from a water stringer. This configuration may include multiple straddle packers or none depending on zone requirements. The features enable adapting in a modular way to site conditions.

Still yet another exemplary configuration 1*d* can utilize a tool, without a packer, with a length of about 12 meters or less.

Yet still another exemplary configuration can be similar to configuration 1*b* however deployed in a horizontal well 4.

Different embodiments of the present technology used in the above exemplary configurations are shown in more detail with reference to their corresponding figure numeral.

Figure 2:
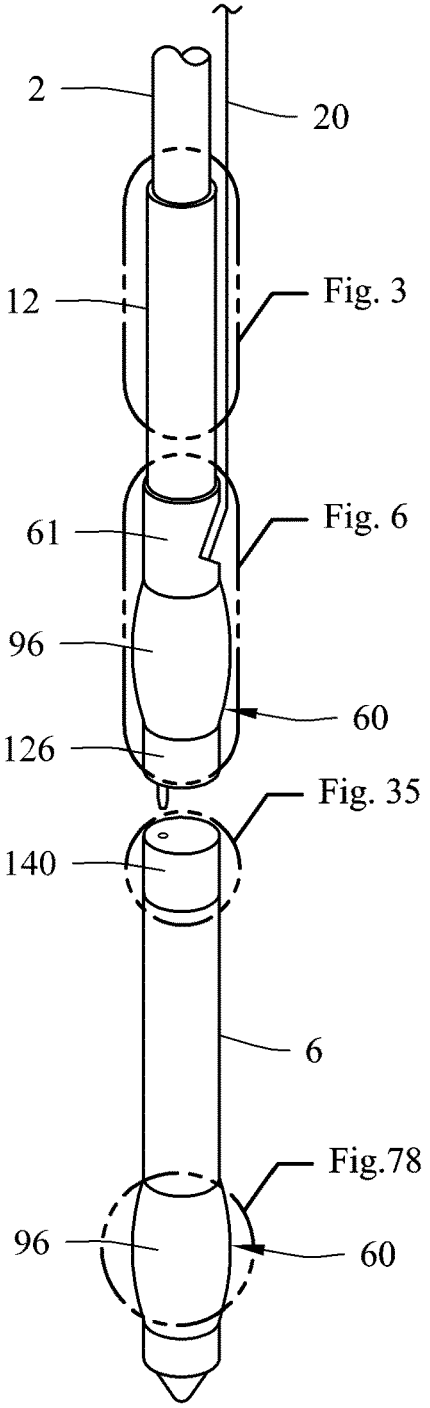
FIG. 2 is an exploded perspective view of an assembly of components of an embodiment of the present technology associated with an inflatable packer, an induction heater, a tubing wiper catcher and connection units taken along section FIG. 2 in FIG. 1.

Referring to FIG. 2, a pictorial diagram linking the system configuration to the component figure number is illustrated, along with certain components that may be common in different configurations. The depictions focus on how the features enable different components to be interconnected for numerous applications. The features of each component are described in their respective figures as they may be part of many different configurations. In an embodiment, all of the assemblies are suspended from the well tubing 2 with an Electric Submersible Pump (ESP) power cable 20 for electrical supply and signal transfer from a tool to a Power Control Unit (PCU).

Figure 22:
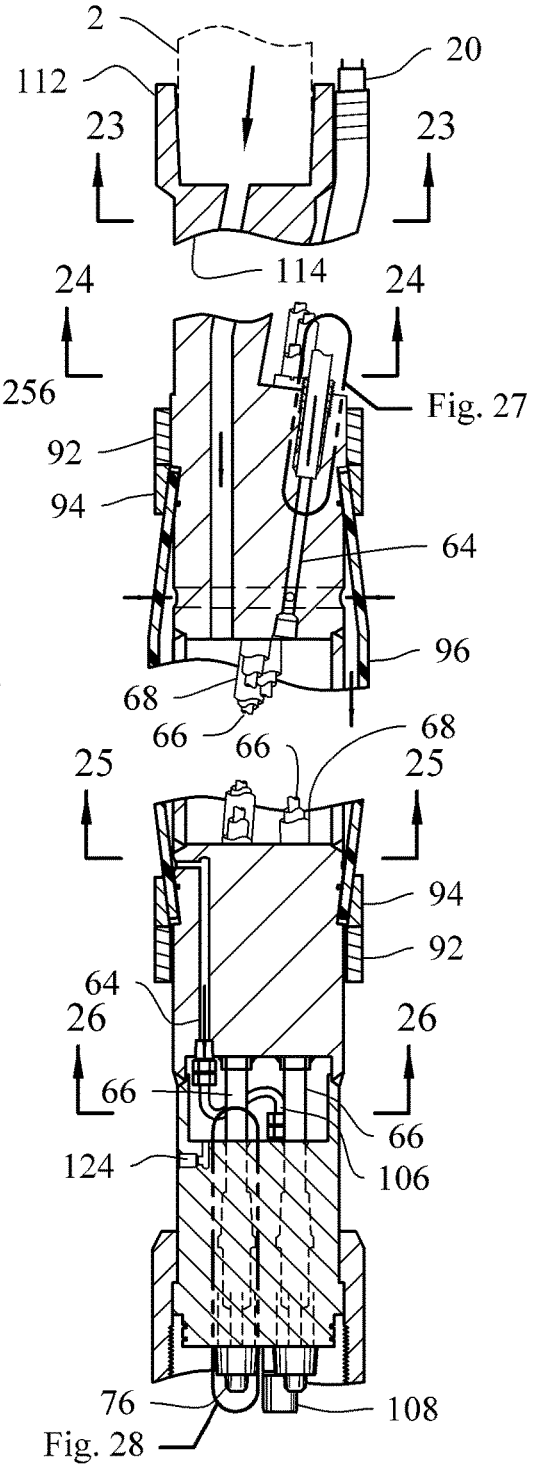
FIG. 22 is a cross-section view of the packer body with three phase wiring taken along section FIG. 22 in FIG. 21.

A configuration having a method of inflating packers 60, an induction heating section 6 and a tubing wiper catcher 12 complete with blow out port is broadly shown in FIG. 2. The configuration can also be utilized for localizing injection of a fluid delivered from the surface through the well tubing 2 and heated in the space between packers. The pressure needed for fluid injection is applied to the packer pump reservoir hose so that inflation of the packers 60 can take place with a readily available immersed fuel pump capable of increasing the pressure by about 110 PSI (700 kPa). If more pressure is needed to isolate the zone or if more fluid volume is required the packer fluid reservoir and pump can be replaced by three wire unit and a capillary tube as best illustrated in FIG. 22, and packer inflation pressure supplied from the surface.

The packer fluid reservoir, a pump for inflating the packers and a wiper catcher chamber can be a configuration that could be used for abandonment activities.

Figure 3:
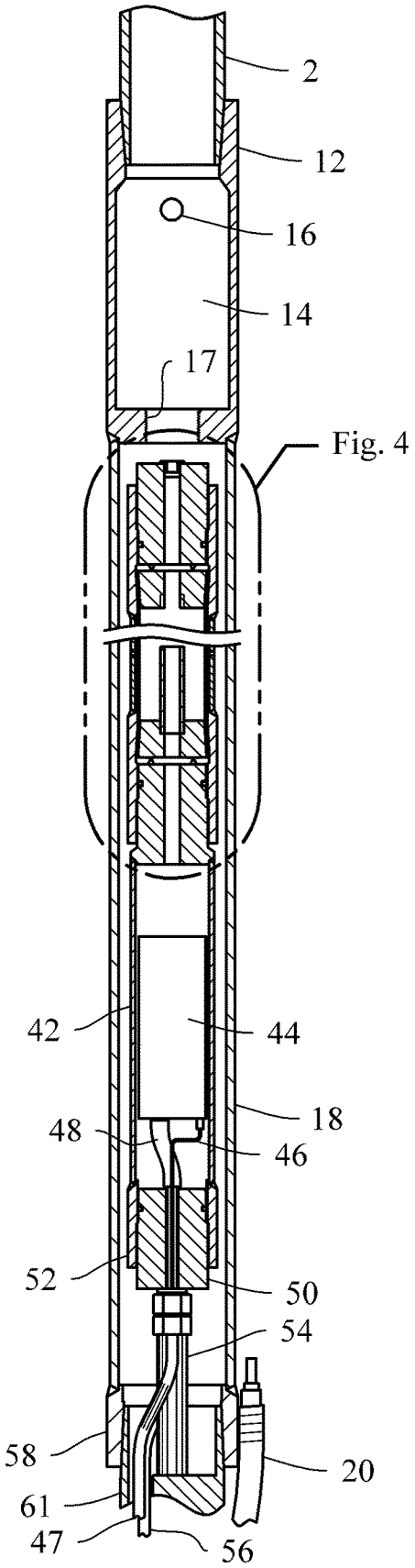
FIG. 3 is a cross-sectional view of the wiper catcher taken along section FIG. 3 in FIG. 2.
Figure 4:
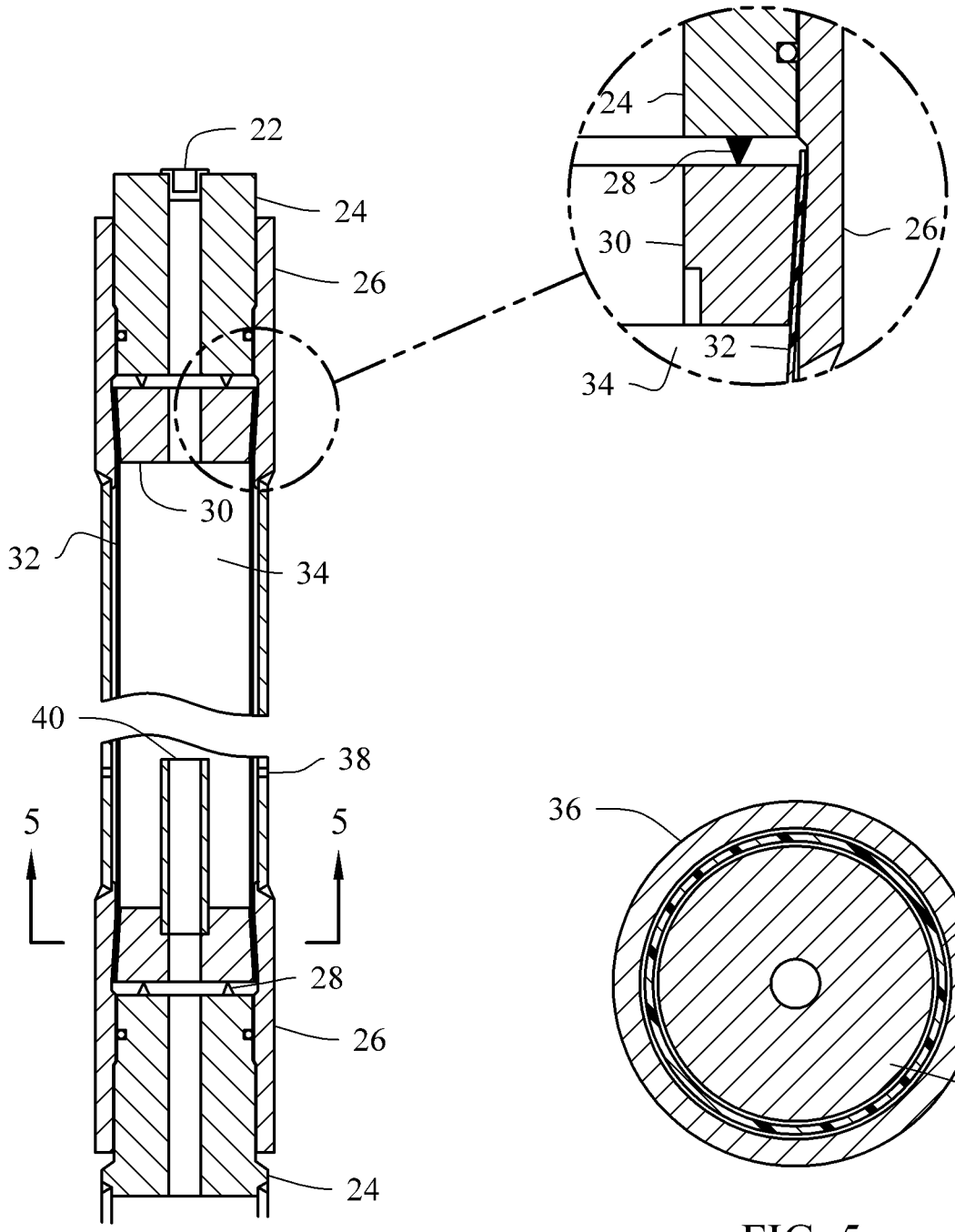
FIG. 4 is a cross-sectional view of a reservoir hose with perforations taken along section FIG. 4 in FIG. 3.
Figure 5:
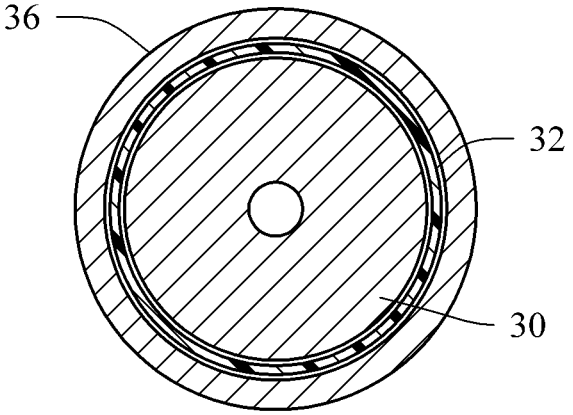
FIG. 5 is a cross-sectional view of the reservoir hose taken along line 5-5 in FIG. 4.

A wiper catcher 12, as shown in FIGS. 3-5, can be coupled to the wellbore tubing 2 so that an interior chamber of the tubing 2 is in fluid communication with a wiper chamber 14. The chamber 14 can include a blowout port 16 to enable flushing action of the tubing 2 following application of a sealant during wellbore abandonment activities. For squeezes and injection operations the blowout port 16 may be plugged. Pressure can build when the wiper catcher 12 hits the receiving chamber, at which the plug may blow allowing flushing liquid to drain from the port 16. Threading 17 can be utilized for the wiper catcher 12.

A pipe 18 containing a packer fluid reservoir 34 (see FIG. 4) and a packer pump 44 extends downward to attach to the tool assembly. A perforated support tube 36 containing a flexible tubular packer fluid reservoir (hose) 32 enables a small electrically controlled pump, delivering about 690 kPa in addition to the injection fluid pressure, sufficient pressure to inflate the packers. The packer fluid reservoir 34 can be inside the flexible hose 32.

The hose 32 is retained and sealed at each end of the support tube 36 by a threaded, tapered walled end piece 26 and an inner tapered plug 30 which is screwed in to press the taper end piece 26 to form a seal with the hose 32.

A wafer spring 28 may be placed between the tapered end piece 26 and the tapered plug 30 to ensure integrity of the seal during expansion and contraction of the hose 32 due to temperature changes. The packer pump 44, located below the packer fluid reservoir 34, boosts the injection fluid pressure to about 700 kPa which is sufficient to inflate the packers. When the packer pump 44 is OFF back flow of packer fluid allows the packer to distend or a solenoid valve may be employed if faster release is needed.

The power cable 20 can be strapped to the side of the tubing 2 and can extend from the surface PCU to the tool so as to transition to inside the tubing in order to make electrical connection to the tool. A separable sub can be utilized that enables that transition without the danger of damaging the power cable 20 damage during screwing of the sub to the tool.

The enlarged section of FIG. 4 illustrate a method of retaining and sealing the packer fluid reservoir hose 32 utilizing the tapered wall of the end piece 26 and the tapered wall of the plug 30.

The packer pump 44 can be enclosed in a packer pump chamber 42 having a passageway from the packer fluid reservoir 34 with a discharge hose 48 connecting to a pump chamber plug 50 sealing a lower end of the packer pump chamber 42. The pump chamber plug 50 can be a threaded plug with one or more passages for fluid and wires, while sealing a bottom end of the pump chamber 42.

A reservoir lower nipple 40 can be utilized to enable pump suction to be above any sediment in the hose 32. A passageway through the pump chamber plug 50 connects the pump discharge hose 48 to the tool packer fluid passageway through a nipple 54. The nipple 54 can be a connecting nipple between the fluid reservoir pipe and the fluid passage to the packer(s). A second hole through the pump chamber plug 50 can be utilized to enable a power supply wire 46 to connect to the packer pump 44 and exit in a tubing to the tool.

A tubing connector or a pump chamber threaded end piece 52 can be utilized to retain the pump chamber plug 50 to the packer pump chamber 42. Further, a mineral insulated heating cable 56 can exit the pump chamber plug 50 to the tool. The heating cable 56 can be connected to the ESP cable 20 to keep sealant passages from solidifying. Still further, a connection end or pipe nipple 58 can couple the pipe 18 to a packer upper body 61.

Referring to FIGS. 6-34, an overall section through the packer portion 60 of the tool is illustrated. There may be some instances when a tube extending into the tool may not provide sufficient fluid to ensure pressure compensation of connector cavities in which case a bellows 132 and plenum 136 may be included (see FIG. 29). If the process is abandonment of the wellbore, then a conventional wiper catcher would be included above the packer 60 however it could be used for injection, water flood or similar processes. Pressure supplied through a capillary tube would cause packer inflation.

Figure 6:
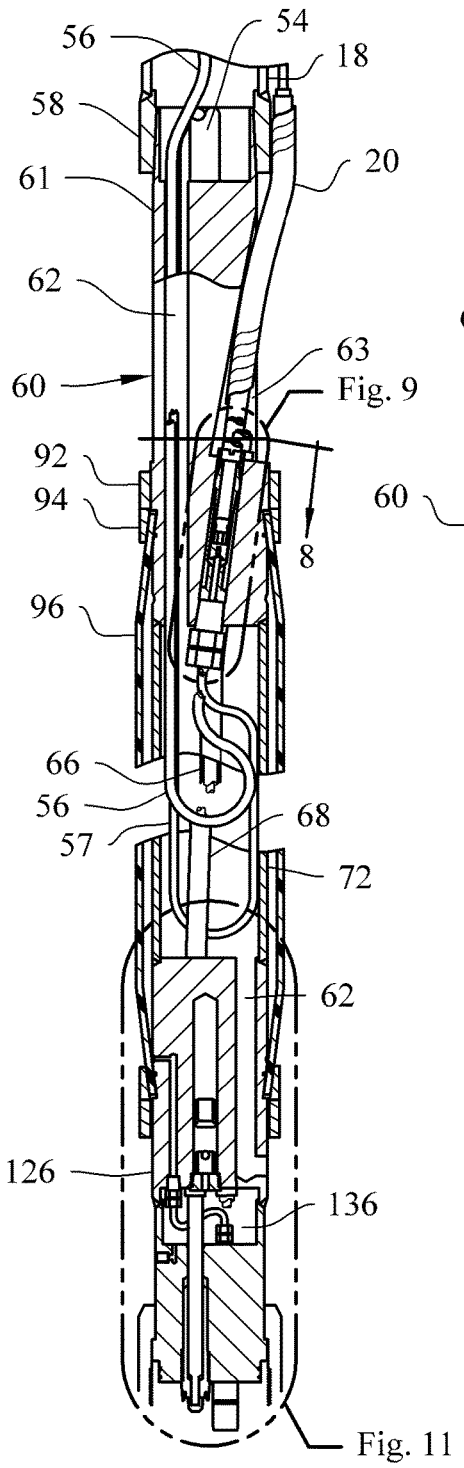
FIG. 6 is a cross-sectional view of an upper packer body taken along section FIG. 6 in FIG. 2.
Figure 7:
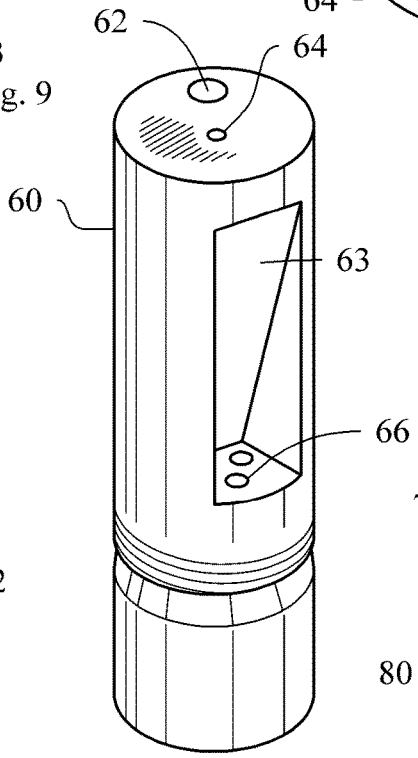
FIG. 7 is a perspective view of the upper packer body.
Figure 11:
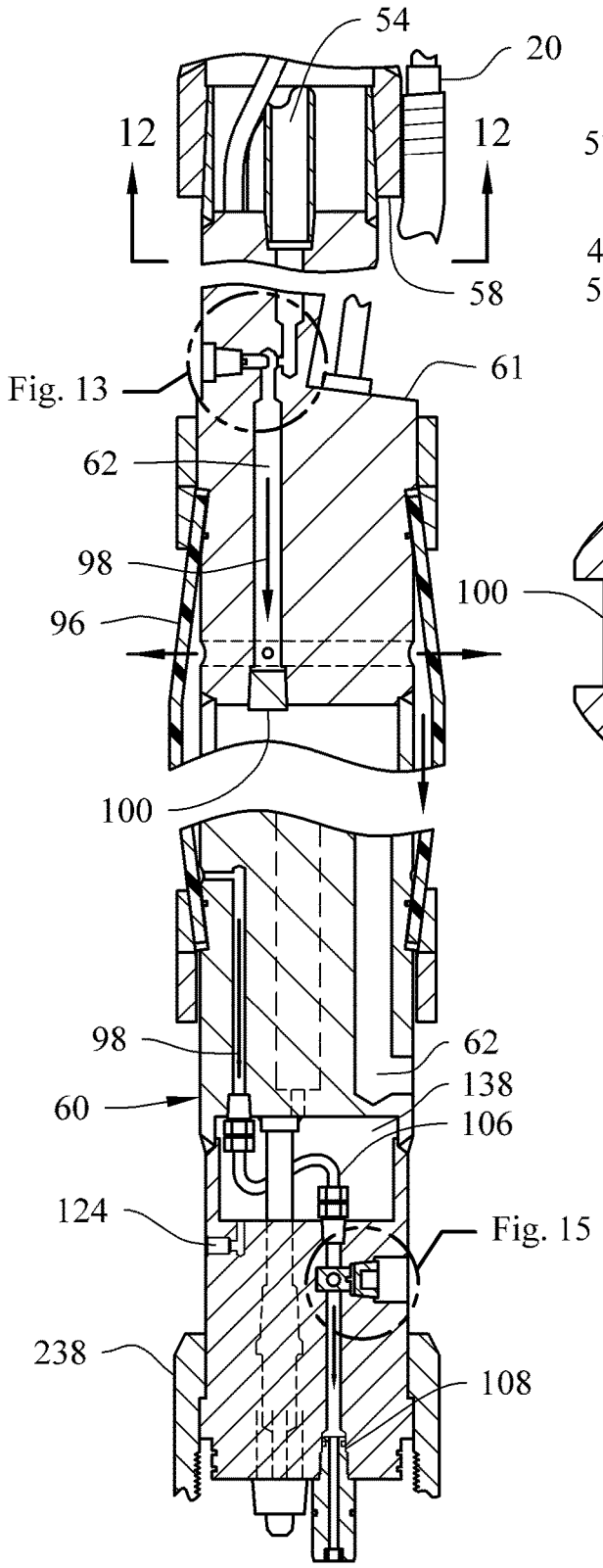
FIG. 11 a cross-sectional view of a packer bladder assembly taken along section FIG. 11 in FIG. 6.
Figure 12:
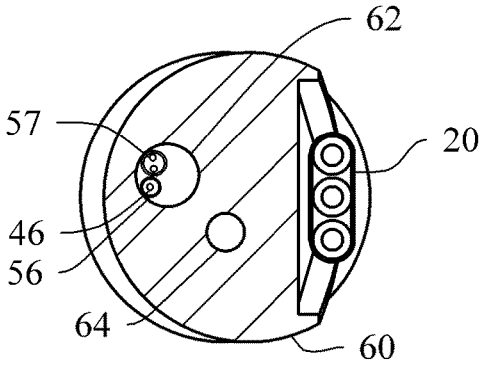
FIG. 12 a cross-sectional view of the upper packer body taken along line 12-12 in FIG. 11.
Figure 13:
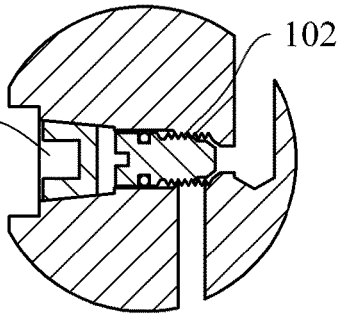
FIG. 13 an enlarged cross-sectional view of a threaded plug and upper shut off valve core of the upper packer body taken along section FIG. 13-13 in FIG. 11.
Figure 14:
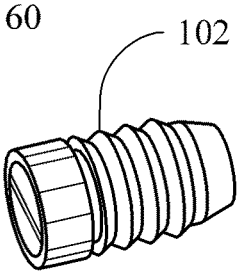
FIG. 14 is an enlarged perspective view of the upper shut off valve core.
Figure 15:
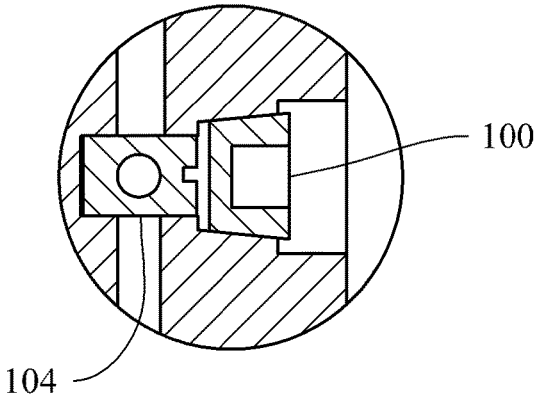
FIG. 15 an enlarged cross-sectional view of a threaded plug and lower shut off valve core of the upper packer body taken along section FIG. 15-15 in FIG. 11.
Figure 16:
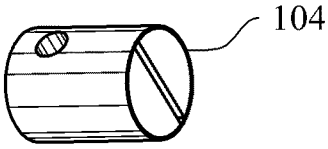
FIG. 16 is an enlarged perspective view of the shut valve core utilizing a national pipe taper (NPT) plug.

The packer upper body 61 of the packer assembly 60 is best illustrated in FIGS. 6 and 7, and can be a machined upper packer body with passages and bladder sealing features. The packer upper body 61 can include an angled recessed section 63 configured to receive the power cable 20 from the side of the tubing and direct it toward an interior of the packer upper body 61. An injected sealant channel or fluid passageway 62 and a packer fluid passageway or channel 64 are defined in and pass through the packer upper body 61. The injected fluid passageway 62 opens inside and is in fluid communication with a packer bladder support pipe 72 and then discharges through a port on a lower side of the packer as best illustrated in FIG. 11. The support pipe 72 can be a pipe within the packer forming an inner surface for packer fluid and a structural member for the packer.

Figure 8:
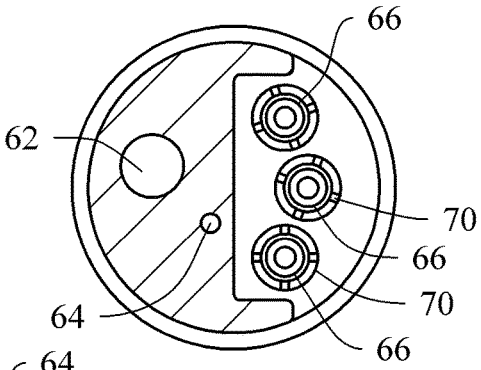
FIG. 8 is a cross-sectional view of the upper packer body taken along line 8-8 in FIG. 6.
Figure 9:
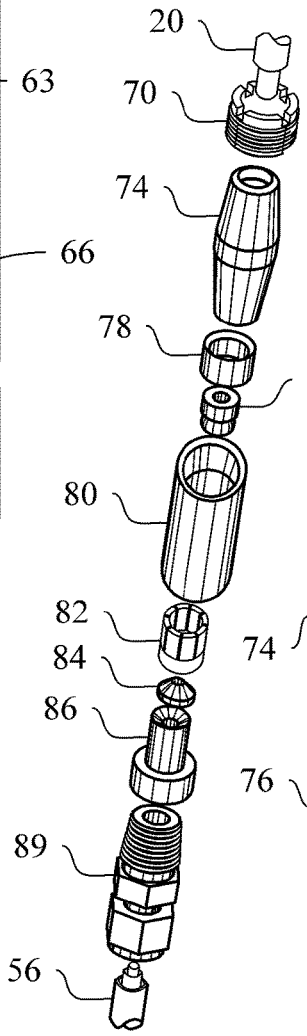
FIG. 9 is an exploded view of the assembly components of the upper packer body taken along section FIG. 9 in FIG. 6.

Three passageways can be defined in a terminus of a sloped or angled recessed section 63 of the packer upper body 61 for ESP wires 66 of the ESP power cable 20 to enter the packer upper body 61 and then emerging on the inside of the bladder support pipe 72. In the exemplary, one of the wires 66 can serve to provide power for the induction heating tool 6, a second wire can provide power supply wire 46 for the packer pump 44 (see FIG. 3), and a third wire can connect to the mineral insulated heating cable 56 (see FIG. 3). All three wires 66 can include a threaded bushing 70 with tapered inner surface, a rubber wire seal insert 74 at an entry point to the packer upper body 61, as best illustrated in FIGS. 8 and 9. The rubber wire seal insert 74 can include opposing tapered end sections, and can be configured to seal the ESP power wire 20 in the packer body.

The power wire for the inductor tool 6 extends through the packer upper body 61 then through a conduit or tubing 68 between the packer upper body 61 and an intermediate or bottom portion 126 of the packer upper body 61 that is seal welded to the lower side of the packer upper body 61 and to a lower face of the bottom portion 126 so as to exclude injection fluid. The insulated ESP wire 66 continues through a plenum 136 through the wire seal insert 74, an insert sleeve, a threaded retaining bushing 70 and ending in a threaded attachment in the barrel shaped inner connector 76.

Figure 17:
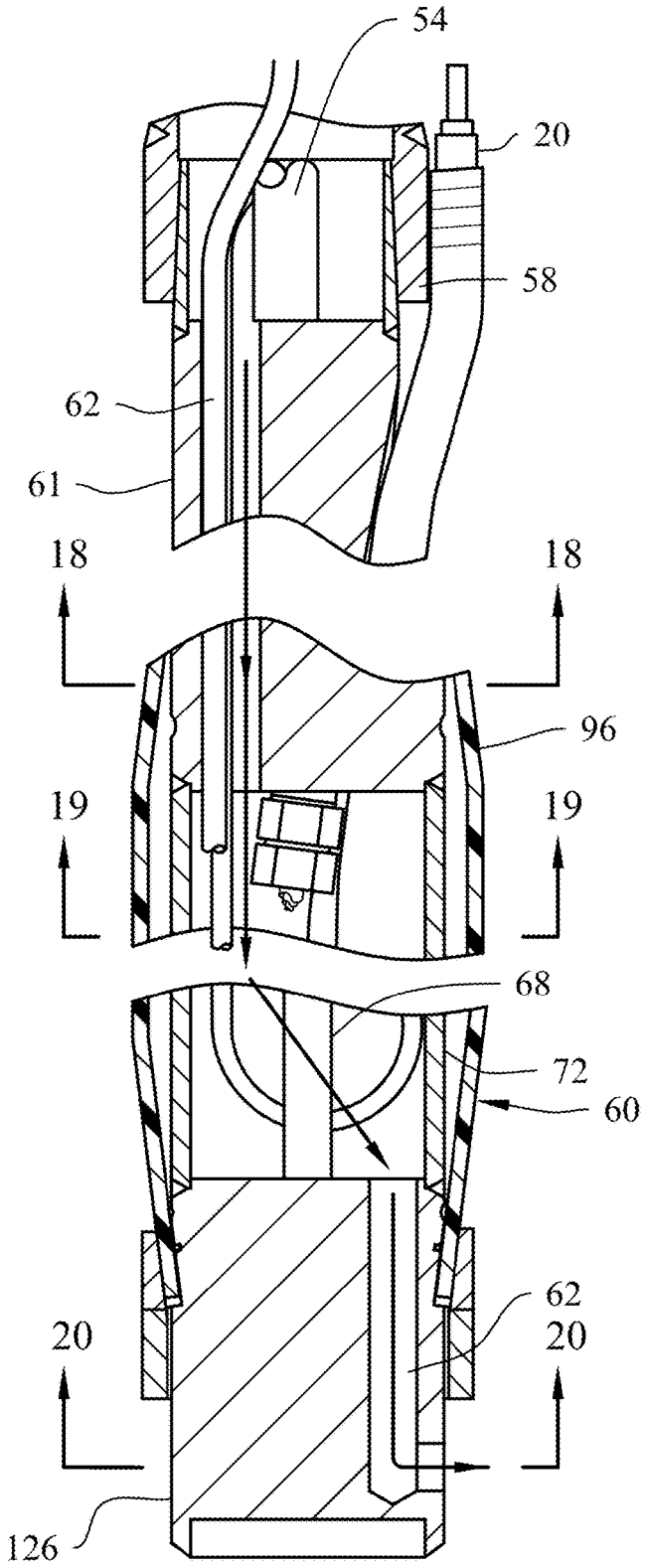
FIG. 17 is a cross-section view of the upper packer body showing fluid flow through a sealant chamber and exiting the upper packer body.

The ESP wires 66 for the packer pump 44 and mineral insulated heating cable 56 terminate in a connector within the upper body as shown in FIGS. 6 and 9. The termination has a barrel shaped inner connector 76 screwed onto the ESP wire 66 thereby allowing an outer connector that is slotted to form flexible multiple fingers, and a connection screw for the packer pump 44 and heating cables 56. The inner connector 76 can be, but not limited to, nickel plated brass and can be configured to accommodate for any misalignment during connection. A tapered sleeve 78 can be used between the wire seal insert 74 and an outer connector 82 for pressing fingers of the outer connector 82 against the ESP wire inner connector 76. Surrounding the connectors 76 is an insulating sleeve 80, the outer connector 84, an insulating stop ring 86 to isolate electricity from the packer upper body 61. Further, a tubing connector 89 can be used to secure the connection assembly to the packer. The power supply wire 46 is contained in tubing 47 between the connector and a pump chamber plug 50. The heating cable attaches at the lower face of the packer upper body 61 and extends the length of the packer bladder support pipe 72 and back through to the packer fluid reservoir 34 to prevent solidification in the flow path as best illustrated in FIG. 17.

Figure 10:
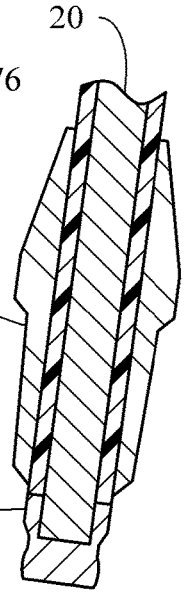
FIG. 10 is an enlarged cross-sectional view of the power connection in FIG. 8.

FIG. 10 is an enlarged cross-sectional view showing the power cable 20 connection with the inner connector 76 as passing through the wire seal insert 74.

Referring to FIGS. 11-16, the packer fluid passageway 62 is equipped with an upper or first valve 102 and discharges between a packer bladder 96 and the support pipe 72. A treaded packer bladder take-up ring 92 and a tapered packer bladder seal ring 94 can be utilized to secure the bladder 96. The ring 92 is configured to force the tapered seal ring 94 onto the packer bladder 96, with the seal ring 94 forming a seal against the bladder 96 and the packer upper body 61.

The first valve 102 controls the fluid flow 98 from the pump to the packer 60 and more specifically to an interior chamber defined by the bladder 96. The fluid flow 98 fills the interior chamber of the bladder 96 and then can continue to a second packer via a passageway at a lower end of the packer 60 by way of a connector tubing 106 leading to a shut off valve 104 and then to guide pins 108. The shut off valve 104 can be an NPT plug that is rotatable to control an ON or OFF flow of the fluid 98. A threaded plug 100 can be utilized to close off the first valve 102 and/or the shut off valve 104, which allows the fluid flow 98 to fill the interior chamber of the bladder 96. The connector tubing 106 provides a passageway through the plenum 136 to the guide pins 108 for packer fluid along the tool. While the guide pin 108 are configured to guide connectors into place and provide passageways for fluid to flow along the tool.

With the plug 100 removed, the fluid flow can enter the interior chamber of the support pipe 72, as best illustrated in FIG. 17. The fluid can flow through the sealant channel 62 of the packer upper body 61 and into the interior chamber of the support pipe 72 containing the tubing 68 that contains the ESP wire inside the packer 60. Then into the sealant channel 62 defined in the bottom portion 126.

Figure 18:
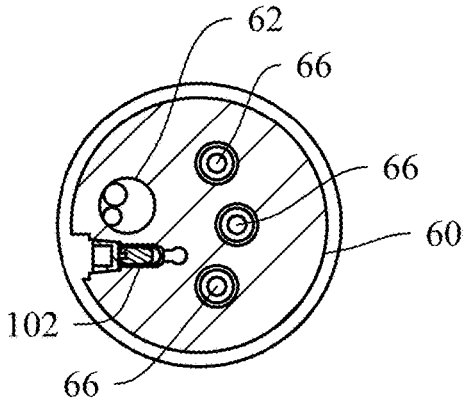
FIG. 18 is a cross-sectional view the upper packer body taken along line 18-18 in FIG. 17.

A lateral cross-sectional view of the packer upper body 61, as in FIG. 18, shows an arrangement of the sealant channel 62 with the ESP power wires 66 and the upper shut off valve 102 inside the bladder.

Figure 19:
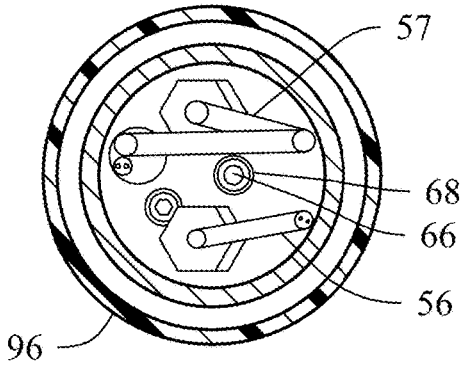
FIG. 19 is a cross-sectional view the upper packer body and the packer bladder taken along line 19-19 in FIG. 17.

FIG. 19 shows the arrangement of the mineral insulated heating cable 56, a tubing containing the pump power wire 57, the ESP power wires 66 and the tubing 68 inside the packer bladder 96.

Figure 20:
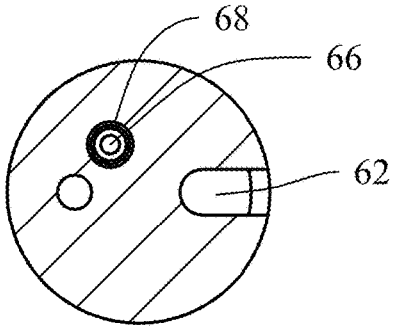
FIG. 20 is a cross-sectional view the upper packer body and a port of the sealant chamber taken along line 20-20 in FIG. 17.

The sealant channel 62 and its exit port in the bottom portion 126 is shown in FIG. 20.

Figure 21:
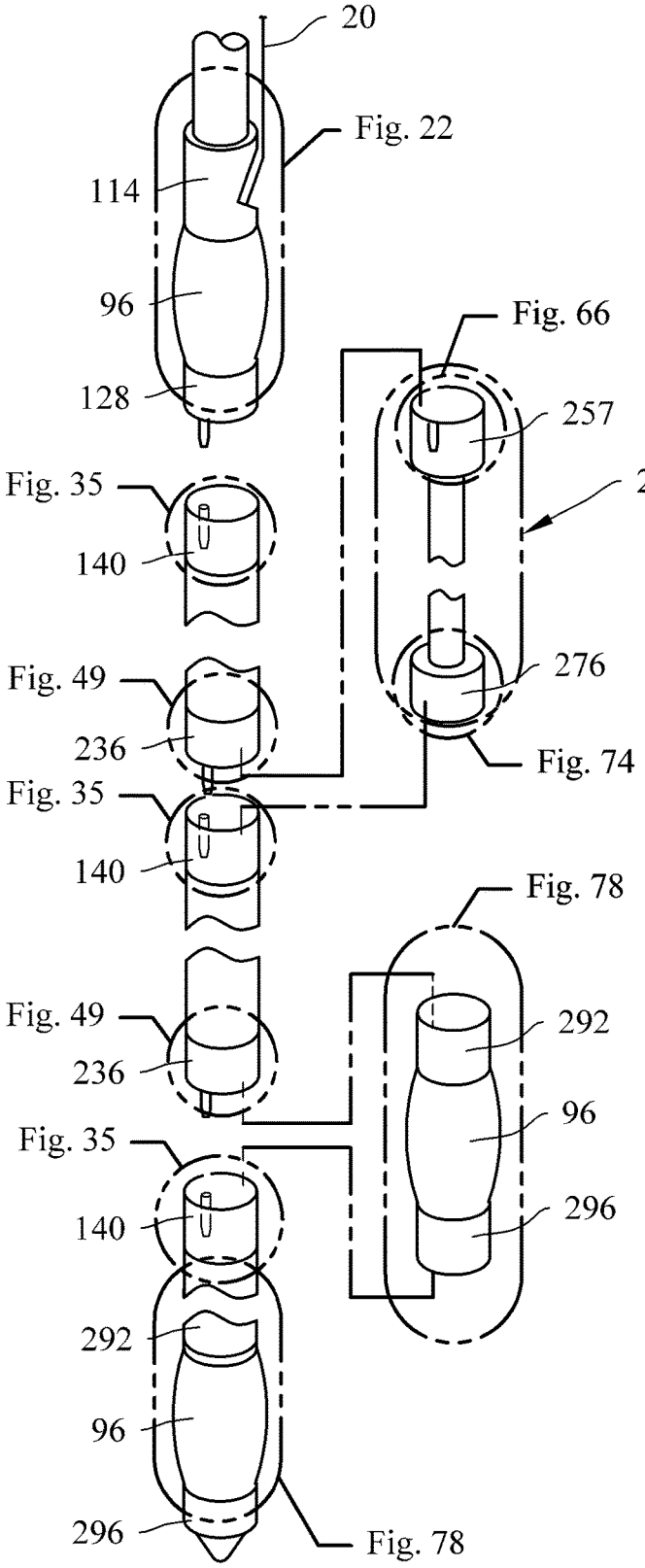
FIG. 21 is an exploded perspective view of an assembly of components of an embodiment of the present technology associated with a multiple section tool that may include a lower packer, induction heaters with three phase wiring, spacer tubing sections and connection units taken along section FIG. 21 in FIG. 1.

Referring to FIG. 21, a multiple section tool that may include spacer tubing 256 with an upper body 257 and a lower body 276 and a lower packer that can be placed along the tool between tool connectors. Three phase wires enable heat output to be individually regulated to three zones and a capillary tube (may be part of the ESP cable arrangement) enables inflation of the packers by application of pressure from the surface. The configuration enables injection of a fluid delivered from the surface and heated in the space between packers thus avoiding heat loss during transport down the well tubing. When well abandonment is the application a conventional wiper catcher would be added in the well tubing above the assembly. The features of each component are described in their respective figures as they may be part of many different configurations. In an embodiment, all of the assemblies are suspended from the well tubing 2 with an Electric Submersible Pump (ESP) power cable 20 for electrical supply and signal transfer from a tool to a Power Control Unit (PCU).

Figure 23:
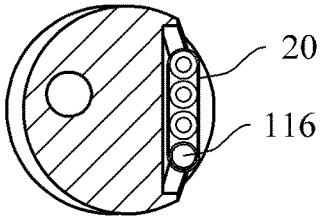
FIG. 23 is a cross-section view of the packer body taken along line 23-23 in FIG. 22.
Figure 24:
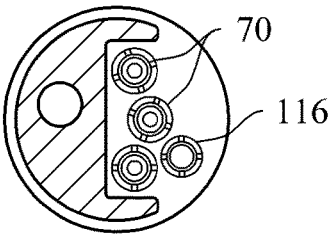
FIG. 24 is a cross-section view of the packer body taken along line 24-24 in FIG. 22.

FIGS. 22-34 shows an embodiment of an upper body 114 of the packer for three wires and capillary tubing 116. The upper body 114 can be attachable to the well tubing 2 by way of a connector assembly coupling 112. The power cable 20 and the capillary tubing 116 can be strapped to the side of the upper body 114 at an upper location of the upper body 114, as best illustrated in FIG. 23. The threaded bushings 70 can be utilized at the terminus of the angled recessed area of the upper body allow coupling of the power cables, as best illustrated in FIG. 24. The capillary tubing 116 can be configured to supply for application of pressure to inflate the bladder 96.

Figure 25:
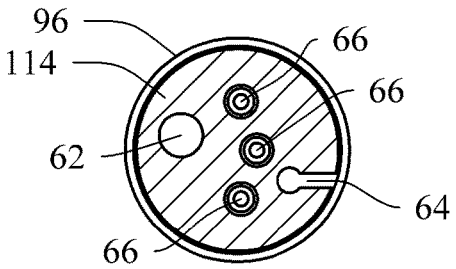
FIG. 25 is a cross-section view of the packer body and the packer bladder taken along line 25-25 in FIG. 22.

FIG. 25 is a lateral cross-sectional view of the bottom portion of the upper body 114 showing the sealant channel 62 in orientation with the ESP wires 66 and a packer fluid channel 64 that receives fluid flow (indicated with arrows) from the interior of the bladder 96.

Figure 26:
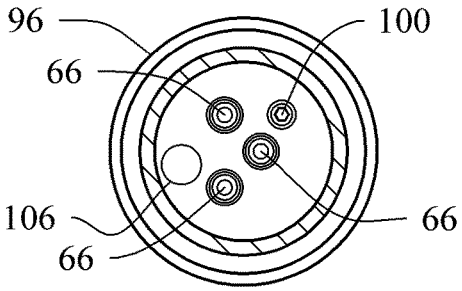
FIG. 26 is a cross-section view of the packer body and the Electric Submersible Pump (ESP) power wires taken along line 26-26 in FIG. 22.

FIG. 26 is a lateral cross-sectional view of the lower body, and an interior chamber between the bottom portion of the upper body 114 and the lower body. This interior chamber includes the ESP wires 66, the threaded plug 100, and the tubing and connectors 106.

Figure 27:
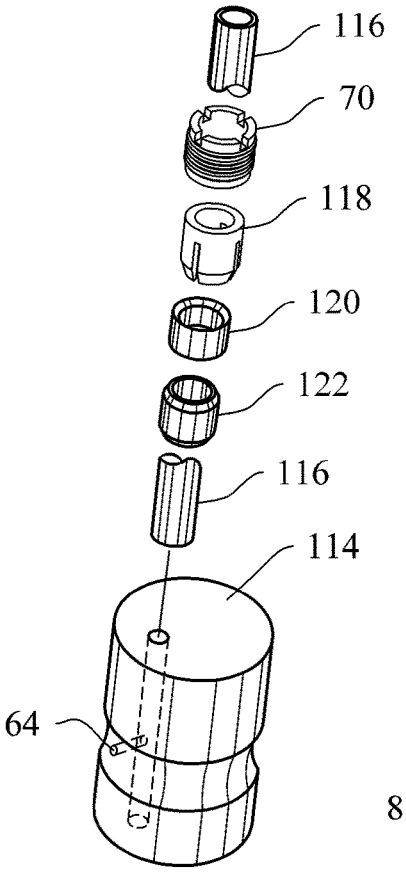
FIG. 27 is an exploded perspective view of an upper packer body for three wires and capillary tubing taken along section FIG. 27 in FIG. 22.

A collet grip can be utilized to keep the capillary tubing 116 in the upper body 114, as best illustrated in FIG. 27. This assembly can include a threaded bushing 70, a grip ring 118 to retain the capillary tubing 116, and a wedge ring 120 between the grip ring 118 and a seal 122 that is in contact with the upper body 114. The capillary tubing 116 is then received in the packer fluid channel 64 defined in the upper body 114. The capillary tubing 116 is capable of supplying pressure to inflate a bellows.

Figure 28:
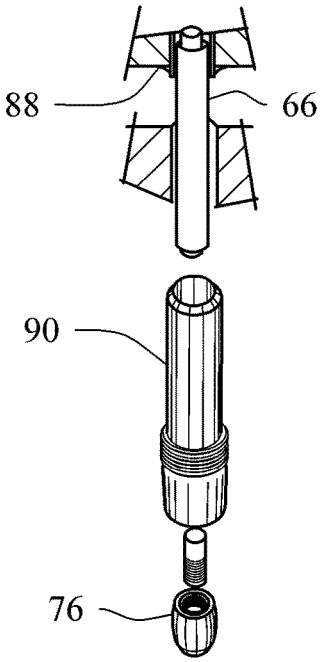
FIG. 28 is an exploded cross-sectional view of a power cable connection tube and ESP cable inner connector taken along section FIG. 28 in FIG. 22.
Figure 29:
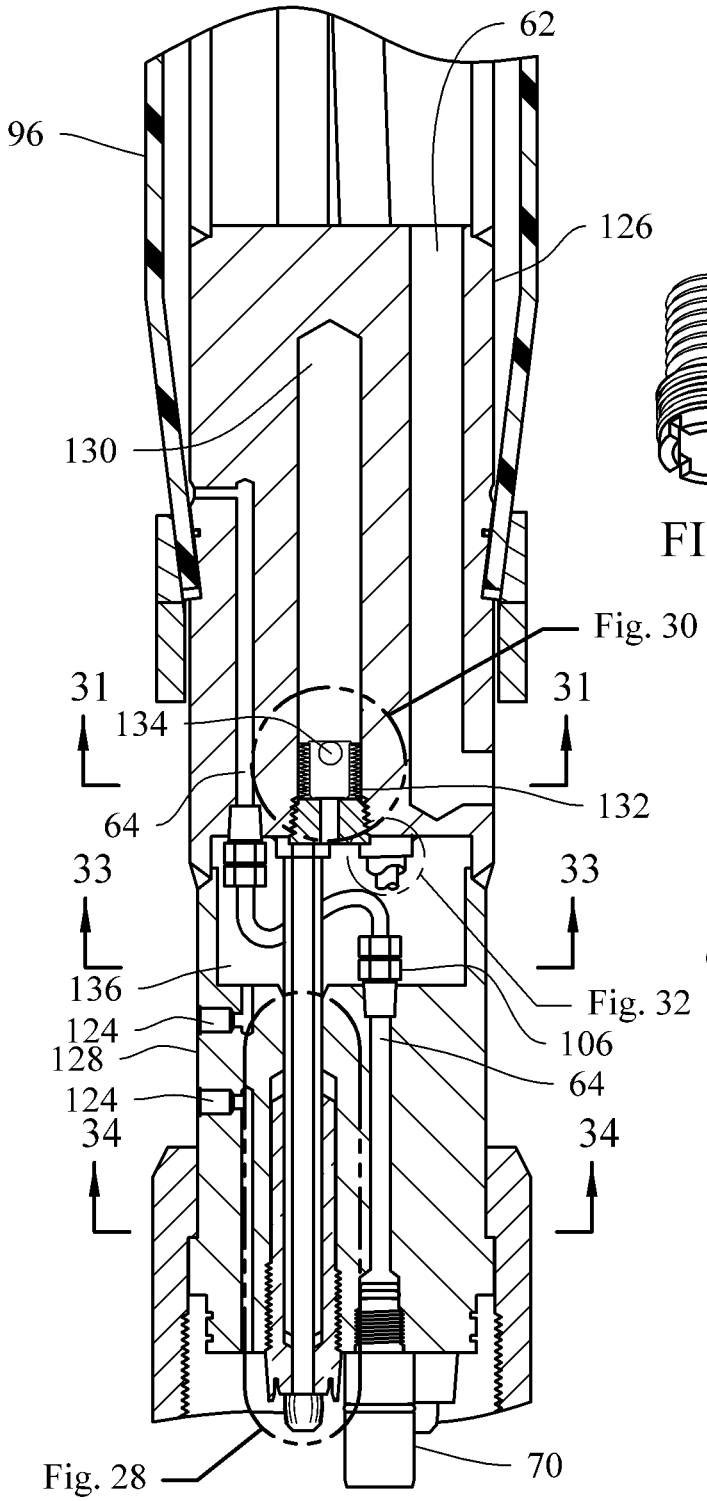
FIG. 29 is an enlarged cross-section view of the bottom portion of the packer body.

Each ESP wire 66 exits a bottom face of an upper packer connector body 128 by way of a power cable connector tube 90 that is threadably secured to the packer connector body 128, with the ESP wire inner connector 76 receiving an end section of the ESP wire 66 and being secured to the connector tube 90, as best illustrated in FIG. 28. The upper packer connector body 128 connects to a mating connector on the tool.

Figure 31:
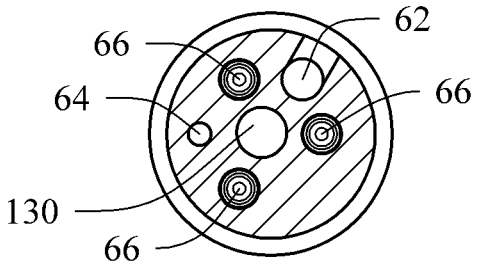
FIG. 31 is a cross-sectional view of bottom portion of the packer body taken along line 31-31 in FIG. 29.
Figure 30:
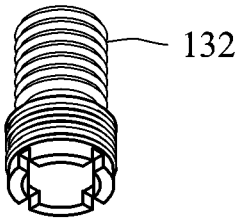
FIG. 30 is an enlarge perspective view of a pressure compensating bellows taken along section FIG. 30 in FIG. 29.
Figure 32:
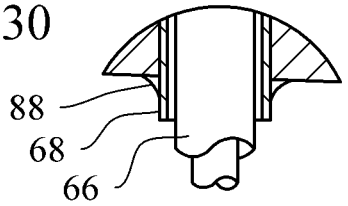
FIG. 32 is an enlarged cross-section view of a seal weld and the ESP wire taken along section FIG. 32 in FIG. 29.
Figure 33:
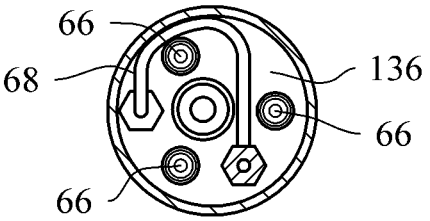
FIG. 33 is a cross-sectional view of the bottom portion of the packer body and a plenum chamber of balanced pressure taken along line 33-33 in FIG. 29.
Figure 34:
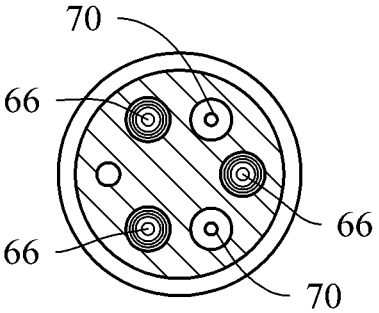
FIG. 34 is a cross-sectional view of the bottom portion of the packer body taken along line 34-34 in FIG. 29.

Referring now to FIGS. 29-34, the bottom portion of the upper body 114 and the packer connector body 128 is illustrated and will be described. To ensure pressures across, wire seals 88 are utilized to balance a pressure compensating bellows 132 located at the plenum 136. The wire seals 88 can be a seal weld to prevent packer sealant from entering the electrical connections. The plenum 136 is located between intermediate (mid) and lower packer bodies for insulating fluid and to enable a seal weld of the ESP wire tubing. FIG. 31 shows the arrangement of the EPS wires 66 around a bellows extension cavity 130 that can be configured as an expansion chamber for the pressure compensating bellows 132.

A port 134 is defined to the wellbore and to an open end of bellows 132, thereby providing fluid communication between the wellbore and the bellows 132.

A first National Pipe Tapered (NPT) fill/vent port 124 is defined in the packer connector body 128 and in communication with the plenum 136 for enabling the insulating oil to fill the plenum 136 and to be degassed, which ensures pressures are equal. A second NPT fill/vent port 124 is defined in the packer connector body 128 for passage through the packer connector body 128 to the tool. The vent port 124 are pipe threaded ports enabling the filling of passageways and cavities with fluid and/or to vent gasses from the passageways or cavities.

Connectors that enable the features presented replace the screwed together joints presently known in the art as well as providing termination of pressure compensating hoses. Flex plates cited in U.S. Pat. No. 6,112,808 are replaced by hoses that extend from connector to connector to provide continuous rather than local pressure and thermal compensation. Item 68 is a flexible hose extending along the tool to provide pressure compensation in the connectors to ensure that pressure within the connection closely matches that of the surroundings.

Referring now to FIGS. 35-48, a lower part of a connector assembly as attached to an upper end of the tool is illustrated and will be described. To facilitate access for components the assembly consists of three bodies. An upper connector body 140 (see FIG. 36) is a plug assembly that connects to the adjacent tool section such as the bottom portion 126 of the upper packer and compensator, an intermediate body 142 (see FIG. 37) provides receptacle features enabling replaceable inserts, and a compensator connector body 144 (see FIG. 38) adds a compensation hose feature and attaches to the tool.

The upper connector body 140 can include a guide pin receiving cavity 146 that is configured to receive guide pins 108 that are part of the upper portion of the connector and for ensuring alignment and enabling fluid passage along the tool. One or more power or signal cavities 148 can be defined through the upper connector body 140 that are configured to contain inserts to transmit power or signals through the connector body 140. A register pin 162 can extend outward from a top face of the connector body 140 and between the connector body 140 and the intermediate body 142 to ensure rotational alignment and to restrain torsion therebetween. The register pin 162 continues the passageway with a hole drilled radially to enable fluid supply for pressure compensation surrounding inserts in the connector.

One or more NPT ports 166 can be laterally defined in the connector body 140 and can include a corresponding plug. One or more of the ports 166 can be in fluid communication with the guide pin receiving cavity 146. The ports 166 are configured to operably receive a shut off valve that can control the flow of fluid to a hollow guide pin 152 of the intermediate body 142.

The intermediate body 142 includes one or more of the hollow guide pins 152 with the hollow interior thereof in fluid communication with a fluid passageway defined through the intermediate body 142 and along the tool 6. The guide pins 152 are configured to allow fluid transfer along the tool in combination with ensuring alignment of the connector body 140 and the intermediate body 142. One or more fluid channels or passageways 154 can be defined through the intermediate body 142 and capable of operably receiving one of the guide pins 152 while allow fluid to transfer to a tubing 156 that passes through an interior chamber of the compensator connector body 144. The tubing 156 fluidly connects the guide pin receiving cavity 146 and through the tool 6.

A vent fill port 124 and/or a port 166 with plug can be laterally defined in the intermediate body 142. The vent fill port 124 is in fluid communication with the interior chamber of the compensator connector body 144, and enables an appropriate volume of insulating oil to be introduced.

Figure 40B:
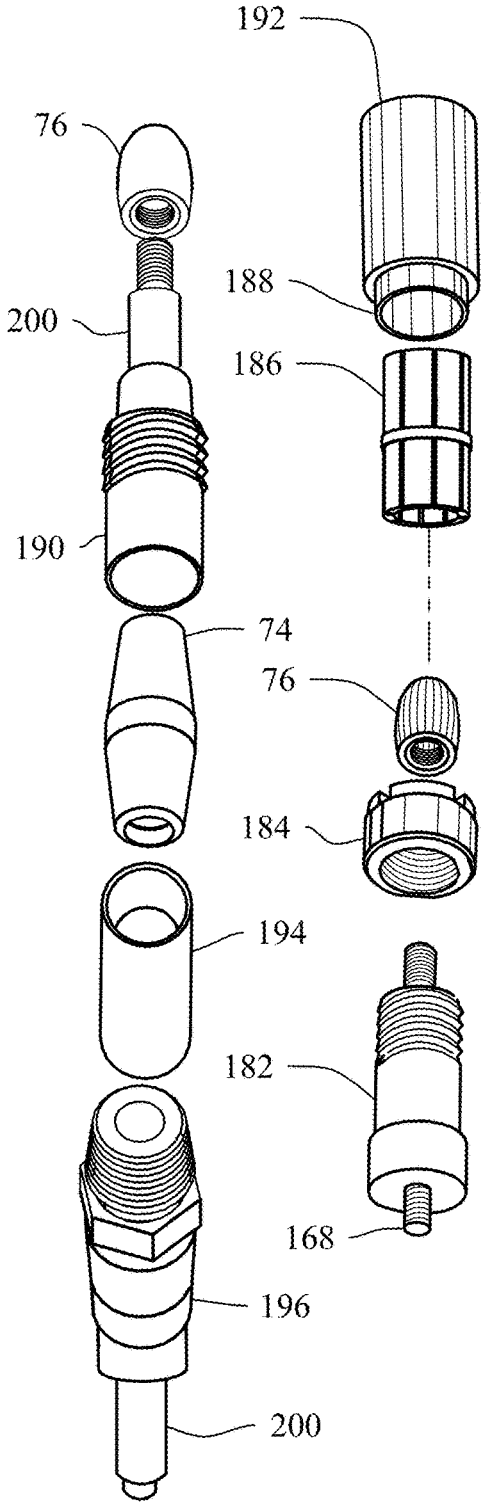
FIG. 40B is an exploded perspective view of another configuration of the connection assembly of one or more embodiments of the present technology.
Figure 40A:
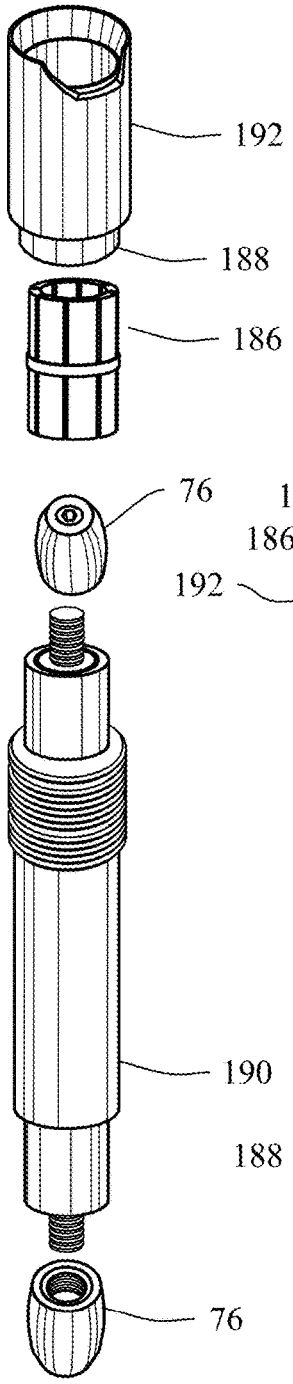
FIG. 40A is an exploded perspective view of one configuration of the connection assembly of one or more embodiments of the present technology.

The power or signal insert cavity 148 can be defined in the intermediate body 142 and is configured to contain inserts to transmit power or signal to and/or through the tool 6. The transfer of power or signals through the connector body 140 and the intermediate body 142 is best illustrated in FIG. 40A.

In an embodiment, the intermediate body 142 can include cavities to accommodate inserts that seal the connector components from contents of the tool 6 as well as fluid passageways associated with the guide pins 152.

The compensator connector body 144 can include a hose assembly 158 that provides a hose within a hose that extends a length of the tool 6 and provides pressure compensation along the length of the tool replacing known flex plates, which only provide local compensation and not over the entire length of the tool 6. An outer hose of the hose assembly 158 is enclosed by a gel with the tool 6, and an inner hose is exposed to the wellbore and the liquid therebetween. The gel can be used to provide shock, vibration, protection and as a cavity filler expands and contracts in response to temperature changes. Since the gel is not a fluid, parts of the tool outer tube were subject to collapse and distortion as wellbore pressure and tool temperature changed during operation. The hose assembly 158 is able to offer the change in volume on a local scale to suit the expansion and contraction needed at that particular location along the full length of the tool 6. Well bore pressure is present on the inside of the hose assembly ensuring a collapsing or expanding force on the pipe wall is avoided along the length of the tool. To provide a measure of protection from well bore fluid incursion into the electrical components with the tool a slightly smaller hose is drawn into the outer hose and any void between the hoses is filled with a compatible insulation fluid.

Figure 38:
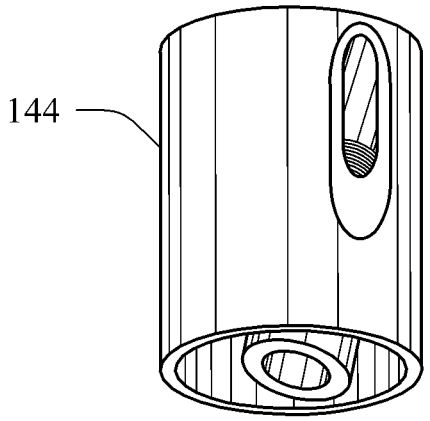
FIG. 38 is a perspective view of the compensator connector body.
Figure 39:
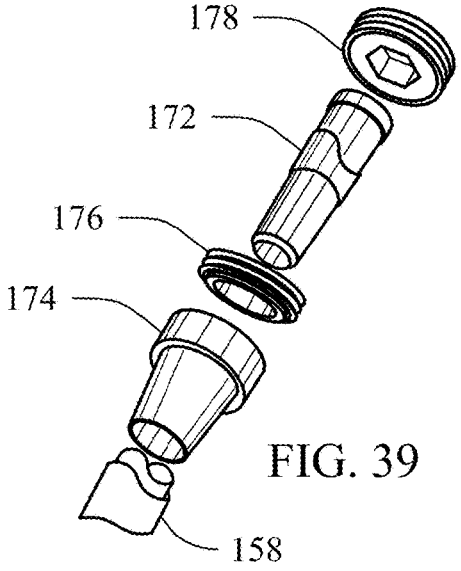
FIG. 39 is an exploded perspective view of components associated with a connection section of the compensator connector body taken along section FIG. 39 in FIG. 35.

Termination of the hose assembly 158, as best illustrated in FIGS. 38 and 39, shows the compensator connector body 144 with a tapered inner bore and a correspondingly tapered sleeve 174 when inserted into the outer hose and which compresses to form a seal. The inner face of the sleeve 174 is tapered similar to an inner tapered sleeve 172 and when inserted into the inner hose forms a seal between the inner and outer hose 158. Retaining collars 176, 178 ensure the tapered sleeves 172, 174 respectively are secured in place. Termination of the hose 158 at the opposite end of the tool 6 is done in the same manner. In an embodiment, the inner tapered sleeve 172 compresses the inner hose against the outer tapered sleeve 174 to seal and exclude wellbore fluids from entering the tool. The outer tapered sleeve 174 compresses the outer hose against the compensator connector body 144 trapping liquid between the outer hose and the sealing gel in the tool 6. The threaded retaining collar 176 presses the outer tapered sleeve 174 to form a seal by pressing it to compress the outer hose in the compensator connector body 144. The threaded retaining collar 178 presses the inner tapered sleeve 172 to form a seal between the inner and outer hoses.

Figure 35:
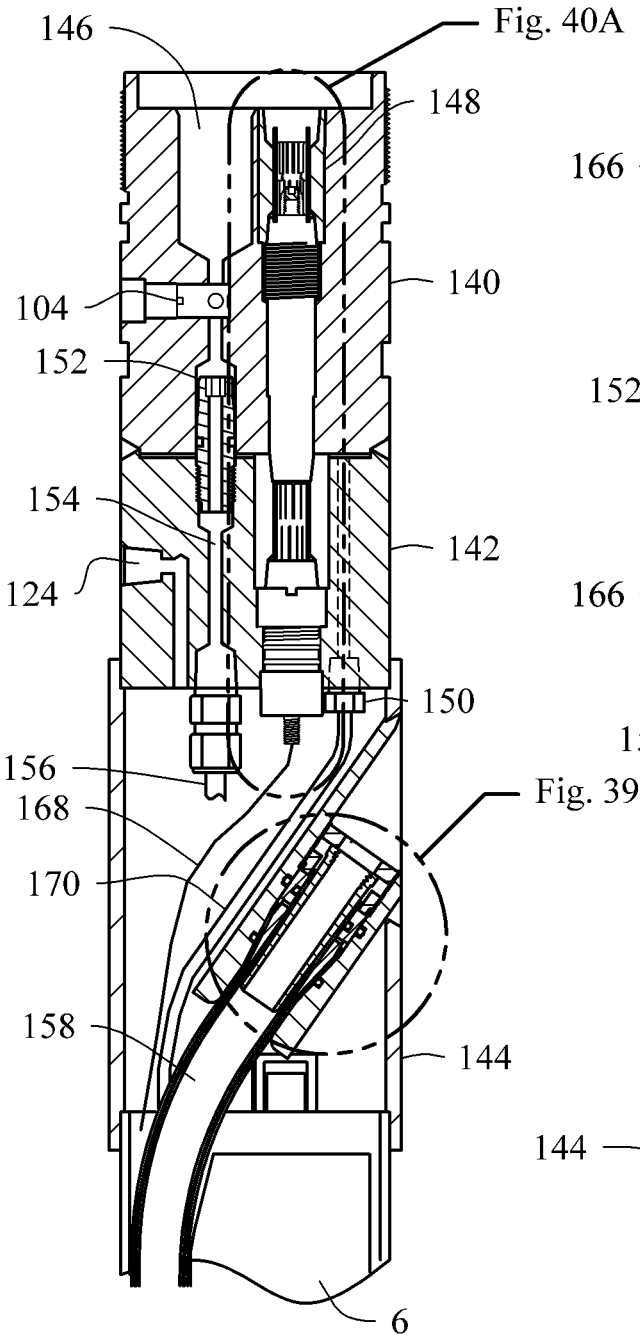
FIG. 35 is a cross-section view of an upper connection body, an intermediate connector body and a compensator connector body taken along section FIG. 35 in FIG. 2.
Figure 36:
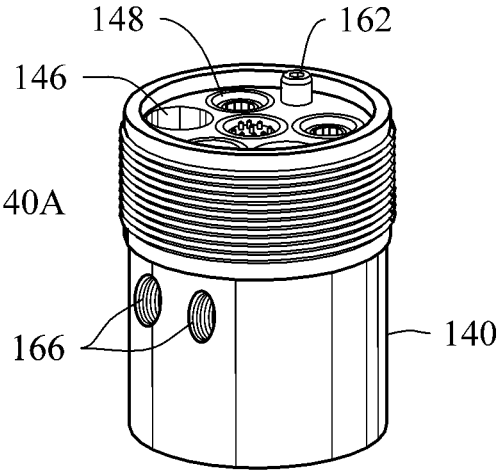
FIG. 36 is a perspective view of the upper connector body.
Figure 41:
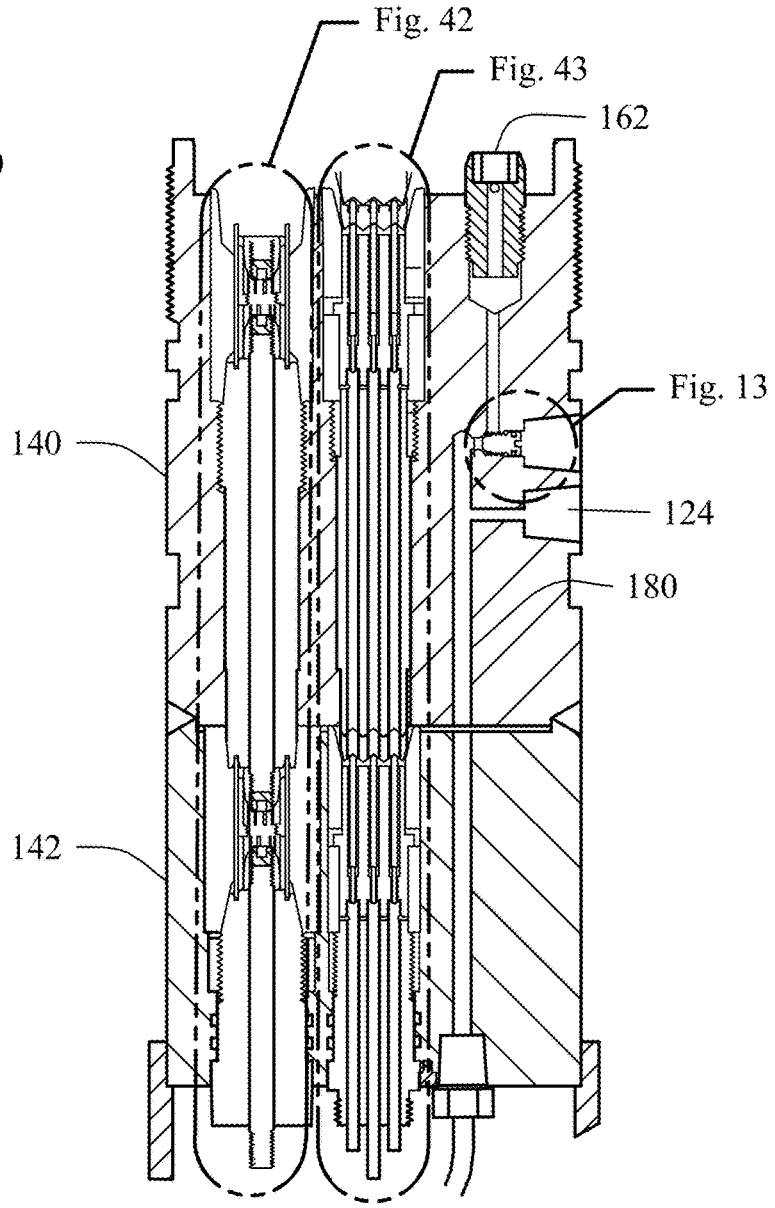
FIG. 41 is a cross-sectional view of the upper connector body and the intermediate connector body showing the wiring and power connection.

A smaller hose 170 extends a short distance along the hose assembly 158 to provide a means of pressure compensation around the power and signal inserts within the connector body 140 and the intermediate body 142, as best illustrated in FIGS. 35 and 41. The register pin 162 includes a hollow passage therethrough that is in fluid communication with a shut off valve (see FIG. 13) and a fluid passageway 180 that enables fluid from the register pin 162 to flow to the pressure compensating hose 170 connected to the intermediate body 142. The shut off valve provides a means of filling and retaining fluid during transport and handling thereby reducing installation time required for filling and degassing. Pressure compensation surrounding the inserts is provided by the continuing passageway 180 from insert cavity pressure compensation hose 170. Power wires 168, signal wires (224 in FIG. 47) and the tubing 156 pass through the compensator connector body 144 and are connected to their respective components of the intermediate body 142 before the intermediate body 142 and the compensator connector body 144 are welded together. The compensation hose 170 and the tubing 156 that is part of the guide pin receiving cavity 146 overcome disadvantages of known connector systems.

In addition, the compensation hose 170 extends from a connector 150 in the intermediate body 142 to run parallel to the compensation hoses 158 so as to provide pressure compensation around the inserts. A total of four or more inserts may be accommodated. The number of power and signal inserts will depend on location of the tool section when part of a multiple section tool. At the top of the tool, all three phase wires are normally present, requiring three power inserts, but near the bottom only one power wire and many signal wires will change the need to one power insert with the remaining three available for signal inserts.

Referring now to FIG. 40A, one or more power inserts 182 can be secured in place by a threaded collar 184 and shoulders machined in the intermediate body 142. The power inserts 182 can be, but limited to, a copper conductor encased in polyetheretherketone (PEEK), epoxy insulating seal or similar high temperature rigid insulating material, with wire threaded at both ends. The threaded collar 184 can be an internally threaded collar configured to secure the power insert 182 in the intermediate body 142.

In some cases, the inserts of the connector body 140 can be exposed to damage when connections are being made particularly during hurried installation activities. In the event of damage, any inserts, guide pins and register pins are all readily replaced in the field. Except for the keyway for signal inserts all insert cavities are similar and are machined so that inserts match the type of insert in the intermediate body 142. Threads on the outer face of the connector body 140 enable a collar 238 (see FIG. 49) to engage and close the connection between the upper and lower parts of the connector.

The power and signal connection assemblies of the connector body 140 and the intermediate body 142 are best illustrated in FIGS. 37, 40A and 41-48.

Figure 42:
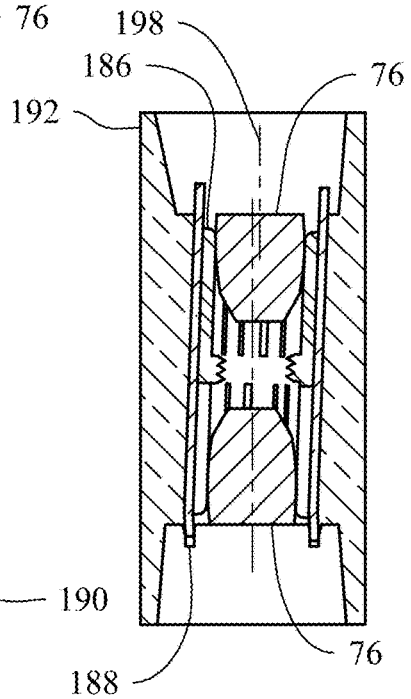
FIG. 42 is an enlarged cross-sectional view of a pair of ESP inner wire inner connector showing a misaligned connection including an offset along a longitudinal axis.

Wires from the tool 6 can attach to a tool side of the power insert 182 and a barrel shaped connector 76 screws to an opposite end of the power insert 182. Surrounding the barrel shaped connector 76 and extending to surround a second and similar inner connector 76 is a conductive sleeve 186 having slotted flexible "fingers" that press on each of the inner connectors 76 received therein to ensure a secure contact even during instances of misalignment 198, as best shown in FIG. 42. The second inner connector 76 can be connected to the power insert 190 that includes an opposing inner connector 76 threaded on to an opposite end thereof. The power insert 190 is secured in place by threads at an upper end thereof and a shoulder machined in the connector body 140. The opposing inner connector 76 can then be received in another conducting sleeve 186 encased by another insulating sleeve 188 that is received in another connector insulator 192. Accordingly, this another connector insulator 192 can receive an inner connector 76 of another component attached thereto.

A Teflon (PTFA) sleeve 188 surrounds the conductive sleeve 186 and extends into pockets in the insert insulation and surrounding the insulating sleeve 188 is a hard rubber insulating sleeve 192 (Shore 60) that fits snuggly in a machined cavity.

Tubing 156 connect to the tool side face of the intermediate body 142 continuing through to the connector assembly at the other end of the tool 6. A passageway extends through the intermediate body 142 to the guide pins 152 equipped with small O-Ring that continue the passageway to the connector body 140.

In an embodiment, when the power insert 190 is positioned in the cavity 148 of the connector body 140, the inner connector 76 enters into the conductive sleeve 186 to complete the electrical connection.

Figure 47:
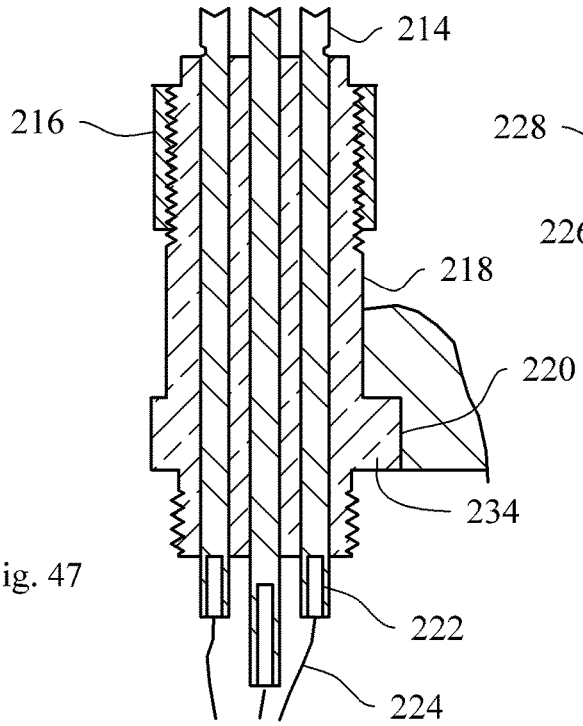
FIG. 47 is a cross-sectional view of the signal insert in the connector body taken along section FIG. 47 in FIG. 43.
Figure 46:
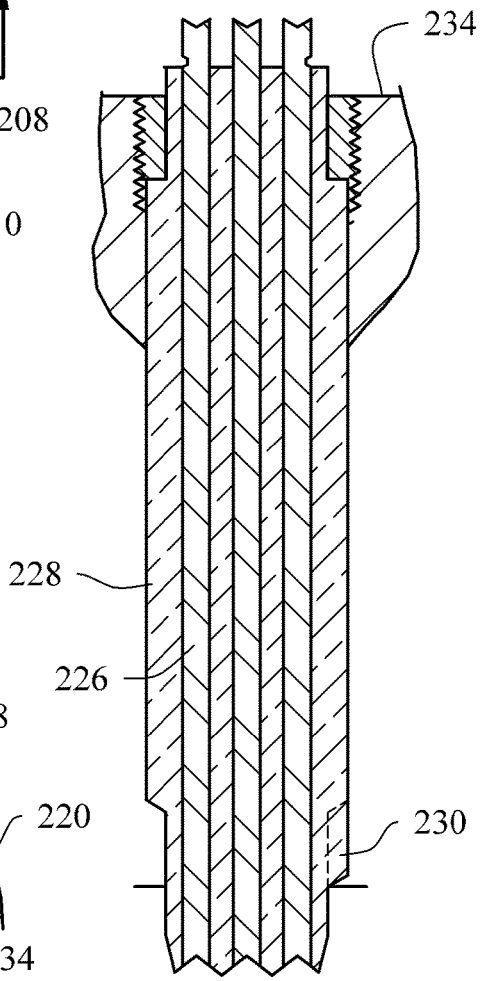
FIG. 46 is a cross-sectional view of a signal insert in an exterior connector taken along section FIG. 45 in FIG. 44.
Figure 48:
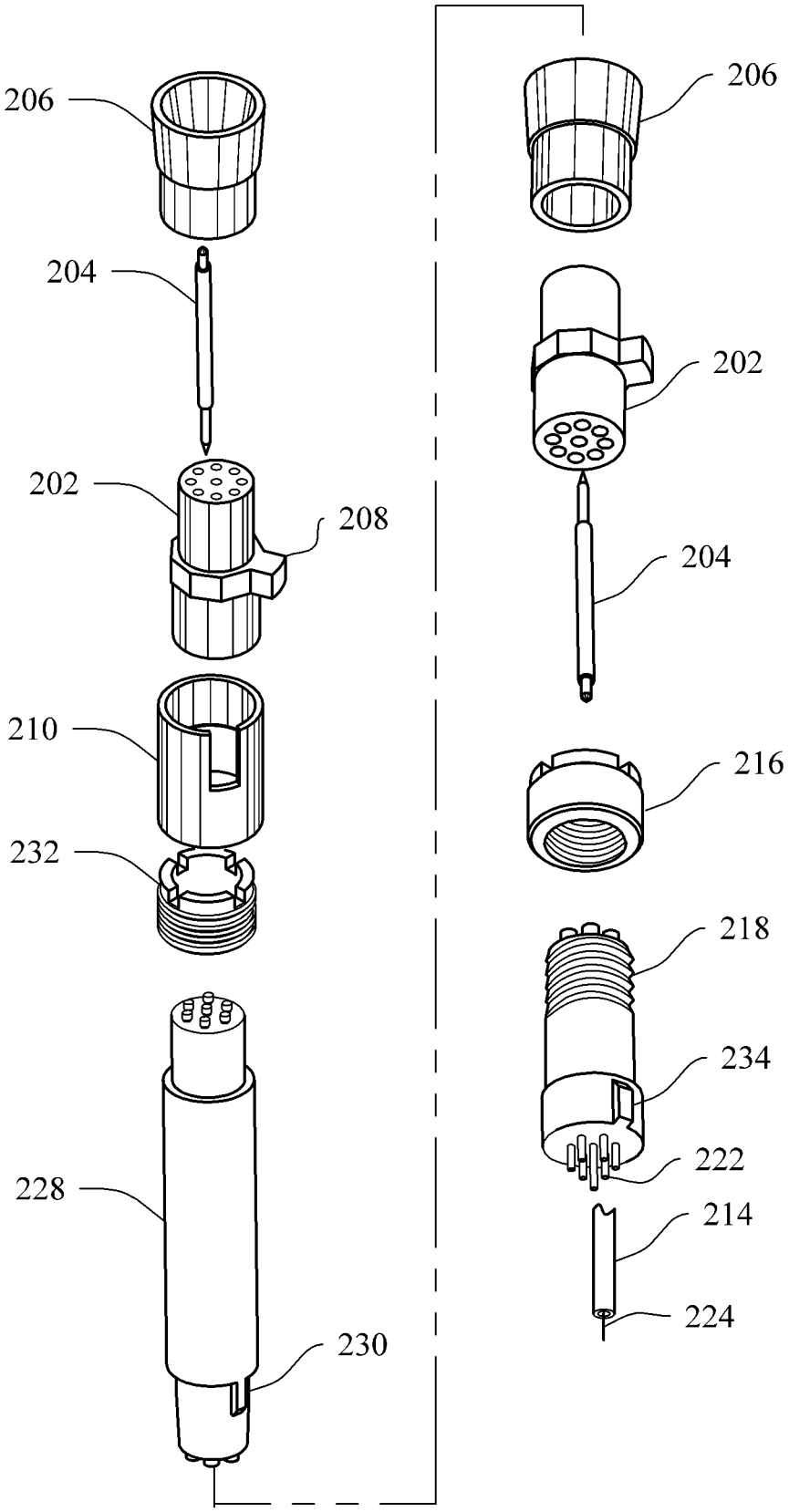
FIG. 48 is an exploded perspective view of the signal insert connection assembly.

Referring to FIGS. 43-48, a signal insert and connection assembly is illustrated and will be described. One or more signal inserts 218, as best illustrated in FIG. 47, can be secured snugly in place by a threaded collar 216 and shoulders machined into the intermediate body 142. Since the signal insert 218 has an array of conductors 214 each dedicated to a specific device or location, an alignment pin 220 is provided to fit in a recess ensuring the signal insert 218 is in the correct radial position. The alignment pin can include a keyway to ensure alignment of the inner signal insert 218.

A cylinder 202 is utilized to mesh with portions of the conductors 214 protruding from the signal insert 218, with the cylinder 202 including multiple holes to enable conducting spring pins 204 to contact the protruding conductors 214 and connect with similar conductors in a mating signal insert 218. The cylinder 202 may have a protruding tab 208 to engage with a keyway 234 in the intermediate body 142 to assist with alignment. Surrounding the lower part of the cylinder 202 is a hard rubber insulating sleeve 210 and on an upper part of the sleeve 210 is funnel shaped at the top and is extended during assembly, to assist in guiding the inserts in correct position.

One or more signal inserts 228 can be secured in place by a threaded collar 232 and shoulders machined into the intermediate body 142. Since the signal insert has an array of conductors 226 each dedicated to a specific device or location, an alignment ring with a protruding pin 230 is provided to fit in a recess on the insert and in a corresponding keyway 234 in the machined cavity ensuring the signal insert 228 is in the correct radial position.

Referring now to FIGS. 49-59, a connector body 236 at the bottom end of the tool that can be configured remotely, for example in the shop, to quickly connect tool sections together with little chance for errors and damage. In the event that an insert is damaged it may be readily replaced in the field.

Figure 49:
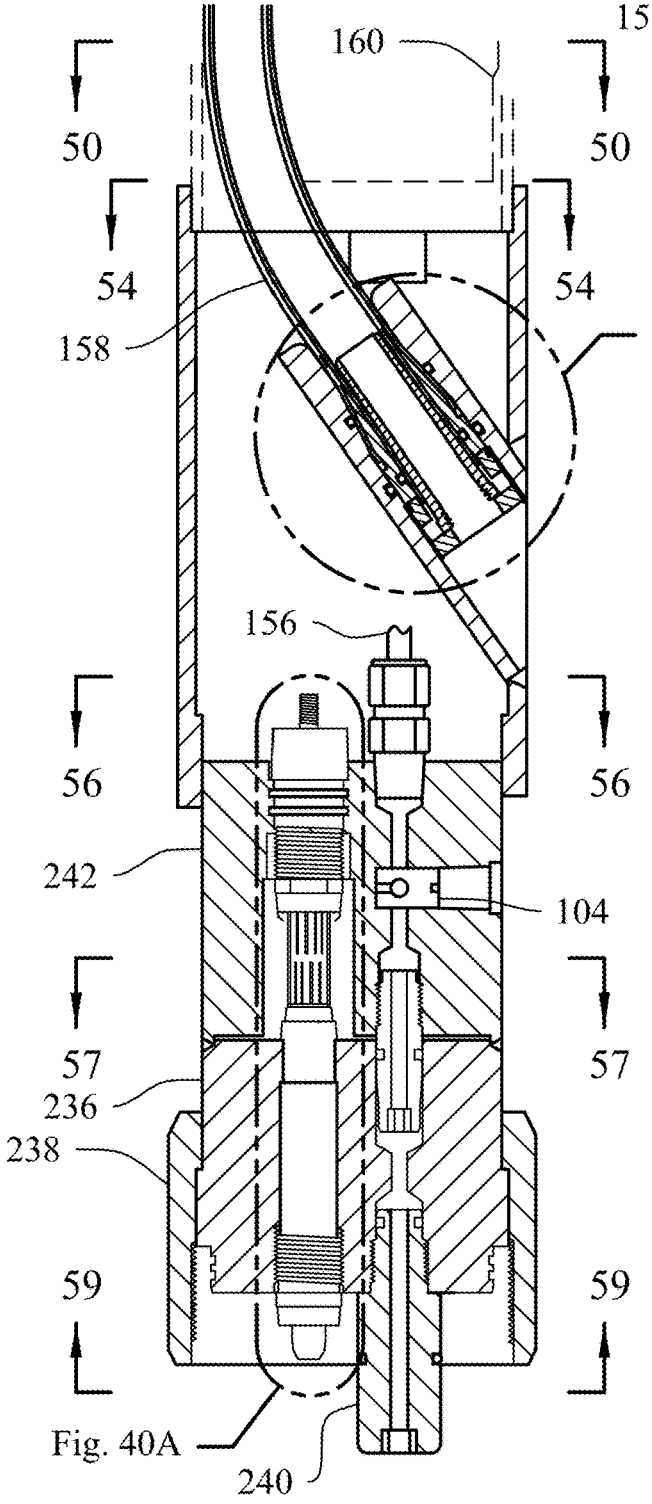
FIG. 49 is a cross-sectional view of the exterior connector body of the lower end of the tool, the inner connector body and with the flexible inner and outer pressure compensating hoses.

An upper part of the connector body 236 is attached to a lower end of the tool, as best illustrated in FIG. 49. To facilitate access for components the assembly consists of three bodies. The connector body 236 connects to the adjacent tool section, an intermediate connector body 242 provides receptacle features enabling replaceable inserts and the compensator connector body adds the compensation hose 158 feature and attaches to the tool. The description of the compensator feature is provided above with reference to FIGS. 35, 38 and 39. In an embodiment, the components of the compensator connector body of the connector body 236 are similar to that in FIGS. 35, 38 and 39, however inverted or facing in a direction opposite to that shown in FIG. 35.

Figure 37:
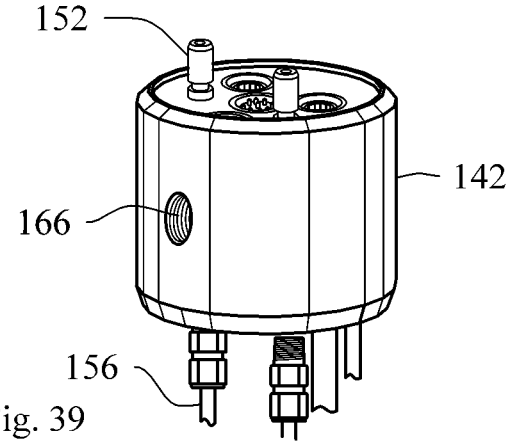
FIG. 37 is a perspective view of the intermediate connector body.

Power and signal insert assemblies and fluid passageways are the same as the lower connector intermediate body 142 (see FIGS. 37 and 41). Shutoff valves 104 are provided in the fluid passageways of the intermediate connector body 242 to enable filling and degassing during manufacture.

The outer connector body 236 engages with the upper connector body 140 at the top end of a tool section. O-Rings provide a seal and machined faces ensure a secure joint once a coupling ring or collar 238 has been made up. One or more guide pins 240 having a diameter larger than its insert cavities and having a different radial angle ensure that a correct position and alignment takes place during installation. The guide pins 240 project a greater distance from a connector face than the inserts thus ensuring that the guide pins 240 are in their respective cavities before inserts make contact with their cavities.

The internally threaded collar 238 engages with a threaded end of a lower portion of the connector body 236 as a means of securing the connector in a closed position.

Figure 50:
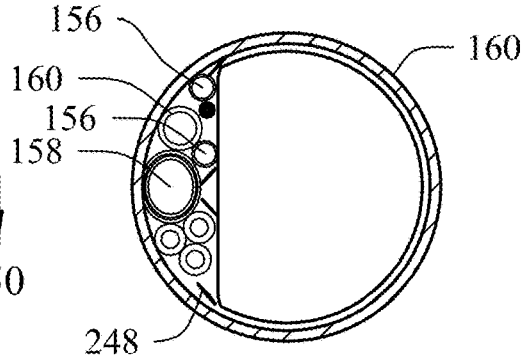
FIG. 50 is a cross-sectional view of the flexible inner and outer pressure compensating hoses with arrows indicating gel expansion taken along line 50-50 in FIG. 49.
Figure 51:
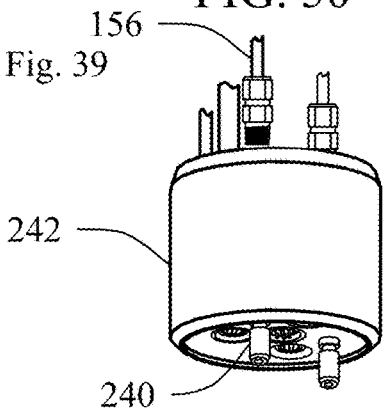
FIG. 51 is a perspective view of the inner connector body.
Figure 52:
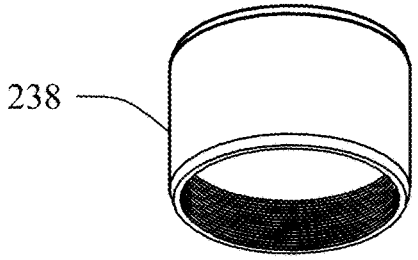
FIG. 52 is a perspective view of the internal threaded collar associated with the exterior connector body.
Figure 53:
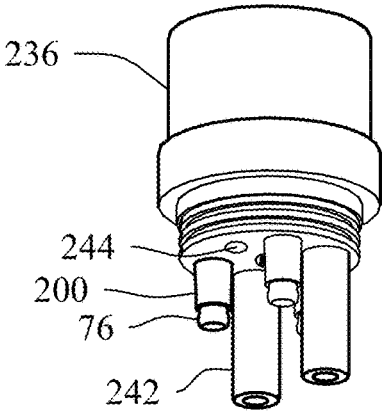
FIG. 53 is a perspective view of the exterior connector body.

FIG. 50 is a cross-sectional view through the existing tool illustrating the compensation hoses 158 which is an added feature ensuring that pressure, expansion and contraction of components do not inflict damage on the tool. As discussed above, the gel fills voids, provides electrical insulation, vibration resistance and being incompressible resists collapse of the tool's pipe. However, compensation for a thermal expansion of 10% during the normal operating temperature range can be accommodated to avoid tool damage. Disposition of the compensation hose 158 along the length of the tool enables local elastic distortion of the gel, due to expansion and contraction, to partially collapse the hose 158. The hose ends are open to the annulus, and wellbore pressure will be present on an inside of the hose 158 therefore the pressure on the gel and on the inside of the pipe will be equal thus providing compensation for volume and pressure changes so as to avoid collapse of the pipe.

Figure 54:
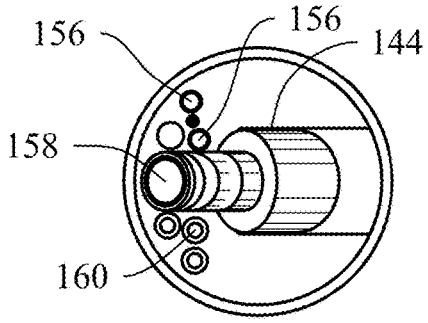
FIG. 54 is a cross-sectional view of a top of the induction heating tool showing the flexible inner and outer pressure compensating hoses and the tubing through tool connecting upper and lower ends of the tool taken along line 54-54 in FIG. 49.

FIG. 54 is a top cross-sectional view illustrating the compensation hoses 158 and fluid tubing 156 as they approach the compensator connector body 144.

Figure 43:
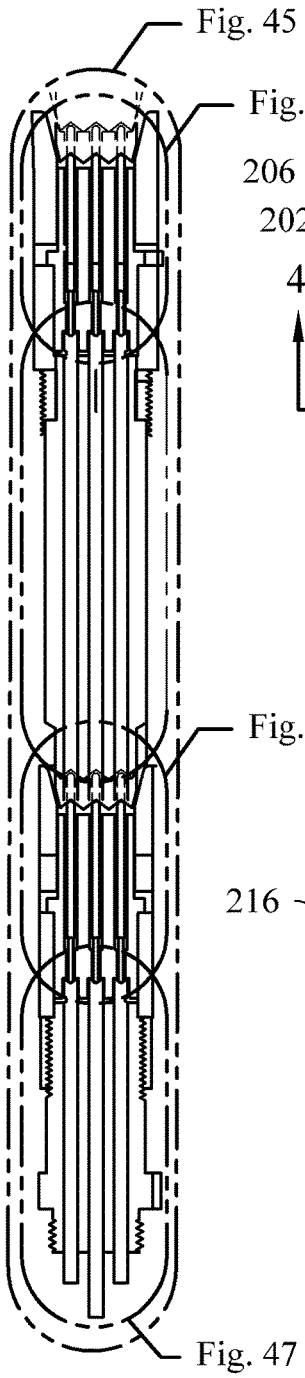
FIG. 43 is a diagrammatical connection view of multiple interconnected components of a connector body assembly.
Figure 44:
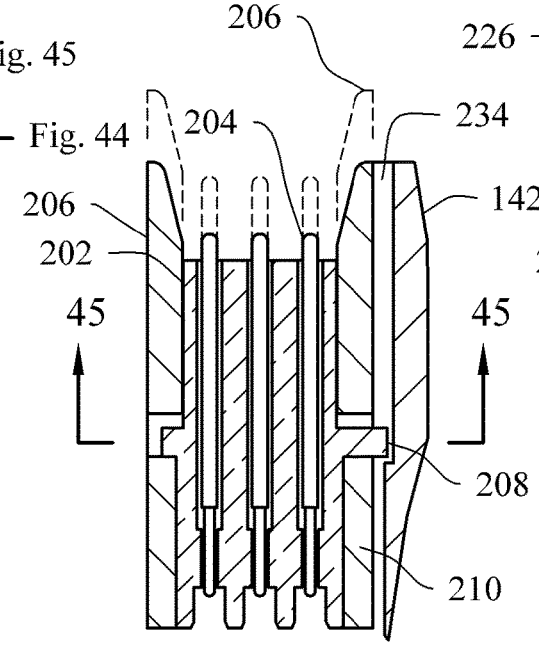
FIG. 44 is a cross-section view of a rubber guide sleeve taken along section FIG. 44 in FIG. 43.
Figure 45:
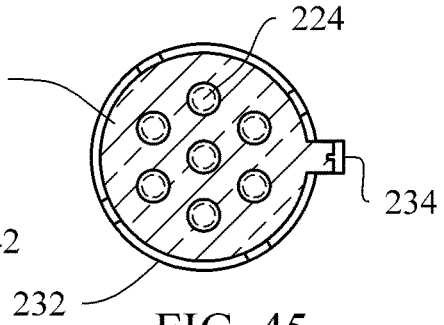
FIG. 45 is a cross-section view of the rubber guide sleeve taken along line 45-45 in FIG. 44.
Figure 55:
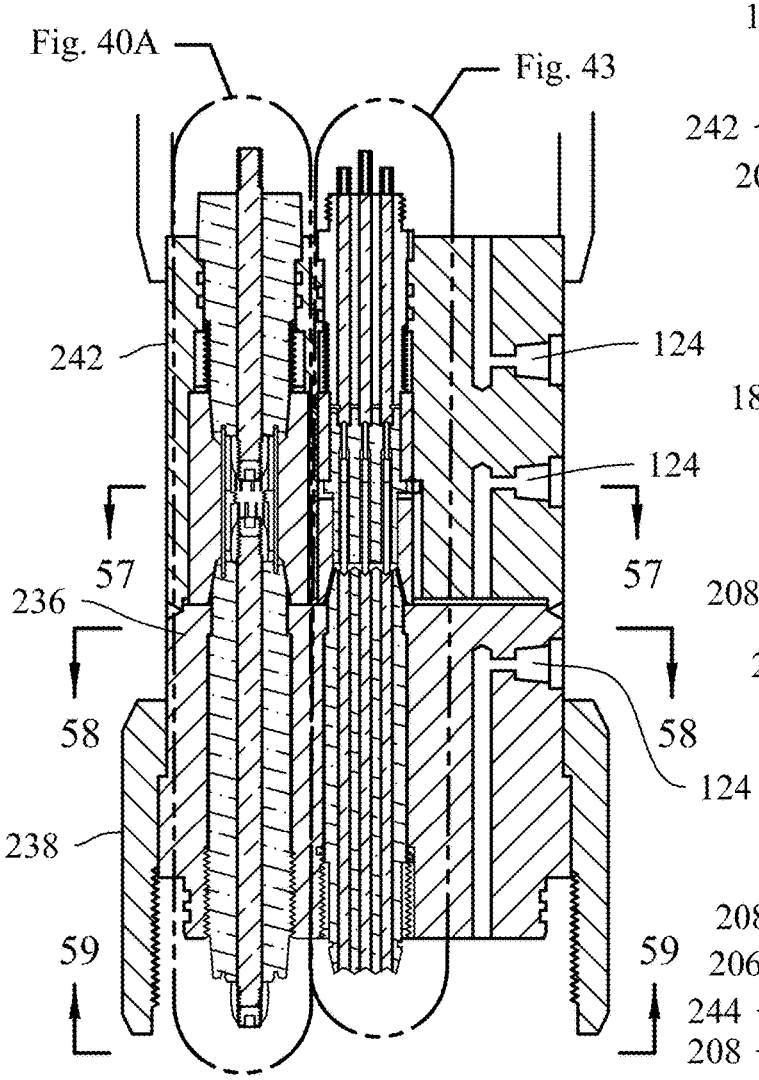
FIG. 55 is a cross-sectional view of the exterior connector body of the lower end of the tool, the inner connector body taken along a different plane to that of FIG. 49.

It can be appreciated that FIG. 55 provides a longitudinal section similar to FIG. 49 except to show the inserts in cross section and the vent/fill ports in more detail, with reference to FIGS. 40A and 43.

Figure 56:
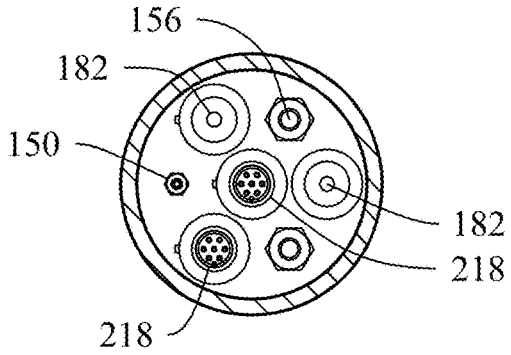
FIG. 56 is a cross-sectional view of the power insert, the signal insert and the tubing taken along line 56-56 in FIG. 49.

FIG. 56 is a cross-sectional view looking up at the lower end of the connector body 236 illustrating the power inserts 182, the signal inserts 218, the tubing 156 at the face of the intermediate connector body 242.

Figure 57:
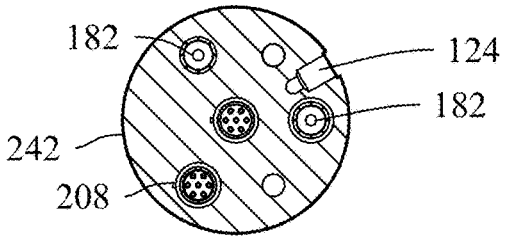
FIG. 57 is a cross-sectional view of the inner connector body taken along line 57-57 in FIG. 55.

FIG. 57 is a cross-sectional view illustrating the power inserts 182, the tab 208 of the spring pin, fluid passageways and the vent/fill port 124.

Figure 58:
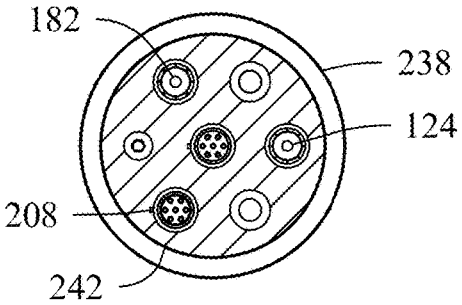
FIG. 58 is a cross-sectional view of the exterior connector body taken along line 58-58 in FIG. 55.

FIG. 58 is a cross-sectional view of the exterior connector body 236 illustrating the power inserts 182, the protruding tab 208, the vent/fill port 124 and the intermediate connector body 242.

Figure 59:
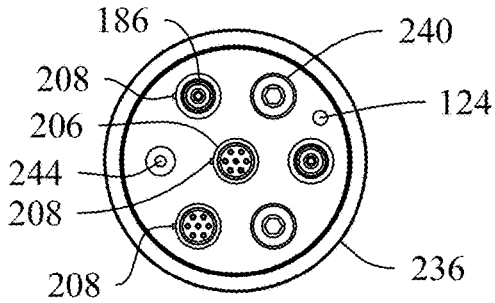
FIG. 59 is an elevational view of the exterior connector body showing the conductor sleeve, the hard rubber guide sleeve, the pin cavity and the threaded vent port taken along line 59-59 in FIG. 55.

FIG. 59 is a cross-sectional view looking up at the face of the connector body 236 while illustrating conductor sleeve 186 between the power inserts, the hard rubber guide sleeve 206, the register pin cavity 244, the guide pins 240, the vent/fill port 124 and the alignment keyways for signal inserts for the upper part of the connector (on the bottom end of a tool section).

Figure 60:
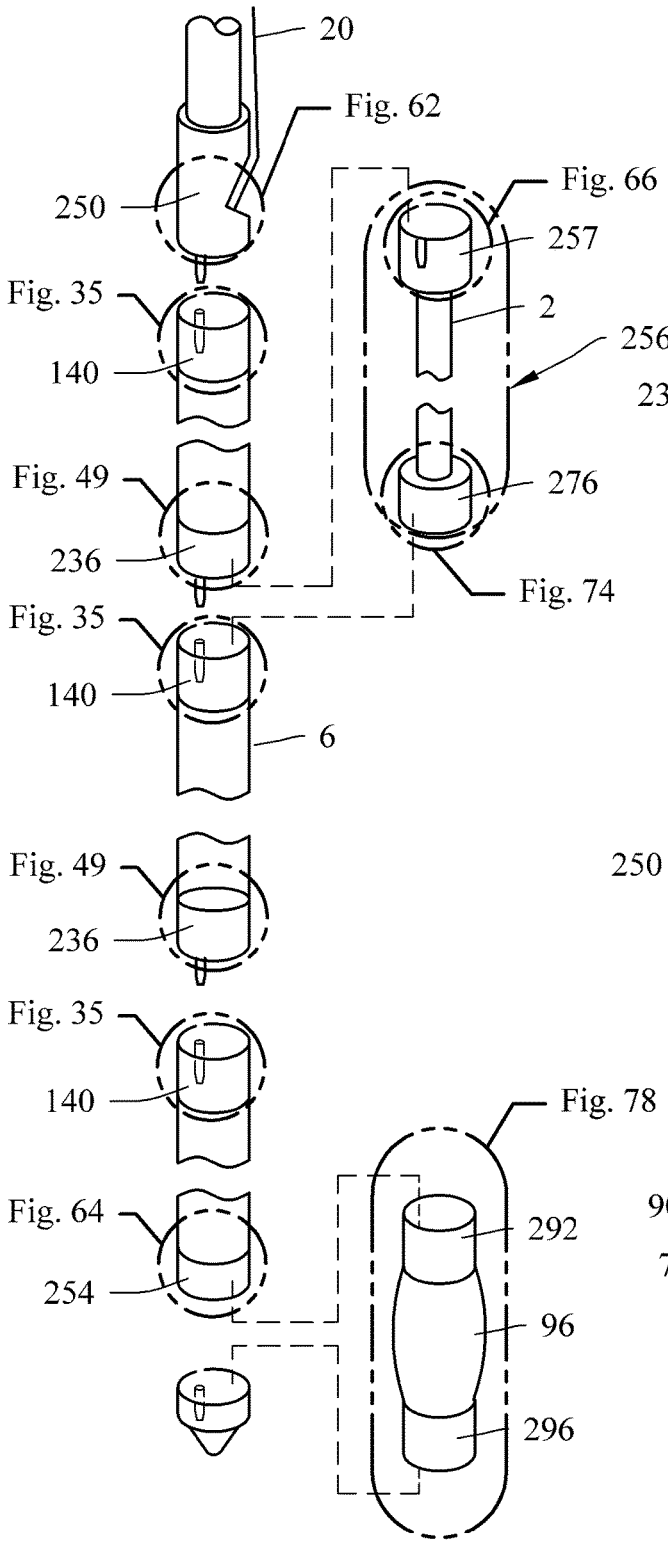
FIG. 60 is an exploded perspective view of an assembly of components of an embodiment of the present technology associated with a multiple section tool that may include an ESP connector body and capillary tubing, an induction heater with three phase wiring, spacer tubing sections and connection units taken along section FIG. 60 in FIG. 1.

Referring to FIG. 60, a multiple section tool that may include spacer tubing 256 with upper and lower body 257, 276 and a lower packer that can be placed along the tool between tool connectors. The connector 250 at the well tubing and ESP cable location is configured when used for the more conventional reservoir heating applications. A commercial ESP cable termination can be replaced by the connector 250 and a connection for capillary tubing is provided.

Three phase wires enable heat output to be individually regulated to three zones and a capillary tube (may be part of the ESP cable) enables inflation of the packers by application of pressure from the surface. The configuration enables injection of a fluid delivered from the surface and heated in the space between packers thus avoiding heat loss during transport down the well tubing. When well abandonment is the application a conventional wiper catcher would be added in the well tubing above the assembly. The features of each component are described in their respective figures as they may be part of many different configurations. In an embodiment, all of the assemblies are suspended from the well tubing 2 with an Electric Submersible Pump (ESP) power cable 20 for electrical supply and signal transfer from a tool to a Power Control Unit (PCU).

The spacer tubing feature in which connectors that are compatible with the tool connectors are screwed onto well tubing. The purposes for utilizing this feature include a non-heating spacer in a zone with poor production or to spread heating over a greater length at reduced cost.

The lower packer module may be placed as needed along the tool. When placed at the bottom of the string it may prevent inflow of water from below that location and several may be placed along the tool, straddling a zone, they may prevent inflow from that portion of the well.

Figure 61:
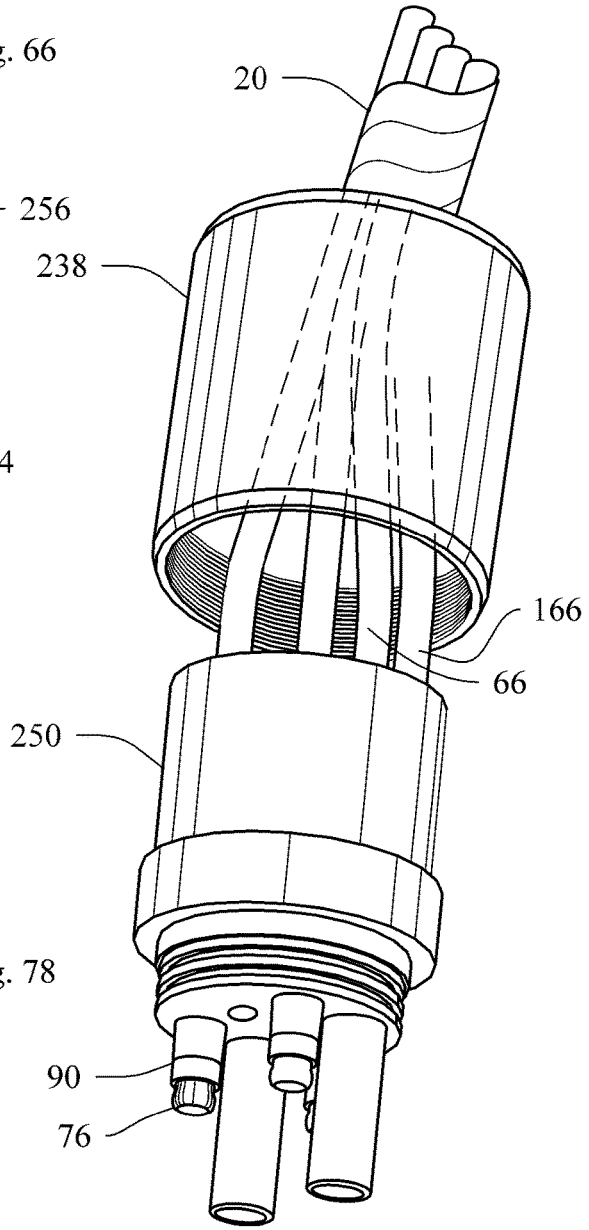
FIG. 61 is an exploded perspective view of the ESP connector body with capillary tubing and the internally threaded collar.
Figure 62:
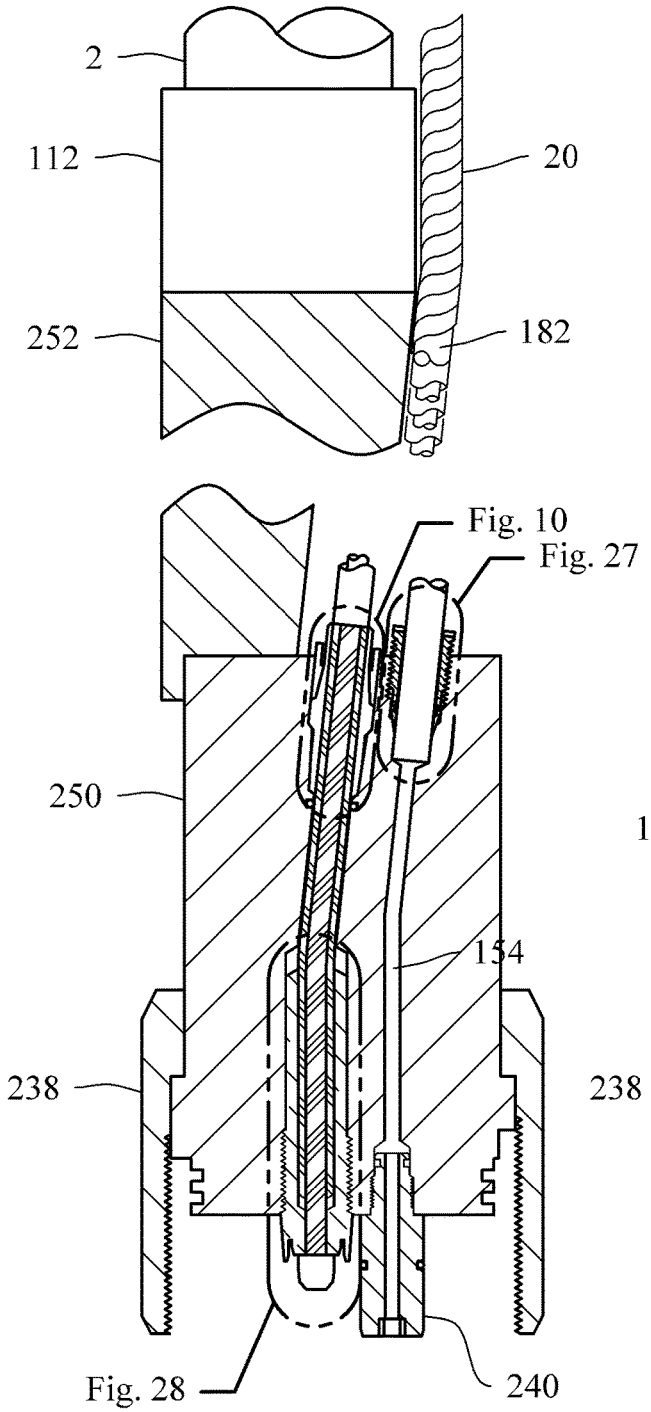
FIG. 62 is a cross-sectional view of the ESP connector body and capillary tubing and an adapter body taken along section FIG. 62 in FIG. 60.
Figure 63:
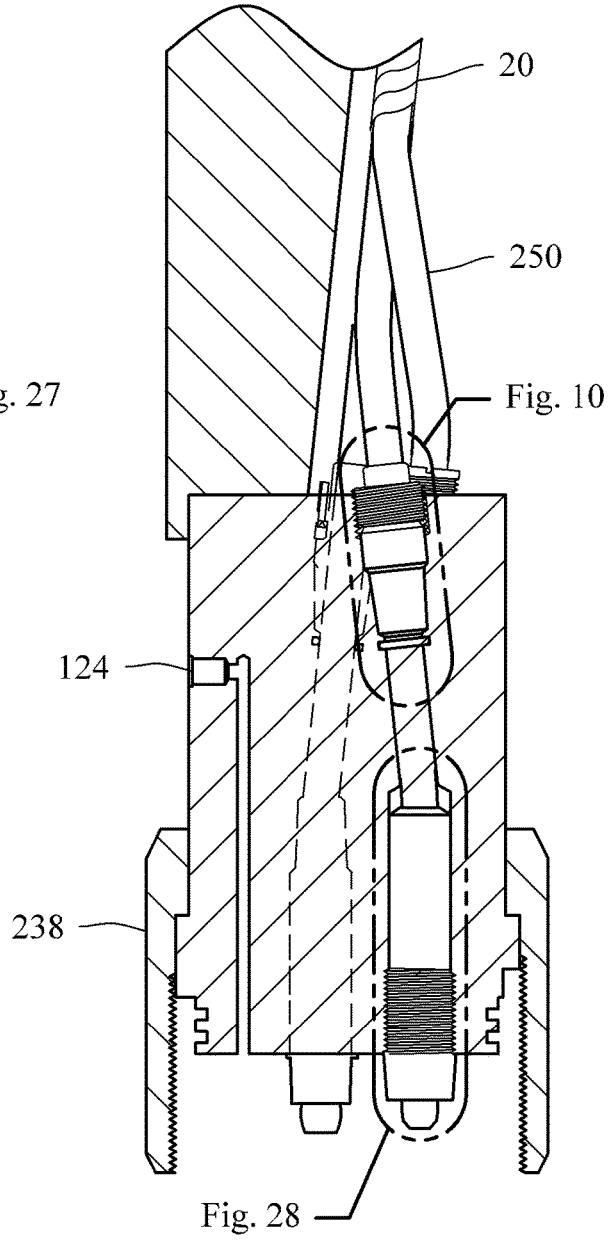
FIG. 63 is a cross-sectional view of the ESP connector body and capillary tubing taken along a different plane to that in FIG. 62.

FIGS. 61-63 shows an embodiment of a longitudinal section depicting the ESP power cable 20 and capillary tubing connection and sealing for the upper part of a connector assembly when the wires extend through to terminate as insert connectors 76. It may or may not include a capillary tube 116 and fluid passageway 154. The connector assembly coupling 112 having matching threads attaches to the wellbore tubing 2 and on its bottom end attaches to an upper end of an adapter body 252 the connector assembly 250 thereby carrying the weight of the tool and providing electrical and fluid connectivity. The adapter body 252 can include a sloped or angled recessed face to enable ESP cable and capillary tubing entry to the connector 250.

Figure 64:
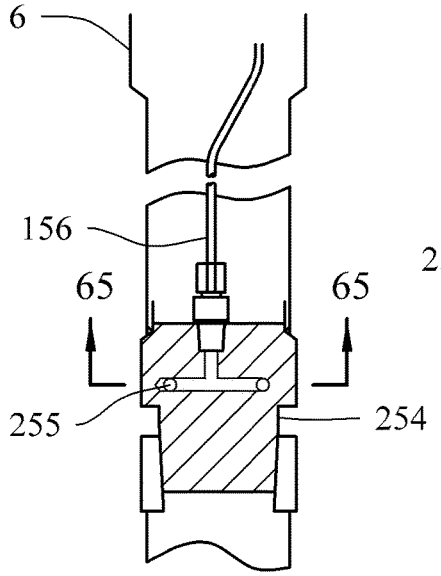
FIG. 64 is a cross-sectional view of a connector end with a fluid discharge port taken along section FIG. 64 in FIG. 60.
Figure 65:
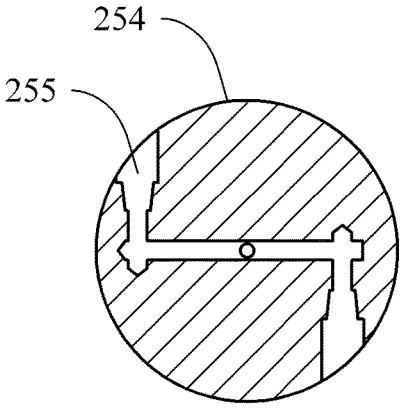
FIG. 65 is a cross-sectional view of the connector end and the fluid discharge port taken along line 65-65 in FIG. 64.

Referring now to FIGS. 64 and 65, a connector body 254 having fluid discharge ports 255 can be utilized to enable fluid delivered via the tubing 156 and tubing passageways within the tool 6. The discharged fluid may assist in desanding, chemical release, formation treatment and dilution of high viscosity liquids. The connector body 254 may be placed as needed along the tool.

Referring to FIGS. 66-73, the spacer tubing 256 includes an upper or outer connector body 257 and a lower body 276 and length of tubing 2 connected therebetween. The spacer tubing can be utilized to provide connectivity of the tool through locations where heating is not needed or to extend a straddle packer zone. Different adapters (see FIGS. 66-77) can be utilized that screw on ends of conventional well tubing to enable continuation of power and fluid features. Fluid filled hoses containing the wires between adapters provide the flexibility required for pressure compensation. The spacers may be shop or field assembled as required.

Figure 66:
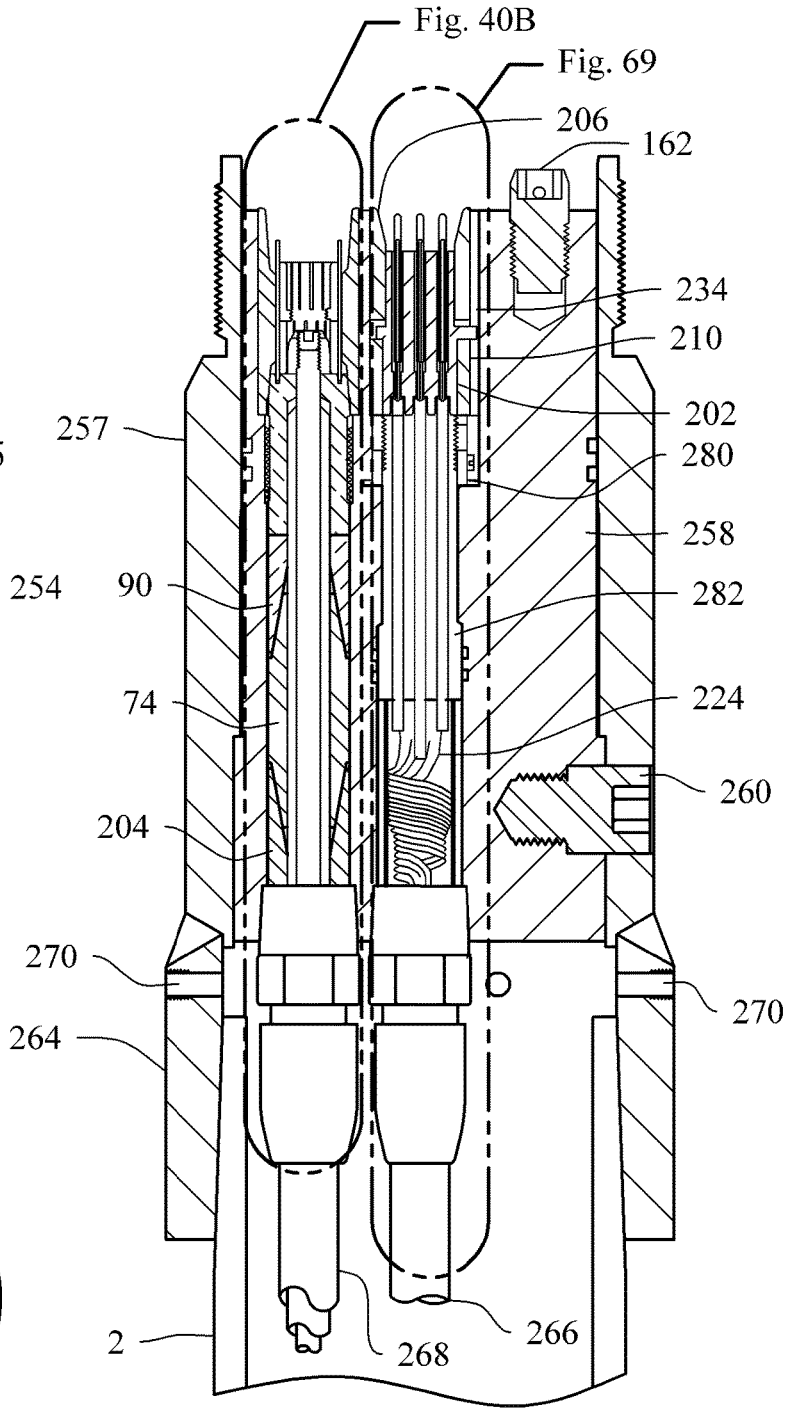
FIG. 66 is a cross-sectional view of a spacer tubing upper connector shell taken along section FIG. 66 in FIG. 60.
Figure 67:
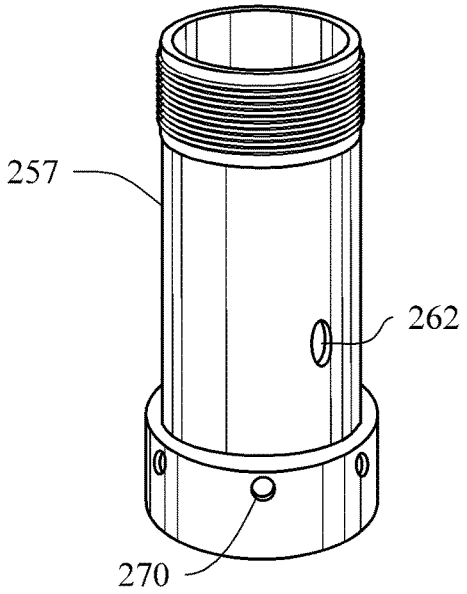
FIG. 67 is a perspective view of the spacer tubing upper connector shell.
Figure 68:
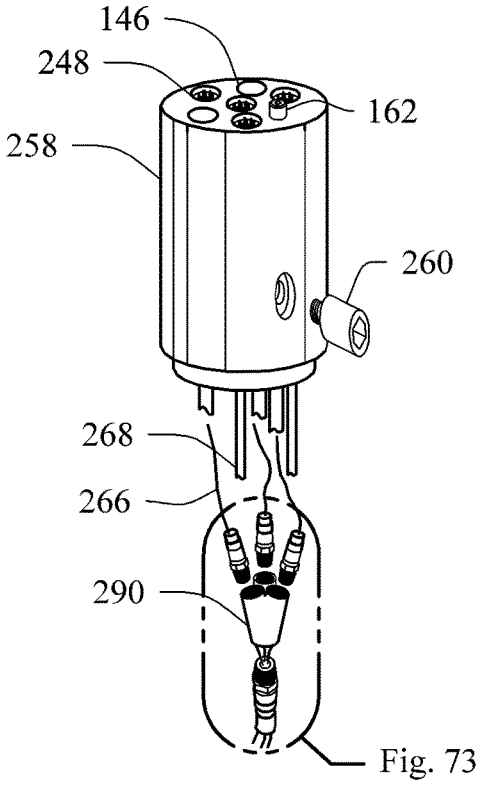
FIG. 68 is an exploded perspective view of a core body with inserts and pins, and a combiner hub.

A lower part of a connector adapter that threads onto the upper end of a length of well tubing (spacer tubing) is best illustrated in FIG. 66. A length of, or lengths of, well tubing may be employed to extend the tool past zones that have low productivity and to extend the length of a horizontal tool at little extra cost. An adapter on each end of the spacer tubing enables standard well tubing to be attached between sections of the tool with continuation of all the wires and fluid tubing from section to section. Since attachment to tubing requires screwing a coupling onto the tubing a means is provided to prevent twisting of the internal wires and tubing as a consequence of screwing the adapters on the spacer tubing. A secondary feature is the capability of assembling the spacer tubing with adapters at shop facilities or onsite in a manner that does not delay rig operations during run-in.

Figure 74:
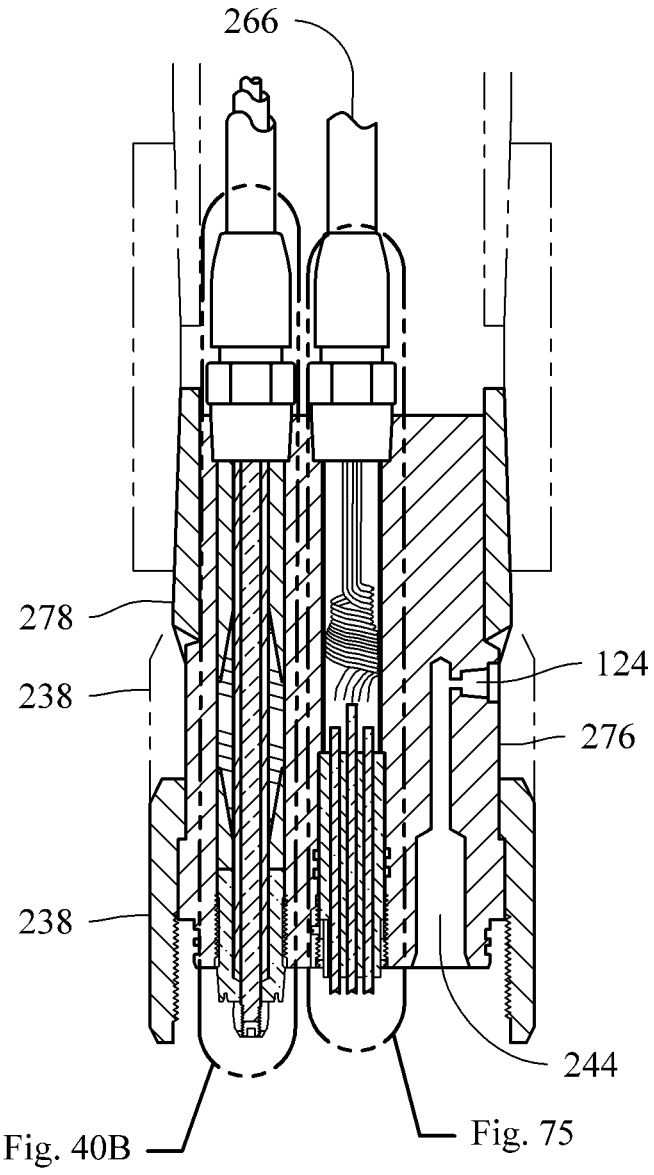
FIG. 74 is a cross-sectional view of the spacer tubing lower body taken along section FIG. 74 in FIG. 60.

Wires and tubes are drawn through the spacer tubing 256 after first being installed in the adapter at the bottom end of the spacer tubing (see FIG. 74). They are then measured, trimmed and connected in a core body 258 and the core is pressed down against the tubing. The core body 258 can include inserts and pins. A lever with pins inserted into the guide pin cavities ensures that the core 258 does not turn while the upper body 257 is screwed onto the spacer tubing. Threads 274 (see FIG. 69) in the bottom of the guide pin cavities 146 may be used to pull the core 258 into place and a screw 260 can then inserted in a hole 262 to secure the core 258 in place.

A coupling 264 can be used for attaching the spacer tubing 256 to a tubing, where a hole 270 can be defined through the coupling 264 to admit wellbore fluids therein for pressure equalization.

Figure 69:
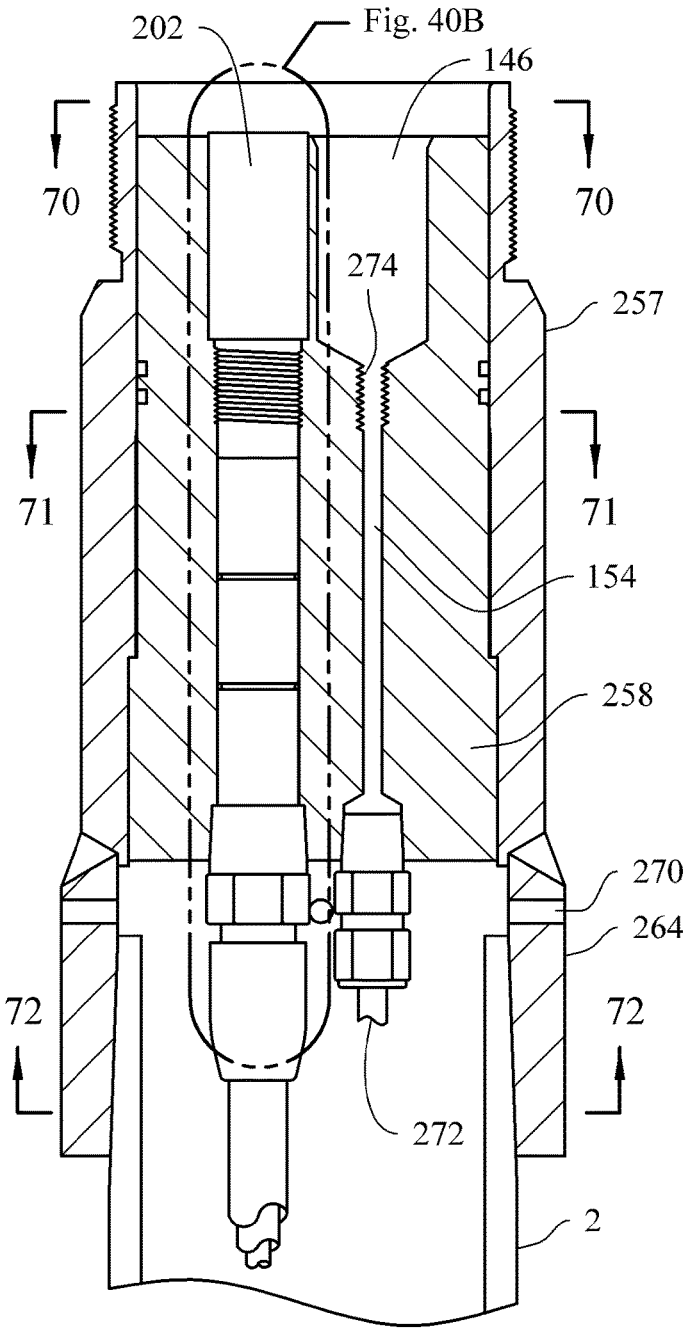
FIG. 69 is a cross-sectional view of the spacer tubing upper connector shell assembled with the core body taken along section FIG. 69 in FIG. 66.
Figure 70:
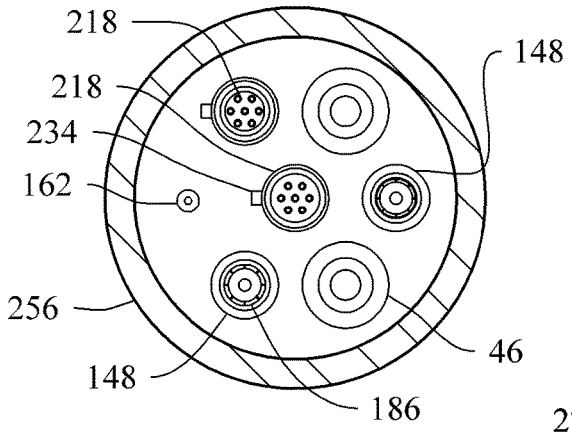
FIG. 70 is a cross-sectional view of the spacer tubing upper connector shell taken along line 70-70 in FIG. 69.
Figure 71:
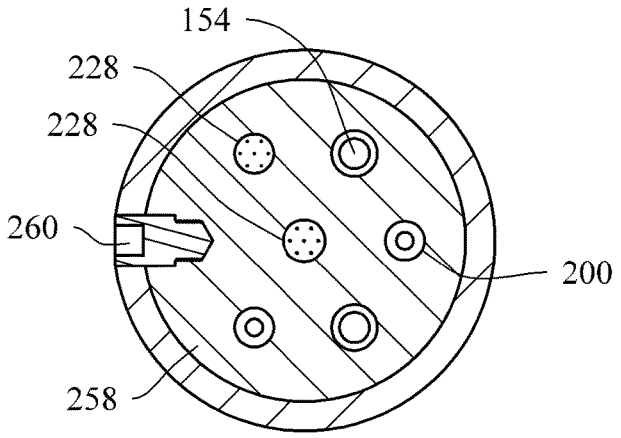
FIG. 71 is a cross-sectional view of the spacer tubing upper connector shell and the core body taken along line 71-71 in FIG. 69.

FIG. 69 is a longitudinal section to depict the power insert and guide pin cavity 146, flow channel 154 and tubing 272.

Power inserts in the adapters can be an insulated wire with solid copper conductor 200 that extends from adapter to adapter and through into the internal connectors 66. The flexible wall of a hose 268, with threaded connections at each end, filled with degassed insulating oil around the wire provides pressure equalization. FIG. 40B illustrates the taper sleeve 194 combined with the rubber wire seal insert 74 and the tapered interior surface of insulating sleeve 188 confines the insulating oil is contained. Holes in the threaded coupling and nipple enable wellbore fluid to enter the spacer tubing to ensure wellbore pressure is present on the exterior surface of the hoses. The hose 268 is a hose between spacer tubing connectors that contain power conductor.

Figure 75:
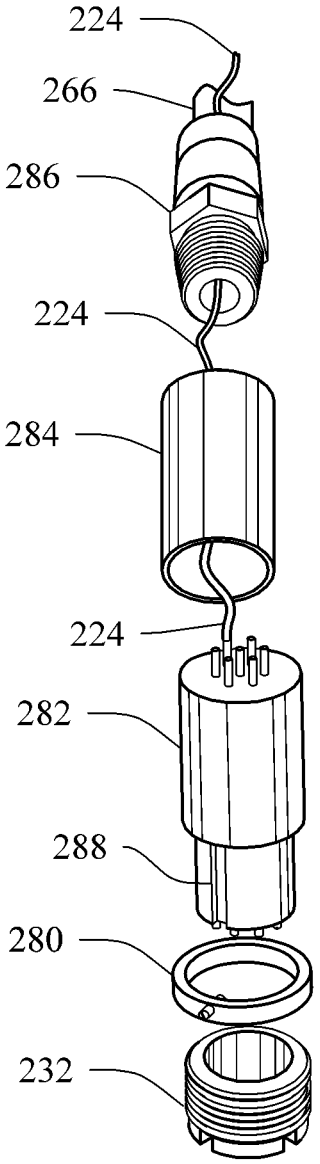
FIG. 75 is an exploded perspective view of the signal wire insert and an insulating sleeve of the spacer tubing lower body taken along section FIG. 75 in FIG. 74.
Figure 76:
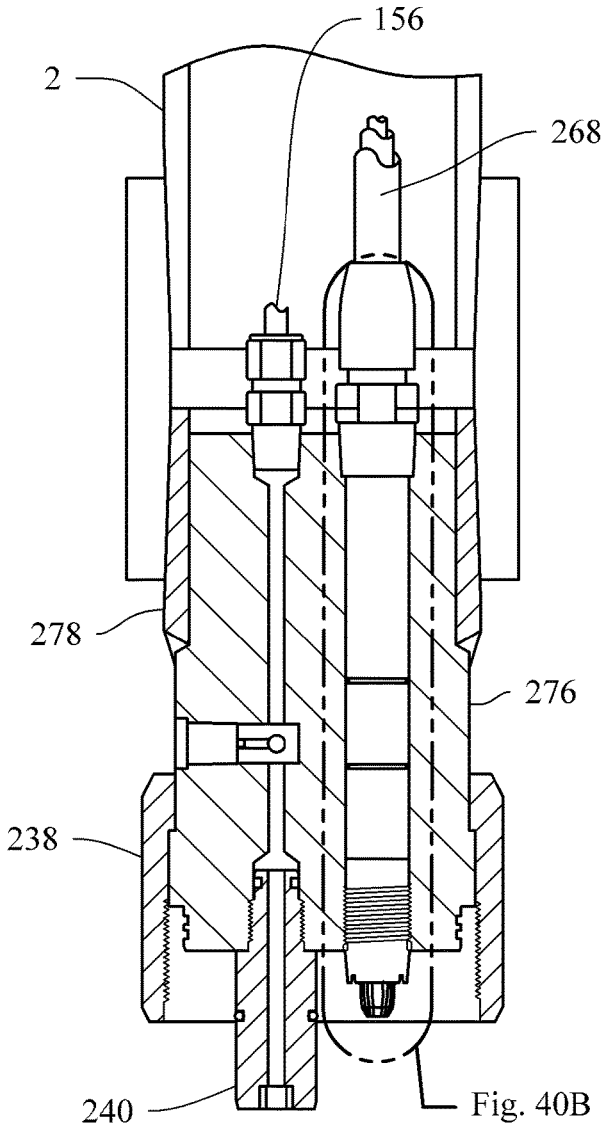
FIG. 76 is a cross-sectional view of the spacer tubing lower body taken along a different plane to that in FIG. 74.
Figure 77:
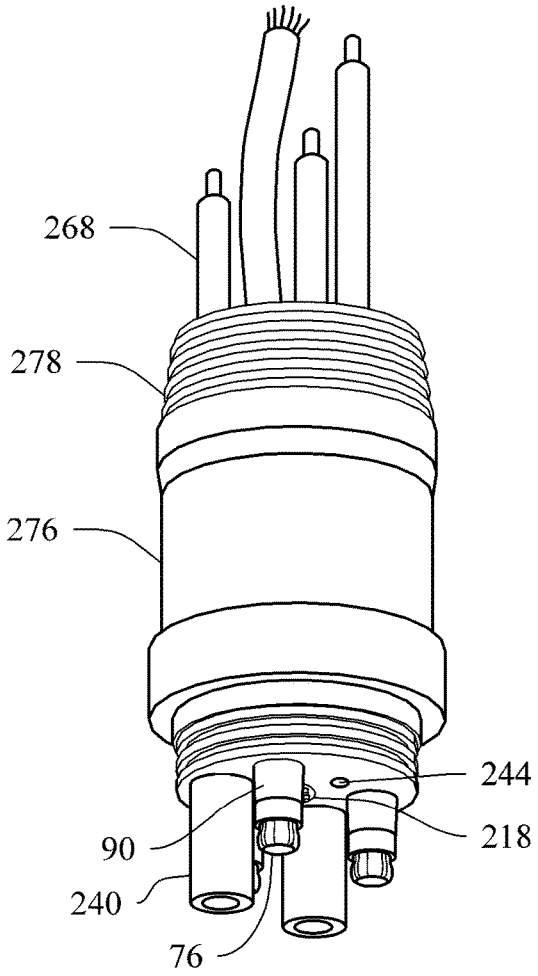
FIG. 77 is a perspective view of the spacer tubing lower body.

Signal inserts 282 are drawn into the core 258 from a tubing side which necessitates utilizing an alignment ring 280 and projections on an inside and outside riding in keyways 234, 288 to ensure rotational position. The ring 280 can include the projections or alignment pin, and can extend from the keyway 234 into a slot defined in the insert to provide rotational alignment, as best illustrated in FIG. 75.

Wires between adapters can be twisted, bundled, drawn through a hose 266 that extends from adapter to adapter or they may be gathered by means of a combiner hub 290 to run through one hose 266. The wires can then be crimped to appropriate conductors in signal insert 282. The insert is held in the core 258 by an internally threaded collar 232. Pressure compensation, as above, is provided by flexure of the hose wall.

Figure 73:
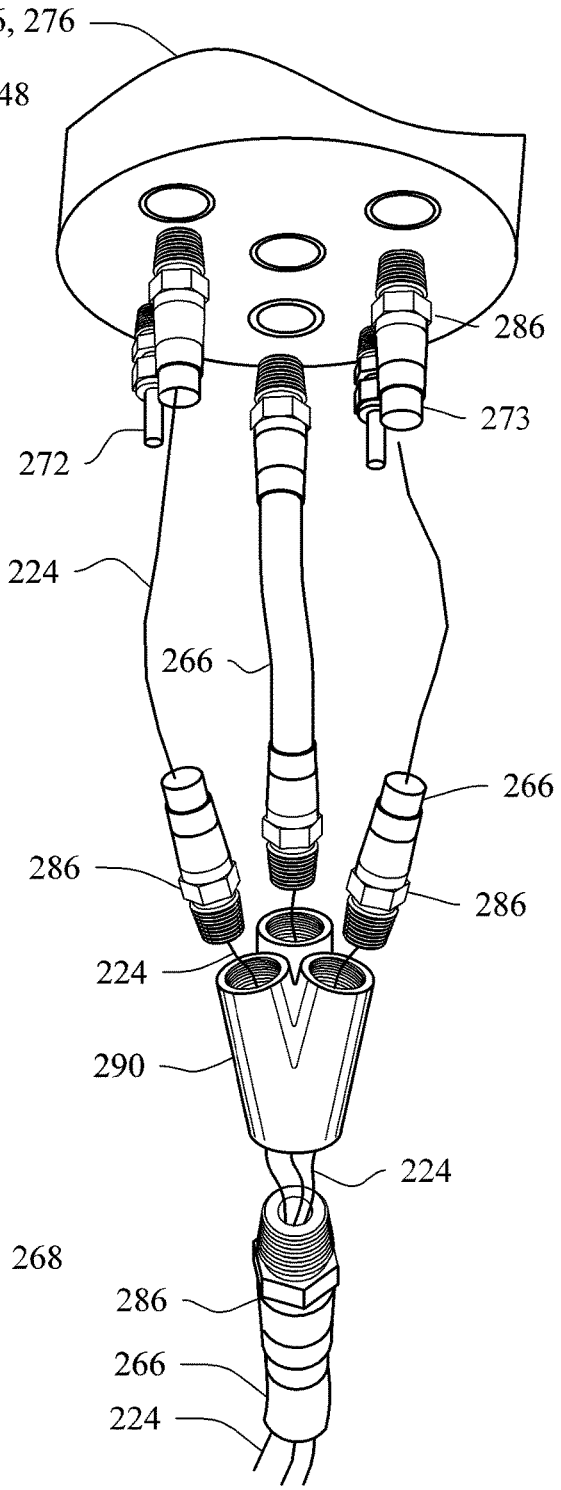
FIG. 73 is an enlarged exploded perspective view of the combiner hub utilized to combine the signal wires from the tool into a single hose in the spacer tubing taken along section FIG. 73 in FIG. 68.

The combiner hub 290 can be a multiple port hub to enable signal wires to be grouped into one hose 266 through the length of the spacer tubing, as best illustrated in FIG. 73. The combiner hub 290 can have a similar configuration at the other adapter. Hose adapters 286 can be utilized as connector bodies that are configured to connect the hose 266 to the upper body 257 or a lower body 276 of the spacer tubing, or other body.

Figure 72:
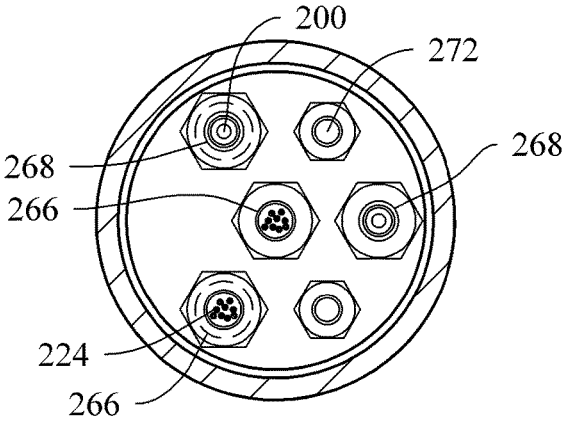
FIG. 72 is a cross-sectional view of the spacer tubing upper connector shell taken along line 72-72 in FIG. 69

FIG. 72 is a cross-sectional view illustrating the disposition of the hose 266, 268 and tube connections at the inner face of the adapters.

FIG. 74 is a longitudinal section depicting the adapter lower body 276 at the bottom end of the spacer tubing. It is similar to the upper body 257 except it is a one piece body with guide pins replacing the guide pin cavity and a shut off valve in the port 124 is included. Signal and power insert assemblies are the same as the upper adapter. A threaded connector nipple 278 can be utilized for attachment of the lower body 276.

As best illustrated in FIG. 75, the hose 266 including the signal wires 224 from the tool can be coupled to a hose adapter 286 that can connect to an NPT port in the lower body 276. An insulating sleeve 284 can be utilized to provide additional insulation for the insulated signal wires 224. The sleeve 284 can receive the signal insert 282, with the keyway 288 being defined in a length of the signal insert 282 along a longitudinal axis thereof. The alignment ring 280 with its alignment pin receives the section of the signal insert 282 that includes the keyway 288 so that the alignment pin is received in the keyway 288. Then the retaining collar 232 can be used to retain the signal insert 228.

A standalone packer 292 that may be configured for many different purposes is shown in FIGS. 60 and 78-88. It may be a lower packer for abandonment or injection activities or located to block bottom water or as a pair to block a stringer or similar applications. The capability of passing well fluids past a zone blocked when configured as a straddle packer is provided by plugs that may be placed within the packer passageways.

FIGS. 78-85 illustrates an independent packer 292 that may be deployed in one or more applications with the one or more embodiments of the present technology, and which can be placed between any tool sections. This independent packer 292 can have a lower connector body 296 in combination with the upper packers shown in FIGS. 6 and 22. The packer 292 can be utilized as a straddle packer when combined with the spacer tubing 256; or can be utilized as multiple straddle packers to block more than one zone. The lower connector body 296 can be used to connect the independent packer 292 to an upper end of the tool.

A lower packer sealing ring body 294 can be used to enable tubing makeup, and can act as an intermediate body to seal a lower end of the packer bladder 96 and packer fluid tubing connection.

Signal wires 298 can be utilized for interconnecting signal inserts, which can include crimped ends on the signal inserts. An insulated solid conductor power wire 302 to the ESP wire connector 76 can be used at each end.

A spacer ring 300 can be welded in place after the support pipe 72 is slid into position, thereby enabling space to tighten any hose connections.

Hose end connectors 304 can be used to connect the hose containing power wires to the upper body of the packer 292 and the lower connector body 296. The packer fluid connecting tubing 306 can be used as a continuation of the packer fluid channel 64.

Figure 86:
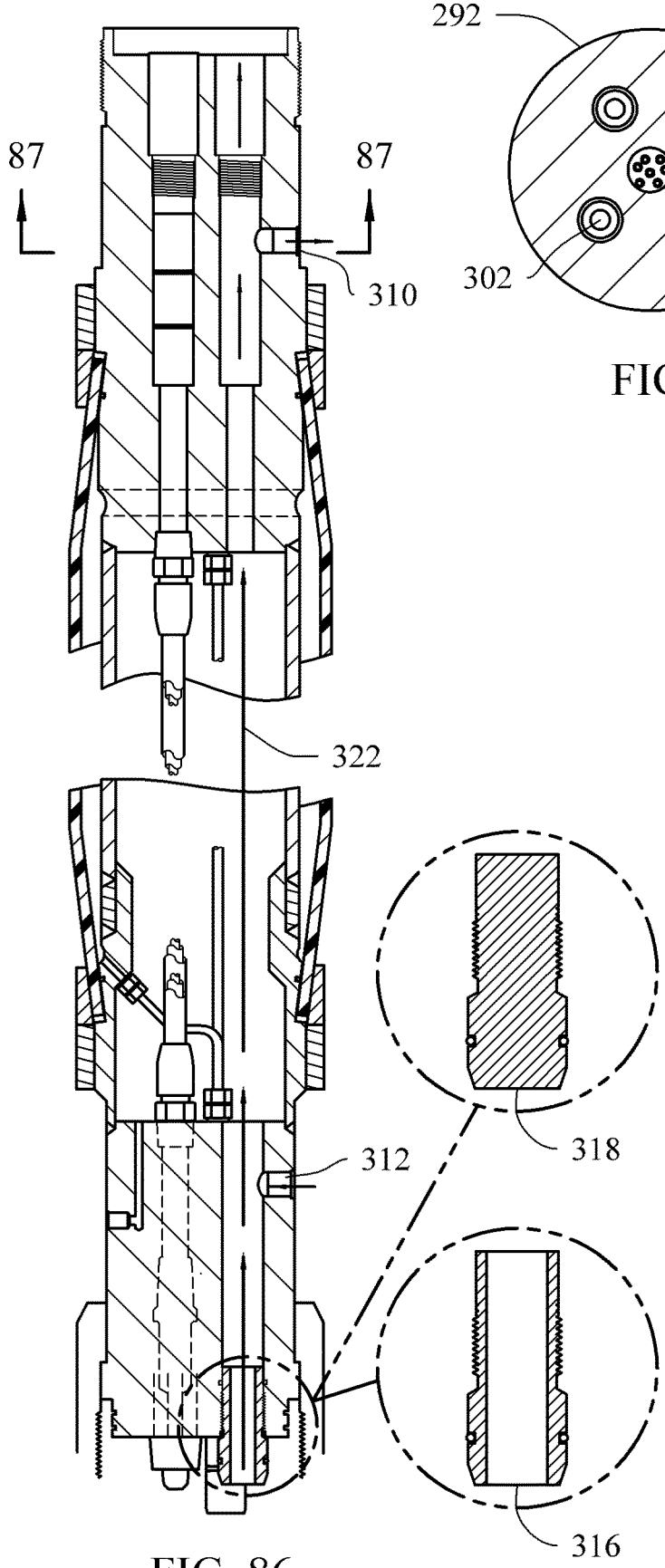
FIG. 86 is a cross-sectional view of the packer assembly showing the fluid flow into the lower packer connector body from the lower wellbore, through the packer chamber and exiting the upper packer connector body.
Figure 87:
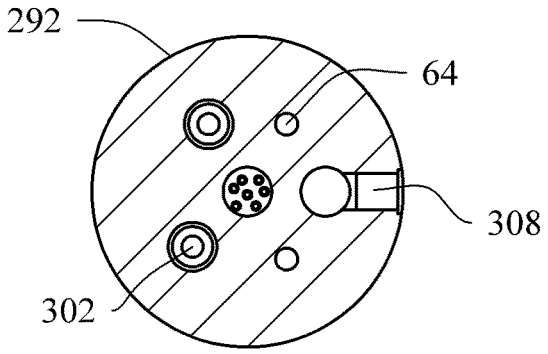
FIG. 87 is a cross-sectional view of the upper packer connector body taken along line 87-87 in FIG. 86.

A removable plug 308 can be used to block wellbore fluid from entering ports such as, but not limited to, an upper wellbore fluid port 310 and/or a lower wellbore fluid port 312, as best illustrated in FIG. 87. The ports 310, 312 are in communication with the insert channel to the wellbore at location respective of the upper body 292 and the lower connector body 296, as best illustrated in FIG. 86.

Figure 78:
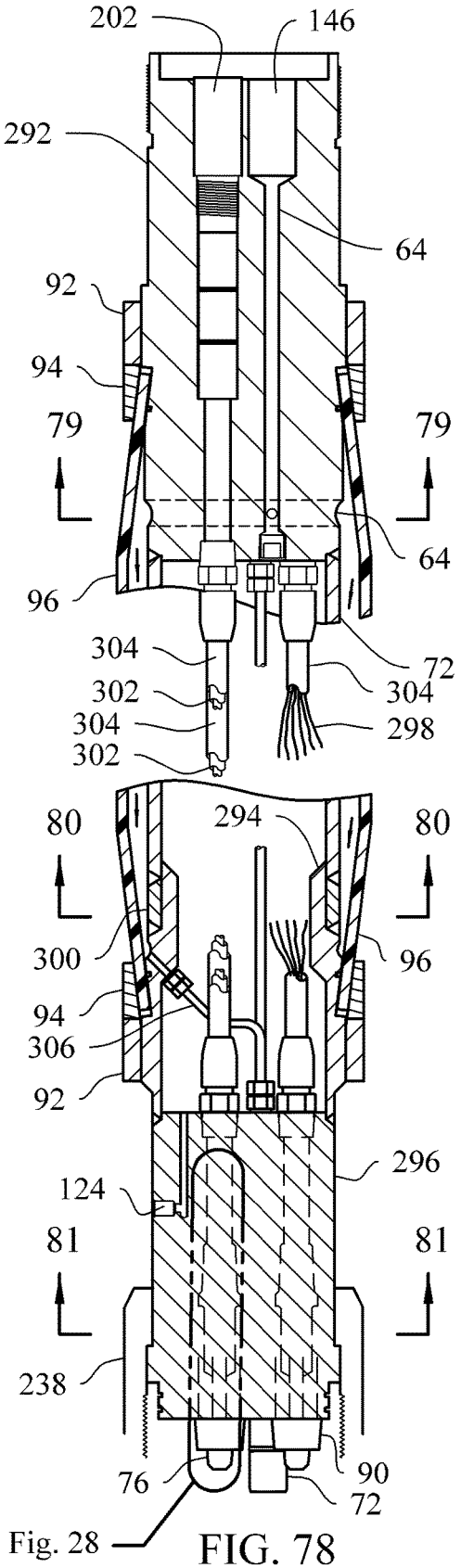
FIG. 78 is cross-sectional view of an upper packer connector body and a lower packer connector body taken along section FIG. 78 in FIG. 60.
Figure 79:
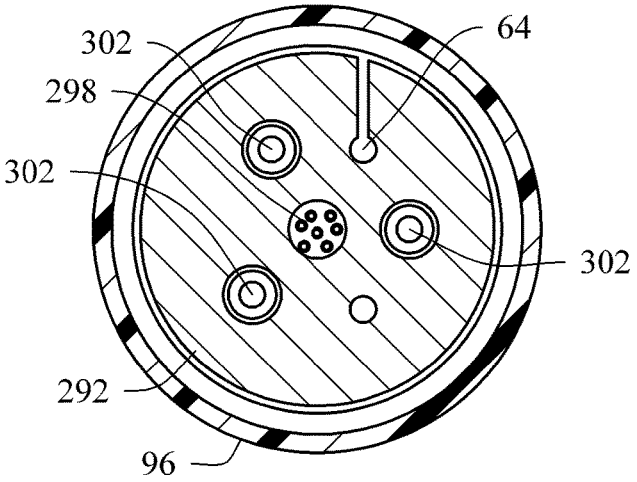
FIG. 79 is a cross-sectional view the upper packer connector body showing a chamber with the packer bladder taken along line 79-79 in FIG. 78.
Figure 80:
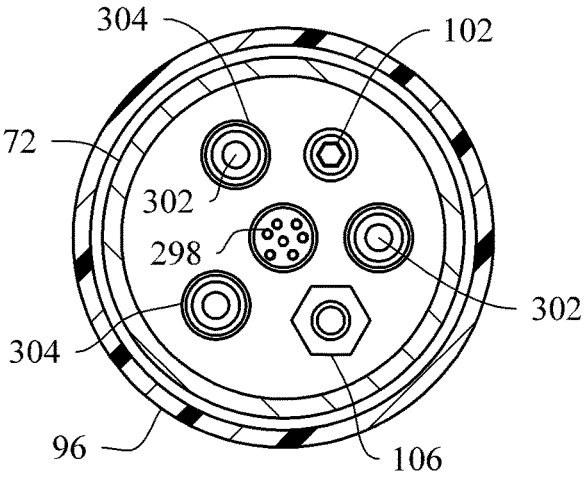
FIG. 80 is a cross-sectional view of a lower packer sealing ring body and the packer bladder taken along line 80-80 in FIG. 78.
Figure 81:
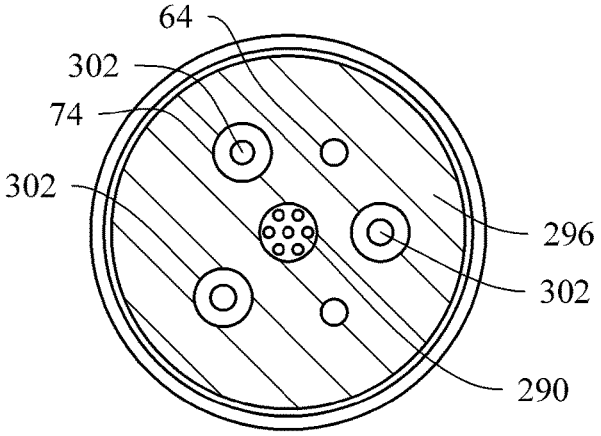
FIG. 81 is a cross-sectional view of the lower packer connector body taken along line 81-81 in FIG. 78.
Figure 82:
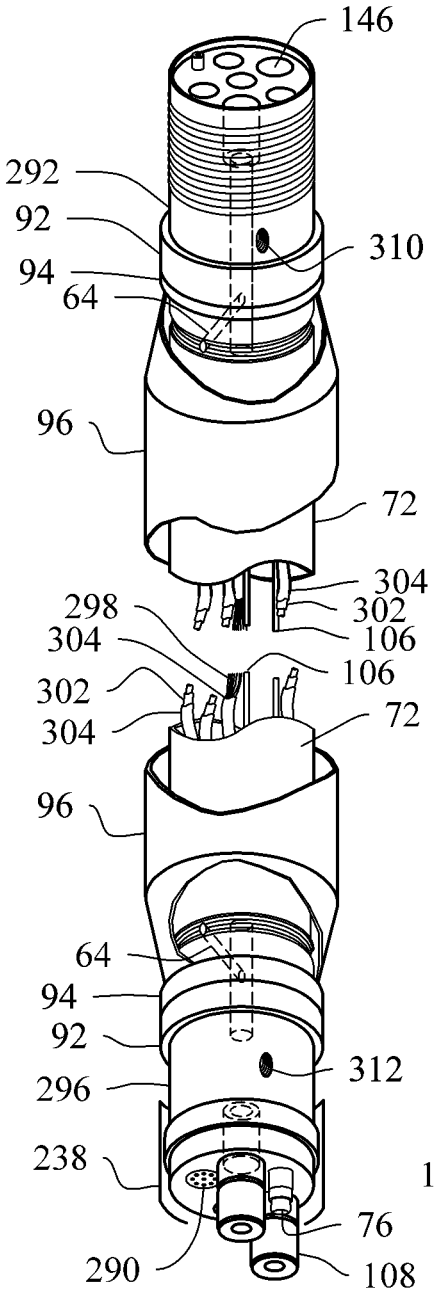
FIG. 82 is a cutaway perspective view of the upper and lower packer connector bodies and the packer bladder showing the support pipe.
Figure 83:
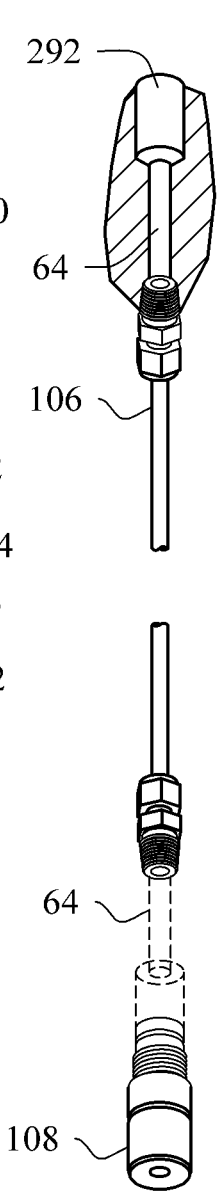
FIG. 83 is a perspective view of the tubing and connectors, the guide pin and the packer fluid channel of the packer assembly in FIG. 82.
Figure 84:
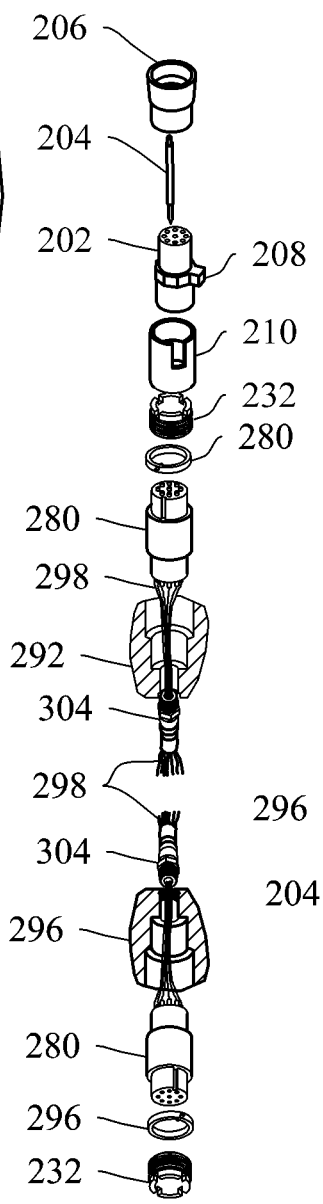
FIG. 84 is an exploded perspective view of the connection assembly of the packer assembly in FIG. 82.
Figure 85:
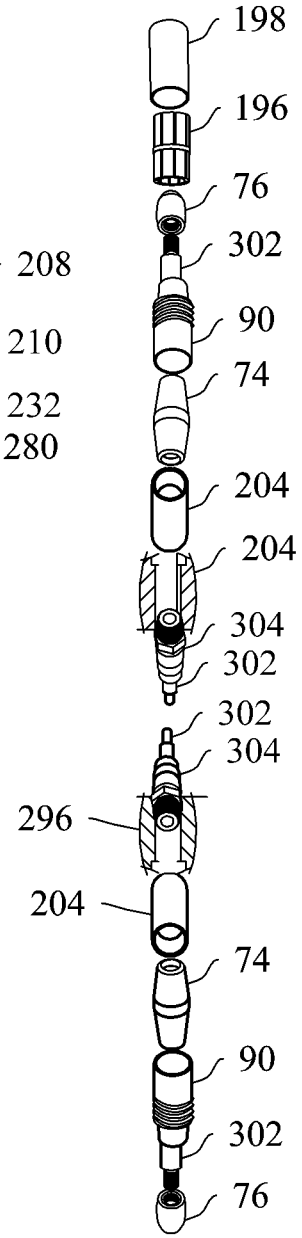
FIG. 85 is an exploded perspective view of the connectors of the connection assembly.

FIG. 86 illustrates a modification to the independent packer 292 shown in FIG. 78 and provides a passageway for wellbore fluids to flow through the packer in a controlled manner. The cavity of one insert in the independent packer's top and bottom connectors 292, 296 may be equipped with NPT threaded ports 310, 312 respectively, connecting the cavity to the annular wellbore space to enable wellbore fluid flow 322 past the packer.

Figure 88:
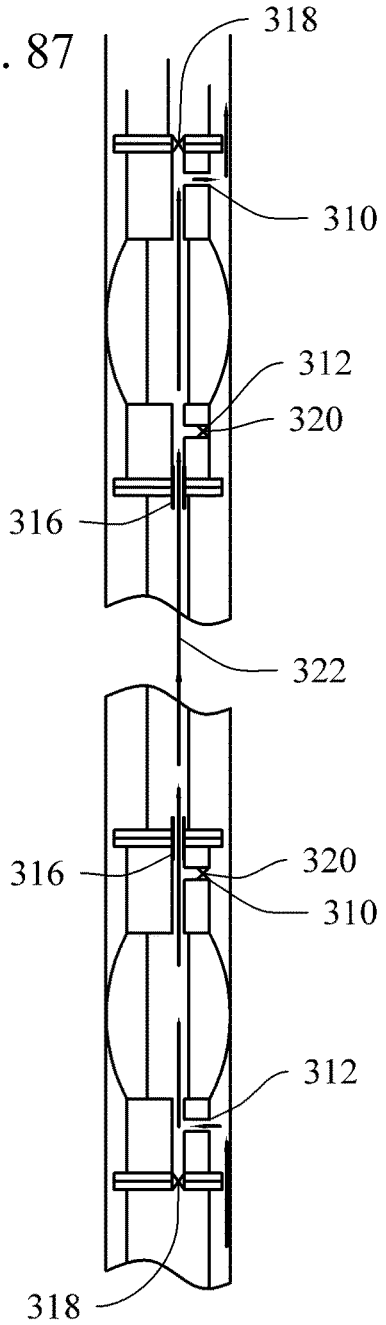
FIG. 88 is a schematical view illustrating wellbore fluid flow through multiple packers showing plugs and bypass sleeve positions.
Figure 89:
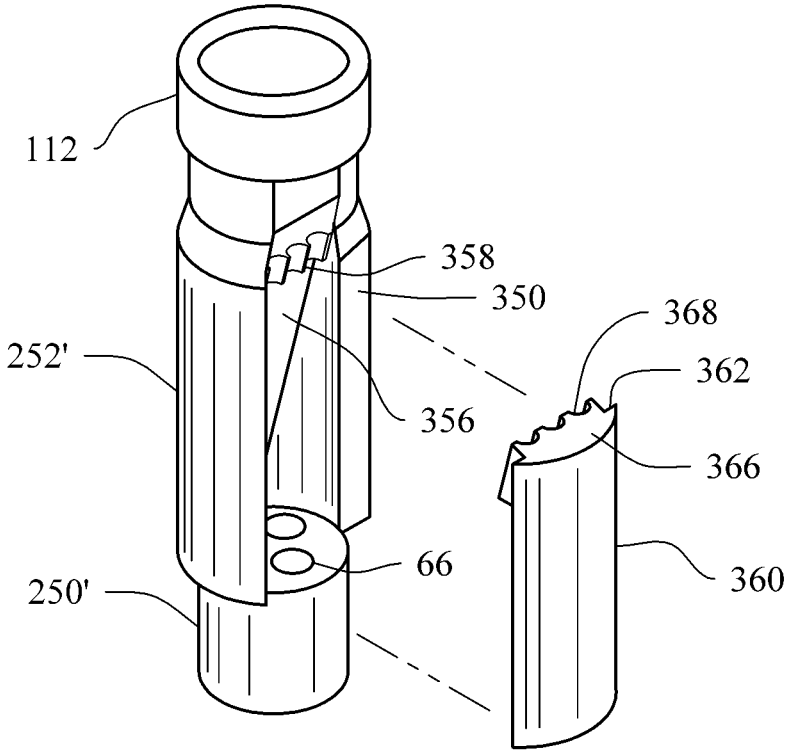
FIG. 89 is a perspective view of the alternate ESP connector body with the cover exploded and the alternate connector assembly.
Figure 90:
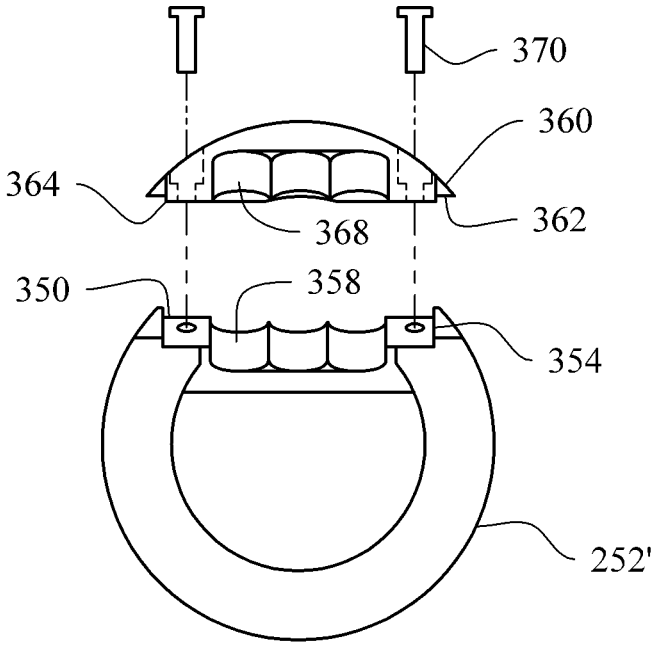
FIG. 90 is a top elevational of the alternate ESP connector body of FIG. 89 with the cover exploded.

FIG. 88 illustrates a straddle packer configuration in which two packers exclude flow of formation fluids from a zone between them and allow wellbore fluids 322 to flow past the zone. This is accomplished by using insert a solid plug 318 (see FIGS. 86 and 88) to plug the upper connector insert cavity of an upper packer, while leaving its upper wellbore port 310 open to the wellbore. Further, an insert bypass sleeve 316 including a passageway therethrough can be used in a lower connector insert cavity of the upper packer that connects with an upper connector of a spacer tubing as needed. The lower wellbore port 312 being plugged with a pipe plug 320.

Another insert bypass sleeve 316 can be inserted into the spacer tubing lower body, which is according attached to an upper body of a lower independent packer. The upper wellbore port 310 of a lower packer can be plugged with the pipe plug 320, with its lower wellbore port 312 being open to the wellbore. Further, a solid plug 318 can be used to plug the lower connector insert cavity of the lower packer.

The above configuration would accordingly allow wellbore fluid 322 to enter the lower port 312 of the lower packer and travel through the lower packer and the spacer tubing by way of the lower insert bypass sleeve 316. After which, the wellbore fluid 322 can then travel from the spacer tubing through upper packer by way of the upper insert bypass sleeve 316 and past the plugged lower port 312. The fluid flow 322 can then exit the upper packer by way of the upper port 310.

FIGS. 89-94 shows an embodiment of a longitudinal section depicting the ESP power cable 20 and capillary tubing connection and sealing for the upper part of a connector assembly when the wires extend through to terminate as insert connectors 76. It may or may not include a capillary tube 116 and fluid passageway. The connector assembly coupling 112 having matching threads attaches to the wellbore tubing 2 and on its bottom end attaches to an upper end of an adapter body 252' with a connector assembly 250' thereby carrying the weight of the tool and providing electrical and fluid connectivity.

The adapter body 252' can be similar to the adapter body 252 shown in FIGS. 62 and 63, however with a removable cover 360 that covers an interior chamber 352 defined in the adapter body 252' by sidewalls 350. In the interior chamber 352 can be a sloped or angled recessed face 356 to enable ESP cable 66 and capillary tubing 116 entry to the connector 250'.

Figure 91:
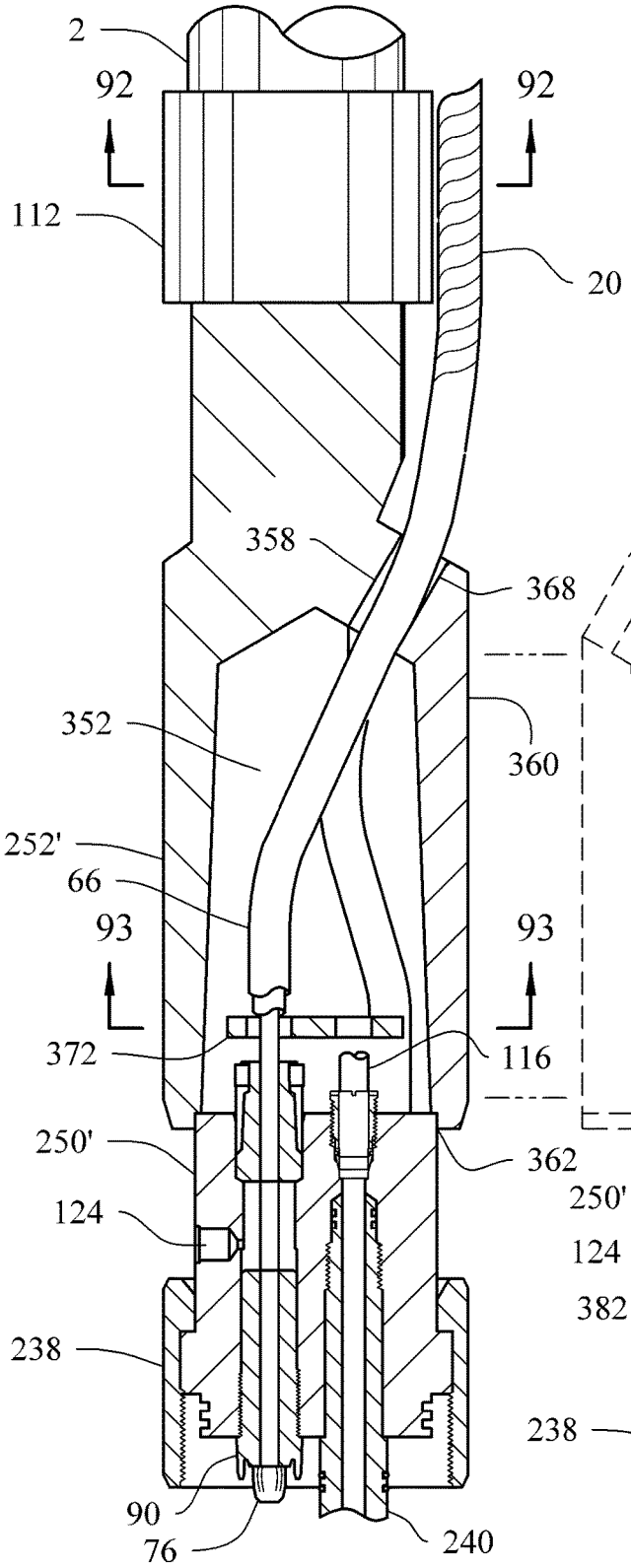
FIG. 91 is a cross-sectional view of the alternate ESP connector body of FIG. 89 showing capillary tubing and an alternate adapter body.
Figure 92:
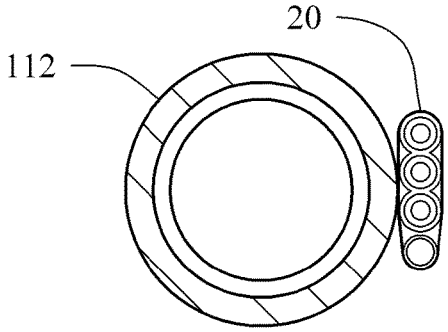
FIG. 92 is a cross-sectional view of the power cable exterior of the connector assembly coupling taken along line 92-92 in FIG. 91

The angled recessed section 356 is configured to receive the power cable 20 from the side of the tubing 2 and/or the connector assembly coupling 112, as best illustrated in FIGS. 91 and 92, and direct it toward an interior chamber 352 by way of guide slots or grooves 358 defined or associated with the angled recessed section 356 adjacent to where the cables or tubing enter the interior chamber 356.

Three or more passageways can be defined in a terminus of a sloped or angled recessed section 363 of the adapter body 252' for ESP wires 66 of the ESP power cable 20 to enter the connector assembly 250'. The sidewalls 350 of the adapter body 252' can include a ledge 364 that are configured to mate with corresponding ledges 354 of the sidewalls 362 of the cover 360.

An angled member 366 of the cover 360 can be defined at angle similar to that of the angled recessed section 356, and can further include guide slots or grooves 368 that have a configuration corresponding with the grooves 358 of the adapter body 252'. In the exemplary, the grooves 358 of the adapter body 252' can be configured to receive a first half of the ESP wires 66 while the grooves 368 of the cover 360 can be configured to receive a second half of the ESP wires 66.

With the ESP wires 66 or tubing received in separate grooves 358, the cover 360 can be mated with the adapter body 252' so that the interior chamber 352 is covered by the cover 360. Fasteners 370 can be utilized to secure the cover 360 to the adapter body 252'.

The cover 360 can include sidewalls 362 that correspond and mate with the sidewalls 350 of the adapter body 252', thereby allowing the cover 360 to cover and seal off the interior chamber 352.

It can be appreciated that when the cover 360 is secured to the adapter body 252', that the grooves 258, 358 create bores that are configured to receive at least one of the ESP wires 66 and guide them into the interior chamber 352.

Figure 93:
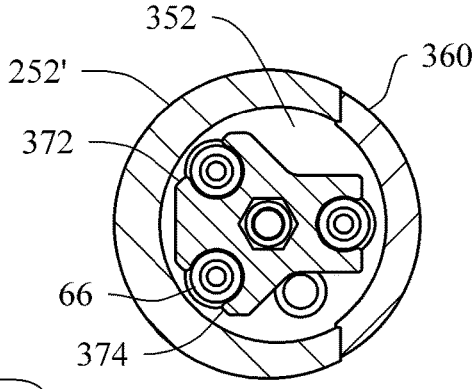
FIG. 93 is a cross-sectional view of the alternate ESP connector body taken along line 93-93 in FIG. 91.

In an embodiment, a cable guide plate 382 can be utilized in the interior chamber 352 to separate the ESP wires 66 and guide them toward their corresponding connectors in the connector assembly 250'. The guide plate 382 can include cable notches 374 each configured to receive one of the wires 66. The notches 374 can be defined in the guide plate 382 in a pattern that corresponds with a layout of the connectors in the connector assembly 250', as best illustrated in FIG. 93.

The connector assembly 250', can include a spider connector 380 associated with a spring 382 for connection with at least one of the wires 66, as best illustrated in FIG. 94. The spider connector 380 and spring 382 assembly is configured to ensure pressure is placed on any rubber seals associated with the connection during temperature and pressure variations encountered in the interior chamber 352 and/or with the connector assembly 250'.

In an embodiment, any one of the connector embodiments 60, 126, 140, 236, 250, 250', 254, 256, 276, 292, 296 of the present technology offer many advantages over known connectors such as, but not limited to, enabling quick assembly of downhole system. One or more embodiments of the connectors enable interchangeable components to facilitate different configurations and tubing spacers to create long strings. One or more embodiments of the connectors avoids errors and time needed when employing conventional wire splicing connection methods. Passages may be used for inflating multiple packers, for pressure equalization between parts, for cooling fluid within the tool, for flushing fluid to mitigate sanding-in. ESP cables with capillary tubing enables fluid from surface sources to be delivered into the tool. The use of guide pins allow continuity of multiple fluid passages through the connections. Further, the guide pins enable positive alignment to prevent damage and speed assembly. The use of hard rubber core encasing power and signal connectors enable accommodation of moderate miss-alignment between connected components. Spherically shaped power plugs within a barrel cylindrical segmented sleeve enables contact continuity during miss-alignment. The use of spring loaded pins in the signal connectors ensure contact during miss-alignment.

In an embodiment, any one of the packer embodiment of the present technology offer advantages over known packers such as, but not limited to, they may be deployed by a remote pressure source or by electrical control from the PCU. One or more embodiments of the packer of the present technology may be used for any one of or any combination of abandonment, for mitigating water inflow, for Steam-Assisted Gravity Drainage (SAGD) applications, for methane production from methane hydrate, for solution mining, and/or for applying heat during sequestering operations. Any one or the packers may be used to localize injection for reservoir squeezes and other remediation.

Another advantage of the any one of the embodiments of the present technology is the resulting pressure compensation along the length of the tool, packer or tubing. The use of a flexible tube extending the length of the tool in combination with a buffer chamber and an external port enables equalization of internal pressure with wellbore pressure. Wellbore pressures in excess of 5,000 PSI (34 MPa) may be accommodated as a result of equalized pressure. The use of the flexible tube avoids the disadvantages found in "flex plates".

In use of any one of the embodiments of the present technology, it can be appreciated that the internal volume of the device/tool (volume compensation) to ensure a balance between pressure on the external surface of the enclosure and internal pressure is maintained throughout the device/tool in order to avoid damage to the device/tool enclosure. Without compensation any event that creates pressure within the device/tool that is greater than the external pressure may stress the enclosure causing it to yield resulting in an increased internal volume. A common cause of an increase in volume is due to thermal expansion of the components within the device. Similarly a decrease in volume either as a result of a return to previous conditions or other factors such as but not limited to a compressible component within the device may cause collapse, crushing or damage to the enclosure. In addition to thermal related volume changes air or gas may be entrained in the gel or liquid employed as fill around components within a device/tool rendering the device/tool susceptible to collapse when external pressure is sufficient to distort or crush the device/tool enclosure. Conditions under which the device/tool operates and construction of the device/tool affects the embodiments with respect to material selection, volume of compensation required, fluid selection and assembly procedures.

The embodiment hoses must remain flexible during operation of the device/tool and have a volume displacement adequate to adjust compensator volume to equalize pressure without compromising the membrane due to over pressure or excessive flexing causing a short fatigue life.

Operation of any one or all embodiments may include implementations to ensure there is adequate expansion and compression volume within the membrane to avoid rupture and extreme collapse, and to ensure the membrane range of motion in combination with the number of flexures will provide a reasonable operational fatigue life.

While a long hose is shown in order to illustrate operation of one or more embodiments, this function may be provided by other shapes, components or means. Pressure equalization is accomplished by allowing fluid from the exterior surface to exert pressure across a membrane (hose in the present embodiment) within the device resulting in a change in volume enclosed by the membrane. The volume within the membrane increases or decreases in response to volume changes of components within the device to balance pressure across the device enclosure thus preventing crushing or stretching of the enclosure. One embodiment can consist of a means of distributing the means of volume compensation along components and the enclosing surface. Another embodiment may consist of a means of adjusting the volume within the first embodiment in order to equalize pressure between the interior and exterior surfaces of the device enclosure.

The hose is an embodiment within which a volume change can be affected as a means of pressure compensation. All devices of the present technology may include a compensator section wherein the hose extends alongside the device components. Some devices may have an additional section known as a compensator chamber which provide a means of ensuring a compatible fluid is present in the compensator adjacent to the device components while fluid from the external surface is present in the compensator chamber. The compensator chambers provide an isolating barrier between exterior surface fluids and the fluid adjacent to the device components. In the event that more compensator chamber capacity is required some devices may be equipped with an additional external compensator chamber.

Fluids and/or gels may be used as fillers around components and should be free of compressible gasses and have near constant vapor pressure through the pressure and temperature range. In the exemplary, a heat transfer fluid, as used in power transformers, may be used to fill the compensators. Repeated cycling from atmospheric to approximately 24 inch Hg (mercury) vacuum to degas the fluids around components and within the compensators may be needed to ensure compressible gasses and off gasses are removed.

Fluid passageways in combination with hollowed guide pins, power and signal inserts, and hoses provide one means of quickly assembling the tool string while allowing for any misalignment along with pressure compensation along the length of the device.

While embodiments of the well tool pressure compensating system have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although utilizing a plug assembly to connect adjacent well tubing have been described, it should be appreciated that the well tool pressure compensating system herein described is also suitable for any connection between downhole assemblies, pipes, tubes, components and the like that can benefit from quick connector alignment and/or pressure compensation.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A well tool pressure compensating system comprising:

a first connector body comprising:

one or more first fluid components configured to allow fluid to pass therethrough; and one or more first electrical components configured for connection with one or more wires associated with a well tool;

a second connector body comprising:

one or more second fluid components configured to allow the fluid to pass therethrough; and one or more second electrical components configured for connection with the wires; and a compensation hose traveling within the well tool and in fluid communication with a wellbore fluid in a wellbore, the compensation hose being configured to provide pressure and thermal compensation along the well tool;

wherein the compensation hose includes an outer hose enclosed by a gel within the well tool, and an inner hose in fluid communication with the wellbore fluid.

2. The well tubing pressure compensating system according to claim 1 further comprises a guide pin associated with any one of the first fluid components and the second fluid components, wherein the guide pin defines a passageway therethrough allowing the fluid to therethrough.

3. The well tubing pressure compensating system according to claim 1 further comprising a connector chamber defined between the first connector body and the second connector body, wherein the connector chamber is pressure compensated with respect to the well tool and the wellbore.

4. The well tubing pressure compensating system according to claim 1, wherein the first electrical components each include a first power insert, and the second electrical components each includes a second power insert, wherein the first power insert and the second power insert are operatively engageable with each other.

5. The well tubing pressure compensating system according to claim 4, wherein the first power insert is a sleeve, and the second power insert is a connector receivable in the sleeve.

6. The well tubing pressure compensating system according to claim 5, wherein the connector has a barrel or curved shape configured to accommodate misalignment when the connector is engaged in the sleeve.

7. The well tubing pressure compensating system according to claim 1, wherein the first electrical components each includes a first signal insert, and the second electrical components each includes a second signal insert, wherein the first signal insert and the second signal insert are operatively engageable with each other.

8. The well tubing pressure compensating system according to claim 7, wherein the first signal insert and the second signal insert each include one or more spring pins.

9. The well tubing pressure compensating system according to claim 1 further comprising one or more register pins associated with any one of the first connector body and the second connector body, the register pins are configured to ensure rotational alignment and torsion restraint when the first connector body or the second connector body is joined with a mating body, respectively.

10. The well tubing pressure compensating system according to claim 1, wherein the first connector body comprises:

an upper connector body including the first electrical components and the first fluid components;

a first intermediate body engageable to the upper connector body, the first intermediate body includes one or more first passageways defined therethrough each in fluid communication with the first fluid components and the first tubing, respectively, and one or more first electrical inserts in communication with the first electrical components and the wires; and a first compensator connector body engageable to the first intermediate body and the well tool, wherein a first end of the compensation hose is associated with the first compensator connector body, and an interior of the first compensator connector body is in communication with an interior of the well tool to contain a gel for providing any one of or combination of pressure and thermal compensation to the compensation hose.

11. The well tubing pressure compensating system according to claim 10, wherein the second connector body comprises:

a second compensator connector body engageable to the well tool opposite to the first compensator connector body, wherein a second end of the compensation hose is associated with the second compensator connector body, and an interior of the second compensator connector body is in communication with the interior of the well tool to contain the gel;

a second intermediate body engageable to the second compensator connector body, the second intermediate body includes one or more second passageways defined therethrough each in fluid communication with the first tubing and the second fluid components, respectively, and one or more second electrical inserts in communication with the second electrical components and the wires; and a lower connector body engageable with the second intermediate body, the lower connector body including the second electrical components.

12. The well tubing pressure compensating system according to claim 11, wherein a hollow guide pin connects each of the first fluid components with the second fluid components, respectively.

13. The well tubing pressure compensating system according to claim 11 further comprising a flexible tubing extending between the first intermediate body and the second intermediate body, the flexible tubing being in fluid communication with an area around the first electrical inserts and an area around the second electrical inserts.

14. The well tubing pressure compensating system according to claim 1 further comprising a first tubing in fluid communication with at least one of the first fluid components and at least one of the second fluid components.

15. The well tubing pressure compensating system according to claim 1 further comprising one or more capillary tubes in fluid communication with any one of the first fluid components and the second fluid components.

16. The well tubing pressure compensating system according to claim 1, wherein the well tool is selected from the group consisting of an induction heater, a packer, and a spacer tubing.

17. The well tubing pressure compensating system according to claim 16, wherein the well tool is a packer including a bladder and a support pipe inside the bladder, and wherein an internal area between the support pipe and the bladder is in fluid communication with the first fluid components and the second fluid components, respectively.

18. A well tool pressure compensating system comprising:

a first connector body of a well tool, the first connector body comprising:

one or more first fluid components configured to allow fluid to pass therethrough; and one or more first electrical components configured for connection with one or more wires associated with the well tool;

a second connector body of the well tool opposite the first connector body, the second connector body comprising:

one or more second fluid components configured to allow the fluid to pass therethrough; and one or more second electrical components configured for connection with the wires associated with the well tool;

a first tubing in fluid communication with at least one of the first fluid components and at least one of the second fluid components;

a hose assembly traveling along and within the well tool and in fluid communication with a wellbore fluid in a wellbore, the hose assembly includes an outer hose enclosed by a gel within the well tool, and an inner hose in fluid communication with the wellbore fluid, the hose assembly being configured to provide pressure and thermal compensation along the well tool; and a flexible tubing extending between the first connector body and the second connector body, the flexible tubing being in fluid communication with an area around the first electrical components and an area around the second electrical components.

19. A method of using a well tool pressure compensating system, the method comprising the steps of:

a) providing a first connector body on a well tool and a second connector body on the well tool opposite the first connector body, the first connector body including one or more first fluid components and one or more first electrical components, the second connector body including one or more second fluid components and one or more second electrical components;

b) allowing a fluid to flow between the first fluid components and the second fluid components by way of a first tubing extending within the well tool between the first connector body and the second connector body; and c) exposing a wellbore fluid from a wellbore to both ends of a hose extending along and within the well tool between the first connector body and the second connector body, wherein the hose includes an outer hose enclosed by a gel within the well tool, and an inner hose in fluid communication with the wellbore fluid.

* * * * *